US007823356B2

(12) United States Patent
Tanaka

(10) Patent No.: US 7,823,356 B2
(45) Date of Patent: Nov. 2, 2010

(54) SHEARING FORCE REINFORCED STRUCTURE AND MEMBER

(75) Inventor: Yoshihiro Tanaka, Tokyo (JP)

(73) Assignee: Taisei Corporation, Tokyo (JP)

( * ) Notice: Subject to any disclaimer, the term of this patent is extended or adjusted under 35 U.S.C. 154(b) by 260 days.

(21) Appl. No.: 10/588,499

(22) PCT Filed: Jan. 13, 2005

(86) PCT No.: PCT/JP2005/000296

§ 371 (c)(1),
(2), (4) Date: Aug. 4, 2006

(87) PCT Pub. No.: WO2006/018908

PCT Pub. Date: Feb. 23, 2006

(65) Prior Publication Data

US 2007/0175127 A1 Aug. 2, 2007

(30) Foreign Application Priority Data

Aug. 18, 2004 (JP) ..... 2004-237999
Aug. 18, 2004 (JP) ..... 2004-238760
Aug. 18, 2004 (JP) ..... 2004-238763
Aug. 18, 2004 (JP) ..... 2004-238814

(51) Int. Cl.
*E02D 37/00* (2006.01)
*E04B 1/98* (2006.01)
*E04C 2/06* (2006.01)

(52) U.S. Cl. ..... 52/514.5; 52/414; 52/600

(58) Field of Classification Search ..... 52/414, 52/334, 432, 514.5, 514, 167.1, 231, 707, 52/708, 711, 431, 600
See application file for complete search history.

(56) References Cited

U.S. PATENT DOCUMENTS 1,734,358 A * 11/1929 Yeager ..... 52/340

(Continued)

FOREIGN PATENT DOCUMENTS

JP 7-238690 9/1995

(Continued)

*Primary Examiner*—Robert J Canfield
*Assistant Examiner*—Brent W Herring
(74) *Attorney, Agent, or Firm*—Kratz, Quintos & Hanson, LLP

(57) ABSTRACT

The purpose of the present invention is to provide a shearing force reinforced structure of an existing RC structure body that can simply and surely ensure a predetermined pulling-out rigidity. Then a shearing force reinforced structure (1) of the invention is configured with: a side wall (W) of an existing reinforced concrete structure; shearing force reinforced members (20) arranged inside reinforced member insertion holes (10) with bottoms formed in a direction intersecting a major reinforcing bar of the side wall (W); and fillers (30) filled in the holes (10), wherein each of the shearing force reinforced members (20) is configured with a shearing force reinforcing bar (21), a plate head 23 and a ring head (22) respectively fixed at a base end and top end of the reinforcing bar (21); each of the holes (10) is formed at a general part (12) having an inner diameter larger than a reinforcing bar diameter of the reinforcing bar (21) and smaller than a width of the head (23), and a base end width broadening part (11) formed at a base end of the hole 10 and having a diameter larger than the width of the head (23). In accordance with such a shearing force reinforced structure and a shearing force reinforced member, it is enabled to simply and surely ensure a predetermined pulling-out rigidity.

25 Claims, 26 Drawing Sheets

U.S. PATENT DOCUMENTS

| | | | | | |
|---|---|---|---|---|---|
| 1,832,397 | A | * | 11/1931 | Hultquist | 52/586.1 |
| 3,600,868 | A | * | 8/1971 | Wilson et al. | 52/334 |
| 4,406,103 | A | * | 9/1983 | Ghali et al. | 52/260 |
| 5,125,200 | A | * | 6/1992 | Natterer | 52/223.8 |
| 5,426,903 | A | * | 6/1995 | Ramm et al. | 52/334 |
| 5,493,833 | A | * | 2/1996 | Irimies | 52/336 |
| 5,606,839 | A | * | 3/1997 | Baumann | 52/848 |
| 5,682,712 | A | * | 11/1997 | Kemeny | 52/167.7 |
| 5,809,722 | A | * | 9/1998 | Bertsche | 52/334 |
| 5,867,960 | A | * | 2/1999 | Andra et al. | 52/649.1 |
| 5,884,440 | A | * | 3/1999 | Kubo et al. | 52/167.1 |
| 5,992,123 | A | * | 11/1999 | Kies | 52/719 |
| 6,860,935 | B2 | * | 3/2005 | Rossi | 106/644 |
| 7,584,581 | B2 | * | 9/2009 | Iske | 52/380 |
| 2002/0069602 | A1 | * | 6/2002 | Blanchet | 52/600 |
| 2003/0000165 | A1 | * | 1/2003 | Tadros et al. | 52/223.4 |
| 2004/0074183 | A1 | * | 4/2004 | Schneider et al. | 52/334 |
| 2004/0161305 | A1 | * | 8/2004 | Simmons et al. | 405/259.1 |
| 2010/0101160 | A1 | * | 4/2010 | Bongiorno | 52/167.1 |

FOREIGN PATENT DOCUMENTS

| | | | | |
|---|---|---|---|---|
| JP | 07238690 | A | * | 9/1995 |
| JP | 2002-137952 | | | 5/2002 |
| JP | 2003-3556 | | | 1/2003 |
| JP | 2003-113673 | | | 4/2003 |

* cited by examiner

SHEARING FORCE REINFORCED STRUCTURE AND MEMBER

TECHNICAL FIELD

The present invention relates to a shearing force reinforced structure and member (this means "reinforced structure and member for resisting a shearing force") of a reinforced concrete structure object with respect to a structure object of an existing reinforced concrete (hereinafter a reinforced concrete may be referred to as "RC" in some case) where the shearing force acts.

BACKGROUND ART

In various establishments such as a subway and a water and sewerage purifying establishment designed and constructed before the Great Hanshin Earthquake, it is clarified that a reinforced concrete structure object (hereinafter referred to as referred to as "RC structure body" in some case) such as a side wall, bottom slab, intermediate wall, and intermediate slab of a box culvert and underground embedded structure object of an RC structure constituting a structure object skeleton of the various establishments; and a wall type bridge pier is poor in shear force capacity with respect to a seismic vibration of a level 2 as a result of various aseismatic diagnoses: thus a necessity for speedily performing an aseismatic reinforcement is pointed out.

Conventionally, as a reinforced structure of such the RC structure body are adopted such a thickness increasing method of performing a reinforcing bar arrangement of a major reinforcing bar and a minor reinforcing bar along a face of the RC structure body and casting a concrete; and a steel plate lining method of lining a steel plate around the RC structure body and filling a filler such as a mortar and a resin between the RC structure body and the steel plate. However, in these structures, because a thickness of such a side wall and a bottom slab increases after the reinforcement and an inside space section of a skeleton decreases, there exists a problem that various inconveniences occur (for example, in a case of a water and sewage purification establishment occurs a decrease of a reserving capacity and a processing capacity; in a case of a subway, because a construction limit becomes not satisfied, the subway results in not being usable in some case). In addition, in the thickness increasing method, because the major reinforcing bar increases, thereby shear force capacity is improved, and on the other hand a bending moment capacity increases, it is difficult to realize a request of changing a shearing preceding failure type to a bending preceding failure.

Furthermore, the thickness increasing method requires a large scale crane in carrying in and building reinforcement members such as a steel plate and a reinforcing bar, and there exists some case that an execution thereof is difficult due to a restriction of the large scale crane in a restricted space such as an inside of an underground structure object and a bridge. In addition, in a shear force reinforcement inside a road tunnel and a railroad tunnel in common use, there exists some case that an execution is difficult with respect to a request for a rapid execution inside a restricted time zone at night due to a restriction of a traffic amount and train operation thereof.

Consequently, in order to solve the problems, a shearing force reinforcement method of a culvert described in Japanese Patent Laid-Open Publication No. 2003-3556 forms slits at a predetermined interval from an inside of an outside wall of the culvert in a vertical direction, inserts a predetermined steel plate in the slits, thereafter filling a grout material inside the slit, and integrates the steel plate and the outside wall.

However, in the reinforcement method, because the predetermined steel plate is merely inserted in the slits, a new problem that a sufficient rigidity (a magnitude of a pulling-out resistance against a pulling-out force, hereinafter referred to as "pulling-out rigidity") cannot be obtained results in occurring when the pulling-out force is generated in the steel plate.

DISCLOSURE OF THE INVENTION

Consequently, the inventor has made a progress of a research and development to cope with the conventional technical problems, and attained to originate the invention. In other words, one aspect of the invention is to provide a shearing force reinforced structure of an existing RC structure body (hereinafter simply referred to as "shearing force reinforced structure") and a shearing force reinforced member that make it possible to simply and surely ensure a predetermined pulling-out rigidity.

To be more precise, a shearing force reinforced structure as one aspect of the invention is the shearing force reinforced structure comprising: an existing reinforced concrete structure object; a shearing force reinforced member where a wire rod arranged inside a reinforced member insertion hole formed at the reinforced concrete structure object is made main; and a filler filled in the hole comprising: a general part having an inner diameter larger than a diameter of the rod; and a base end width broadening part formed at a base end of the hole and having an inner diameter larger than the general part.

In addition, in the shearing force reinforced structure, at a top end of the reinforced member insertion hole is formed a top end width broadening part having an inner diameter larger than the general part.

In addition, in the shearing force reinforced structure the shearing force reinforced member comprises a shearing force reinforcing bar of the wire rod; and a base end fixation member that is formed at a base end of the reinforcing bar and of which a section shape is larger than a reinforcing bar diameter of the reinforcing bar.

In addition, at a top end of the shearing force reinforcing bar in the shearing force reinforced structure is formed a top end fixation member of which a section shape is larger than a reinforcing bar diameter of the reinforcing bar.

Here, an objective member of a reinforcement by the present invention is a member, where a shearing force reinforcement is requested; is applicable to any one of a face material (such as a wall) and existing slab material (such as a bottom slab, an intermediate slab, and a roof slab) (hereinafter referred to as "RC structure face/slab material") of existing various reinforced concrete structure objects; and with respect to an execution objective, does not request a kind such as a cast-in-place and a pre-cast concrete product.

In addition, the shearing force reinforced member ensures a predetermined cover concrete thickness from an inner end face and an outer end face in a thickness direction of an RC structure face/slab material of an existing reinforced concrete structure object, and is requested to be arranged so as to avoid a major reinforcing bar and a minor reinforcing bar that are arranged in advance.

Furthermore, a filler is filled in order to integrate a shearing force reinforced member and an RC structure face/slab material firmly, and any one of such an epoxy resin, cement milk, and cement mortar can be used as the filler.

As a blending of the cement milk and the cement mortar, because after the materials of a filler are hardened, a minute gap occurs between a reinforced member insertion hole and the filler materials due to a desiccation shrinkage and a self shrinkage, and a shearing force reinforced member is thought not to be integrated with an RC structure body, it is preferable to mix an expansion agent in the filler materials, and to integrate the RC structure body and the shearing force reinforced member as a non shrinkage material even after the hardening of the filler materials. In addition, it is also preferable to use a material having a plasticity as a filler so that the filler being filled does not flow out according to a direction of a reinforced member insertion hole.

In accordance with the present invention, because concretes of a shearing force reinforced member and an RC structure object are integrated through a filler, the member and the body result in integrally resisting against an oblique tensile stress occurring when an out-of-plane shearing force acts on the body. Accordingly, it is enabled to improve shear force capacity of an existing RC structure object and to change a failure mode due to such an earthquake from a fragile failure to tough one.

In addition, in accordance with the present invention, because an increase of shear force capacity and a toughness performance can be efficiently realized by directly embedding a shearing force reinforced member inside a structure body without increasing a concrete thickness of an RC structure object, it is enabled to prevent an inconveniency that an inner space section of a skeleton results in decreasing after a reinforcement. In addition, because a major reinforcing bar is not increased, it is enabled to improve an out-of-plane shear force capacity without increasing a bending moment capacity. Therefore, in an earthquake of a level 2, it is enabled to change an RC structure object having a possibility of a shearing preceding failure to bending preceding failure.

In addition, in a shearing force reinforced member, if fixation members (a base end fixation member and a top end fixation member) of which section shapes are larger than a shearing force reinforcing bar of a wire rod are provided at a base end or base end and top end of the shearing force reinforced reinforcing bar, it is enabled to enhance a fixation effect of the shearing force reinforced member, and to more effectively improve shear force capacity and a toughness performance by a tensile resistance of the shearing force reinforcing bar and a compression stress occurring inside concretes of the fixation members. Here, a wire rod is not limited to a reinforcing bar, and all wire rods such a carbon rod, a steel bar, and a PC (Prestressed Concrete) tendon are applicable. In addition, in the description a "width size" of a fixation member is assumed to be unified into a diagonal length if a shape of the fixation member is a rectangle or a polygon; a diameter if it is a circle; and a long axis length if it is an ellipse. In addition, in an explanation below, when "base end fixation member" and a "top end fixation member" are not distinguished, they are simply called a "fixation member" in some case.

In addition, the shearing force reinforced structure is characterized in that an adhesion strength of the filler is not less than 60 N/mm$^2$ if the wire rod is a deformed reinforcing bar.

In other words, if a material of which an adhesion strength to a wire rod (for example, a deformed reinforcing bar) is not less than 60 N/mm$^2$ as a filler, it is enabled to improve an out-of-plane shear force capacity even if a shearing force reinforced member consists of the wire rod. Meanwhile, if the shearing force reinforced member consists of the wire rod, a drilled hole diameter of a reinforce member insertion hole can be preferably made smaller, and a trouble of processing the shearing force reinforced member can be preferably omitted.

In addition, the shearing force reinforced structure is characterized in that the filler is a fiber reinforced cementitious composite material where a fiber is mixed in a cementitious matrix.

In addition, the fiber reinforced cementitious composite material in the shearing force reinforced structure is characterized by being formed by: blending a fiber, of which a diameter is 0.05 to 0.3 mm and a length is 8 to 16 mm, with a cementitious matrix by around 1 to 4% for a volume of the cement mixture body, which the cementitious matrix is obtained by mixing cement, an aggregate of which a maximum particle diameter is not more than 2.5 mm; a pozzolan reaction particle of which a diameter is 0.01 to 15 μm; and at least one kind of super plasticizer; and water.

In other words, using a fiber reinforced cementitious composite material formed by: blending a fiber, of which a diameter is 0.05 to 0.3 mm and a length is 8 to 16 mm, with a cementitious matrix by around 1 to 4% for a volume of the matrix, which is obtained by mixing cement, an aggregate of which a maximum particle diameter is not more than 2.5 mm, preferably not more than 2 mm; a high activity pozzolan reaction particle of which a diameter is 0.01 to 15 μm, preferably 0.1 to 5 μm; a low activity pozzolan reaction particle of which a diameter is 0.1 to 15 μm; and at least one kind of super plasticizer; and water, a compression strength becomes 20 N/mm$^2$, a bending tensile strength becomes 40 N/mm$^2$, an adhesion strength for a deformed reinforcing bar becomes 60 to 80 N/mm$^2$, and thereby a high rigidity fixation effect is realized.

In addition, the shearing force reinforced structure is characterized in that: a fiber sheet is adhered to a surface of the reinforced concrete structure object; and the fiber sheet and the shearing force reinforced member are integrated.

In addition, the shearing force reinforced structure is characterized in that: a fiber sheet may also be adhered to a surface of the reinforced concrete structure object and that of the base end fixation member; and the fiber sheet and the shearing force reinforced member are integrated.

In other words, if a shearing force reinforced member or a base end fixation member, and an RC structure object are integrally adhered by a fiber sheet, it is enabled to more effectively improving a toughness performance because a peel-off of a concrete is prevented.

In addition, a shearing force reinforced structure as one aspect of the present invention is the structure comprising: an existing reinforced concrete structure object; a first shearing force reinforced member arranged inside a first reinforced member insertion hole and a second shearing force reinforced member arranged inside a second reinforced member insertion hole formed in the reinforced concrete structure object; and a filler filled in the first reinforced member insertion hole and the second reinforced member insertion hole, wherein the first shearing force reinforced member comprises a first wire rod, and a first base end fixation member formed at a base end of the first wire rod and having a width larger than a diameter of the first wire rod.

In addition, in the shearing force reinforced structure the first reinforced member insertion hole comprises a first general part having an inner diameter larger than a diameter of the first wire rod, and a first base end width broadening part formed at a base end of the first reinforced member insertion hole and having an inner diameter larger than the general part.

In addition, at a top end of the first reinforced member insertion hole of the shearing force reinforced structure is formed a first top end width broadening part having an inner diameter larger than the first general part.

In addition, in the shearing force reinforced structure the second shearing force reinforced member comprises a second wire rod, a second base end fixation member formed at a base end of the second wire rod and having a width larger than a diameter of the second wire rod, and the first base end fixation member has a width larger than that of the second base end fixation member.

In addition, at a top end of the first reinforced member insertion hole of the shearing force reinforced structure is formed a first top end fixation member having a width larger than a diameter of the first wire rod.

In addition, at top ends of the first shearing force reinforced member and the second shearing force reinforced member of the shearing force reinforced structure may also be respectively formed a first top end fixation member having a width larger than a diameter of the first wire rod and a second top end fixation member having a width larger than a diameter of the second wire rod.

In addition, in the shearing force reinforced structure the reinforced concrete structure object is configured with a rahmen structure, and the first reinforced member insertion hole is formed at a corner of the reinforced concrete structure object.

In addition, the first base end fixation member of the shearing force reinforced structure is characterized in that a plate member configured with a width not less than five folds and not more than 20 folds, preferably not less than ten folds and not more than 15 folds of a diameter of the first wire rod is fixed at a base end of the first wire rod.

In addition, to an inner face of the reinforced concrete structure object of the shearing force reinforced structure is adhered a fiber sheet, and the fiber sheet is integrated with the first wire rod.

In addition, in the shearing force reinforced structure to an inner face of the reinforced concrete structure object may be adhered a fiber sheet, and the fiber sheet may be adhered to a surface of the reinforced concrete structure object and that of the first base end fixation member of the first wire rod and be integrated.

Accordingly, if a first base end fixation member of a first shearing force reinforced member that is a shearing force reinforced member in a vicinity where a plastic hinge occurs (hereinafter referred to as "first area" in some case) is formed of a plate form member having a width of around ten to 15 folds of the shearing force reinforcing bar (first wire rod), it is preferably enabled to constrain an outer face concrete rather than the first base end fixation member and to more effectively improve a toughness performance. Furthermore, if a fiber sheet is integrally adhered to surfaces of a plate form first base end fixation member and an RC structure object, it is enabled to more effectively improve a toughness performance because a peel-off of a concrete is prevented. Here, a wire rod is not limited to a deformed reinforcing bar and a round steel reinforcing bar, and all wire rods such a carbon rod, a steel bar, and a PC tendon are applicable.

In addition, a shearing force reinforced structure of the present invention uses two kinds of different shearing force reinforced members, and if properly arranging the two kinds of the different shearing force reinforced members, it is preferably enabled to more effectively reinforcing shear force capacity and to improve a toughness performance. In addition, in each area (for example, an area where a plastic hinge is thought to occur, and other areas) where a different stress acts, if forming a shape of an arranged shearing force reinforced member according to a stress thereof, it is preferably enabled to suppress material cost at minimum inside being requested.

In other words, in accordance with the shearing force reinforced structure of the present invention, when an RC structure object receives a horizontal force due to such a great earthquake, it is enabled to make damage small due to a deformation amount of ground by enlarging a deformation capacity of a plastic hinge occurring near a corner. Therefore, a put-on load cannot be supported at the same time of a shearing failure, and a whole of an RC structure object can be prevented from being failed.

A shearing force reinforced member as one aspect of the present invention is the member arranged inside a reinforced member insertion hole formed in an existing reinforced concrete structure object, and comprises: a wire rod shorter than a total length of the insertion hole; and a base end fixation member and a top end fixation member respectively having width sizes larger than a diameter of the wire rod and respectively fixed at a base end and top end of the wire rod.

In addition, in the shearing force reinforced member the top end fixation member is characterized in that a width size is formed to be 120% to 250% of a diameter of the wire rod.

In addition, in the wire rod of the shearing force reinforced member, at a top end of the wire rod is integrally formed a male thread member; the top end fixation member is configured with a steel plate of which a shape is a circle or a polygon, a thickness size is 80% to 120% of a diameter of the wire rod, and a width size is 200% to 300% of the diameter of the wire rod; a female thread is formed in the steel plate; and by screwing the male thread member of the wire rod into the female thread, the top end fixation member is fixed at the top end of the wire rod.

In addition, in the wire rod of the shearing force reinforced member, at a top end of the wire rod is processed a male thread; the top end fixation member is configured with a steel plate of which a shape is a circle or a polygon, a thickness size is 80% to 120% of a diameter of the wire rod, and a width size is 200% to 300% of the diameter of the wire rod; a female thread is formed in the steel plate; and by screwing the male thread of the wire rod into the female thread, the top end fixation member is fixed at the top end of the wire rod.

In addition, the wire rod in the shearing force reinforced member is configured with a thread reinforcing bar; the top end fixation member is configured with a steel plate of which a shape is a circle or a polygon, a thickness size is 80% to 120% of a diameter of the wire rod, and a width size is 200% to 300% of the diameter of the wire rod; a female thread is formed in the steel plate; and by screwing the wire rod into the female thread, the top end fixation member is fixed at a top end of the wire rod.

In addition, in the base end fixation member of the shearing force reinforced member, at a base end of the wire rod is fixed a steel plate of which a shape is a circle or a polygon, a thickness size is 30% to 120% of a diameter of the wire rod, and a width size is 130% to 300% of the diameter of the wire rod.

Various aspects and effects of the present invention thus described and other effects and additional features thereof will be further clarified by detailed explanations of exemplifying and non limiting embodiments described later, referring to appended drawings.

BRIEF DESCRIPTION OF DRAWINGS

FIG. 2A is a front section view; and FIG. 2B is a side section view.

FIG. 9A is a side section view; and FIG. 9B is a front section view.

FIGS. 10 A to 10D are front section views showing each process of a shearing force reinforcement method related to the third embodiment.

FIGS. 14 A to 14D are front section views showing each process of the shearing force reinforcement method related to the fourth embodiment.

FIGS. 15 A to 15D are front section views showing each process of a shearing force reinforcement method related to a fifth embodiment.

FIG. 22A is a section view showing a placement state thereof; and FIG. 22B is a perspective view showing a whole thereof.

FIG. 23A is a section view showing a placement state thereof; and FIG. 23B is a perspective view showing a whole thereof.

FIG. 24A shows a normal state; FIG. 24B shows a state in earthquake; and FIG. 24C shows a bending moment drawing in earthquake.

BEST MODE(S) FOR CARRYING OUT THE INVENTION

Here will be described preferred embodiments of a reinforcement method of the present invention in detail, referring to drawings. Meanwhile, below will be described a case of reinforcing a side wall or intermediate wall of an existing reinforced concrete structure object embedded in ground G inside the earth. Meanwhile, in an explanation below a same symbol will be used for a same element, and a duplicated explanation will be omitted. Here, in the description an "outer face" means a face of a side fronting the earth of a face material or slab material of an RC structure body; an "inner face" means a face of a side opposing the face material or slab material of the RC structure body and not fronting the earth.

First Embodiment

Figure 1:
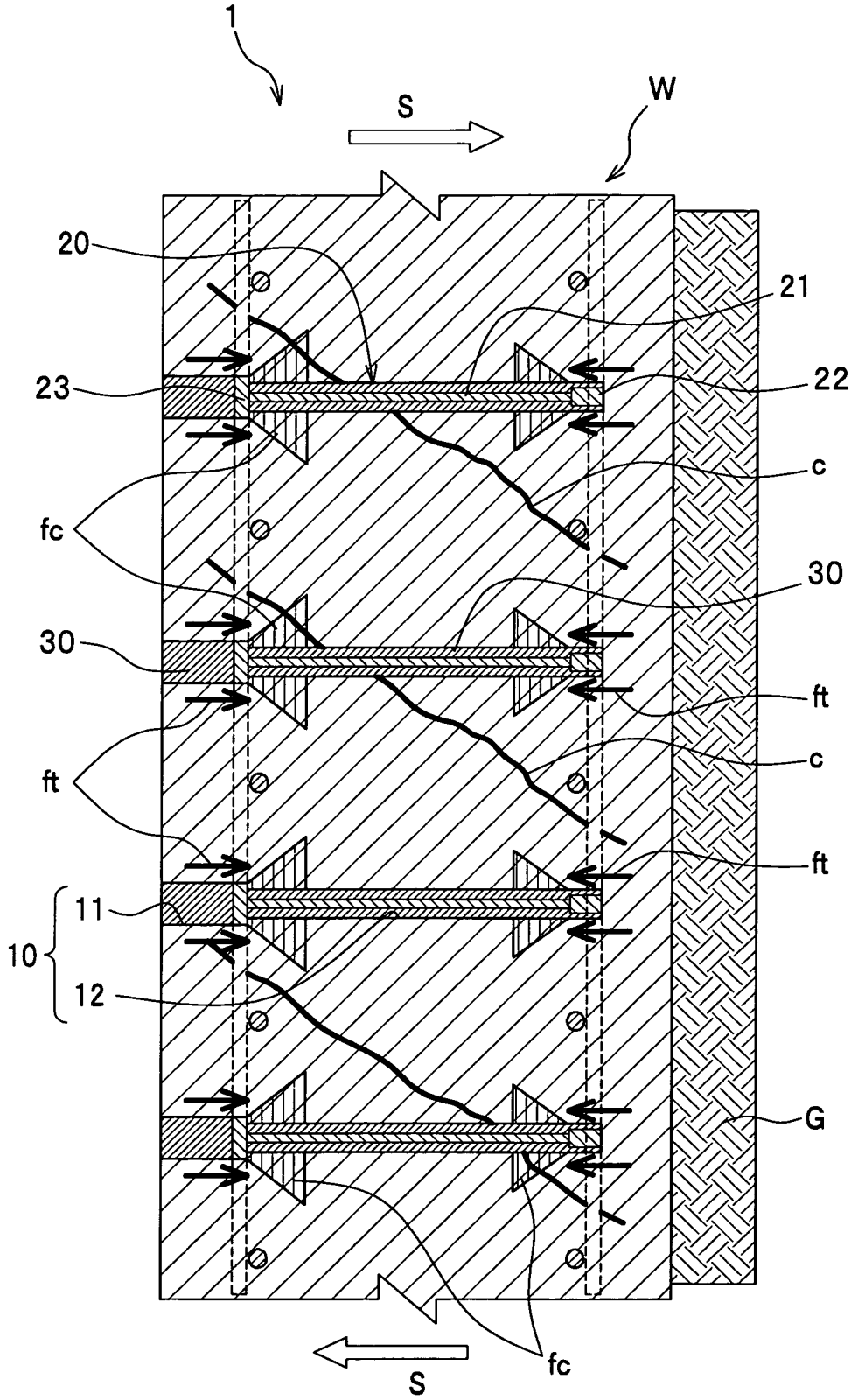
FIG. 1 is a section view showing a shearing force reinforced structure related to a first embodiment of the predetermined.

A shearing force reinforced structure 1 related to a first embodiment of the present invention comprises, as shown in FIG. 1, a side wall W of an existing reinforced concrete structure, shearing force reinforced members 20 respectively arranged inside reinforced member insertion holes 10 with bottoms formed in a direction intersecting a major reinforcing bar from an inner face side of the side wall W; and fillers 30 respectively filled in the holes 10.

Figure 3:
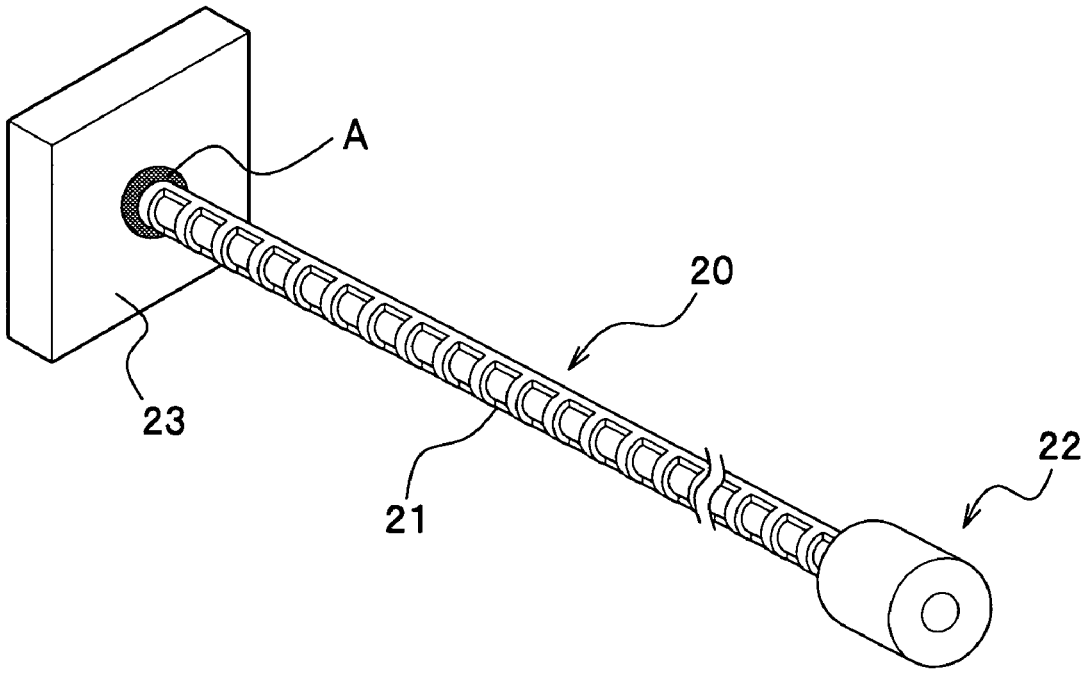
FIG. 3 is a general perspective view of a shearing force reinforced member related to the first embodiment.

Here, each of the shearing force reinforced members 20 comprises a shearing force reinforcing bar 21 of a wire rod, a ring head (top end fixation member) 22 fixed at a top end of the reinforcing bar 21, and a plate head (base end fixation member) 23 fixed at a base end of the reinforcing bar 21 (see FIG. 3).

In addition, each of the reinforced member insertion holes 10 comprises a general part 12 having an inner diameter larger than a reinforcing bar diameter of the shearing force reinforcing bar 21 and an outer diameter of the ring head 22, and smaller than a width of the plate head 23; and a base end width broadening part 11 formed at a base end of the hole 10 and having an inner diameter larger than the width of the plate head 23. Here, in the description a "width" of a fixation member is assumed to be unified as: a diagonal length if a shape of the fixation member is a rectangle or a polygon; a diameter if the shape is a circle; and a long axis length if the shape is an ellipse.

Then a space of an inner face more inside than the plate head 23 of the base end width broadening 11 is filled with the filler 30.

Here will be described a detail of the shearing force reinforced structure 1 related to the first embodiment.

Figure 2B:
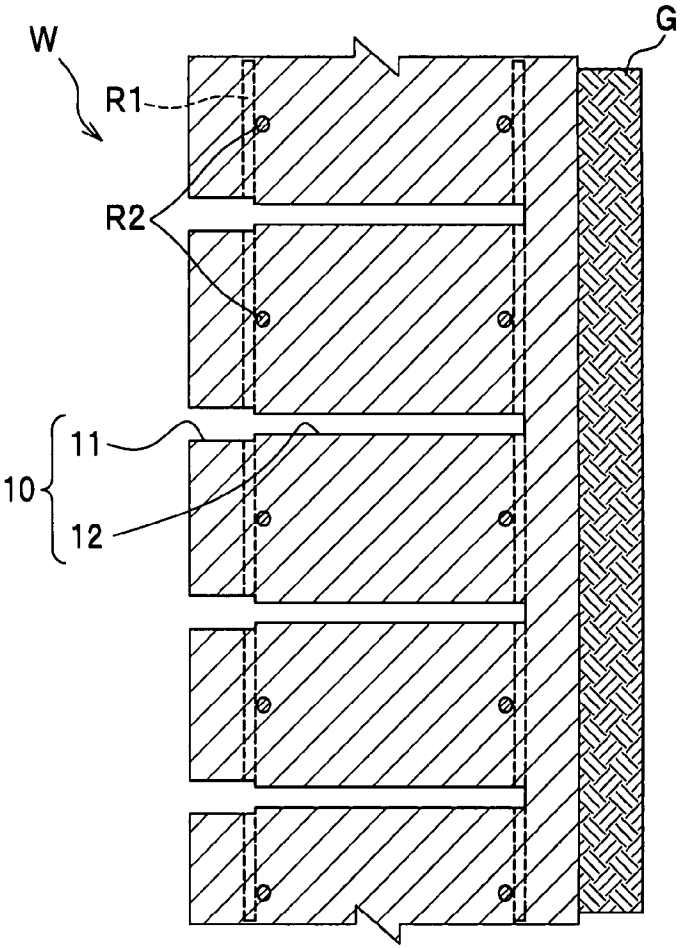
FIGS. 2A and 2B are drawings showing reinforced member insertion holes related to the first embodiment and a second embodiment.
Figure 2A:
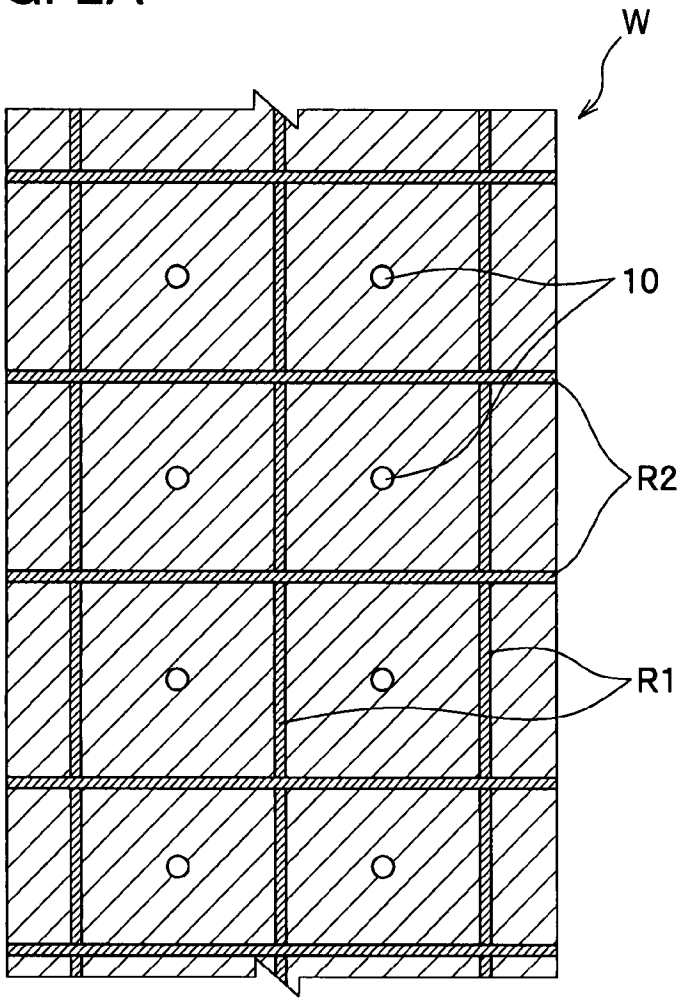

Each of the reinforced member insertion holes 10 is drilled from an inner face side to outer face side of the side wall W in order to place the shearing force reinforced member 20, and as shown in FIGS. 2A and 2B, is arranged at center of both major reinforcing bars R1 and minor reinforcing bars R2 at a same interval laterally as in the reinforcements R1 and longitudinally as in the reinforcing bars R2 not to damage them in drilling, based on information of a bar arrangement drawing and a nondestructive test in execution of an existing RC structure body. As shown in FIG. 2B, the drilling of the reinforced member insertion hole 10 is performed till a depth of a position of the major reinforcing bar R1 at the outer face side in a direction from the inner face side (one face side) to outer face side (the other face side) of the side wall W, which the outer face side contacts the ground G, and in a direction approximately perpendicular to a face of the side wall W, using a drilling means such as an impact drill, a rotary hammer drill, and a core drill. In addition, the reinforced member insertion hole 10 is drilled, having a slightly downward slant, and is provided in a length size where a cover concrete thickness of a predetermined size is subtracted at the other face side; and a hole diameter thereof is formed into a value where a slight margin is anticipated in a diameter of the ring head 22 attached at the top end of the shearing force reinforced member 20 shown in FIG. 3.

Meanwhile, a reason why the reinforced member insertion hole 10 is formed, having a slight downward slant, is to easily discharge inner air in filling the filler 30 when inserting the shearing force reinforced member 20, and thus it is enabled to more completely fill the filler 30.

In addition, at the base end of the reinforced member insertion hole 10 is formed the base end width broadening part 11 by broadening a drilled hole diameter so that a peripheral edge of the plate head 23 attached to the base end (distal end) of the shearing force reinforced member 20 is hooked, using the drilling means. Meanwhile, a drilled depth of the base end width broadening part 11 is designed to be a value where a cover concrete thickness is added to a thickness of the plate head 23, and is drilled till a position of the major reinforcing bar R1 of the inner face side in the first embodiment.

The shearing force reinforced member 20 comprises, as shown in FIG. 3, the shearing force reinforcing bar 21 of a deformed reinforcing bar; and the ring head 22 and the plate head 23 that are provided at the top end and base end of the reinforcing bar 21 and of which section shapes are larger than the reinforcing bar 21. Then, as shown in FIG. 1, in a state of being inserted in the reinforced member insertion hole 10, the shearing force reinforced member 20 has a length where the peripheral edge of the plate head 23 is hooked at the base end width broadening part 11, and the top end of the ring head 22 abuts with a bottom of the top end of the reinforced member insertion hole 10. Here, although it is assumed to use a deformed reinforcing bar as the shearing force reinforcing bar (wire rod) 21, it is not limited thereto; anything bringing out a function of a linear reinforced material, for example, such as a thread reinforcing bar, a steel bar, a PC tendon, and a carbon rod may also be used.

Figure 4A:
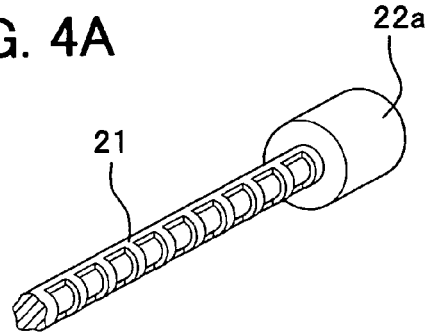
FIG. 4A is a perspective view showing a ring head of the shearing force reinforced member related to the first embodiment.

In making the ring head 22, as shown in FIG. 3 or FIG. 4A, using a metallic material such as mild steel and an aluminum alloy comparatively easy to be processed, is prepared a cylindrical body having a shape of which a thickness is 15% to 40% of a reinforcing bar diameter of the shearing force reinforcing bar 21; and a length, 100% to 250% thereof. By covering this on the top end of the shearing force reinforcing bar 21, and squashing a periphery thereof from around with using a gripper where two half circular rings are combined; or by squeezing such a cylindrical body used in a squeeze joint of a reinforcing bar, plastically deforming the cylindrical body, and integrating it with the shearing force reinforcing bar 21, the ring head 22 is manufactured.

Figure 4B:
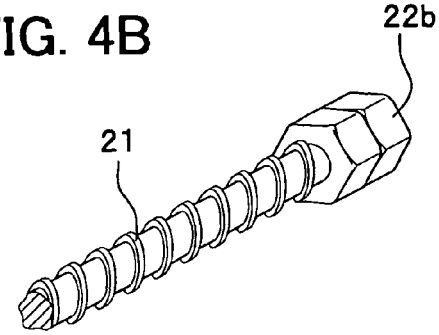
FIGS. 4B to 4G are perspective views showing variation examples of the ring head.

Meanwhile, the ring head 22 is not limited to the above, and a width size thereof may be formed into 120% to 250% of the shearing force reinforcing bar 21 by a proper method as needed. For example, as a ring head 22*b* shown in FIG. 4B, according to either method of using a thread reinforcing bar as the shearing force reinforcing bar 21, screwing a locknut at the top end, and making a double nut in order to remove a jounce between the reinforcing bar 21 and the locknut, or injecting a filler such as an epoxy resin in a gap inside a nut, it is also enabled to manufacture a head 22*b* so that its thickness becomes 150% to 250% of the diameter of the shearing force reinforcing bar 21; and its length, 100% to 250% of the reinforcing bar 21.

Figure 4C:
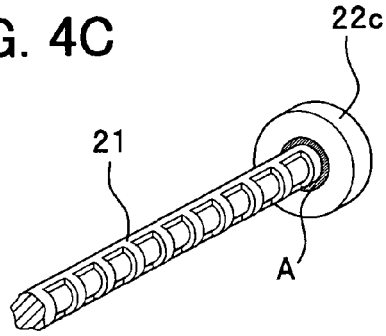
Figure 4D:
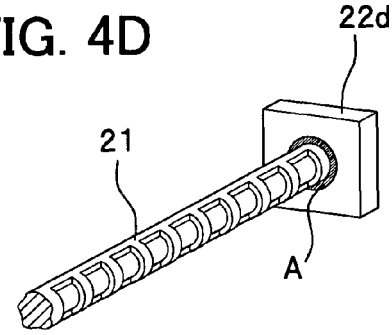
Figure 4E:
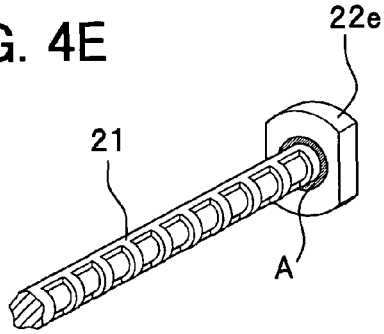

In addition, as a ring head 22*c* shown in FIG. 4C, performing at the top end the shearing force reinforcing bar 21 a friction-pressure joining A of a circular steel plate of which a thickness is 30% to 80% of the diameter of the reinforcing bar 21, and a width is 140% to 200% of the diameter of the reinforcing bar 21, the head 22*c* may also be manufactured. In addition, as ring heads 22*d* and 22*e* shown in FIGS. 4D and 4E, they may also be respectively manufactured from a polygonal steel plate of which a thickness is 30% to 80% of the diameter of the shearing force reinforcing bar 21, and a width is 140% to 200% of the diameter of the reinforcing bar 21, and an elliptical steel plate (including an oval shape and such a shape where side parts of a circle is cut off) of which a thickness is 30% to 80% of the diameter of the reinforcing bar 21, and a long axis is 140% to 200% of the diameter of the reinforcing bar 21. Thus because a gap is formed between the reinforced member insertion hole 10 and the ring heads 22*d* and 22*e*, it is enabled to reduce an insertion resistance due to the filler 30 filled in the hole 10, and to insert the shearing force reinforced member 20 without air remaining in rearward of the ring heads 22*d* and 22*e*.

Figure 4F:
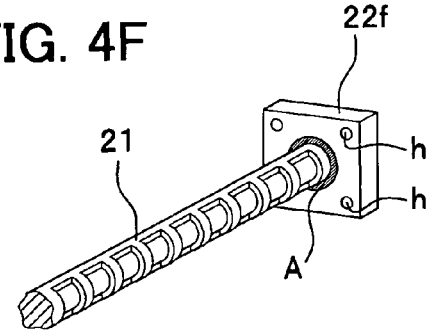
Figure 4G:
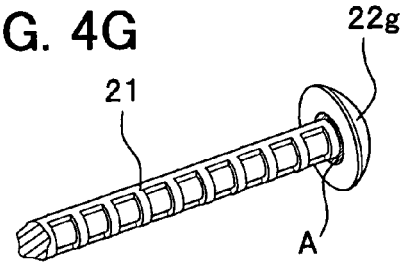

In addition, providing any one of the circular steel plate, the polygonal steel plate, and the elliptical steel plate with holes h, a ring head 22*f* may also be configured to reduce an insertion resistance due to the filler 30 and to insert the shearing force reinforced member 20 without air remaining in rearward of the ring head 22*f* (see FIG. 4F). Furthermore, as shown in FIG. 4G, a ring head 22*g* may also be configured to reduce an insertion resistance by making a joined face with the shearing force reinforcing bar 21 of the ring head 22*g* and an opposite side face thereof a convex spherical shape.

Here, a joining method between the ring head 22 and the shearing force reinforcing bar 21 is not limited to the above method; a friction pressure joining, a gas pressure joining, an arc welding joining, and the like are available if the head 22 and the reinforcing bar 21 can be integrated.

As shown in FIG. 3, the plate head 23 is configured so that a rectangular steel plate is integrally fixed at the base end of the shearing force reinforcing bar 21, wherein a thickness of the steel plate is 40% to 80% of the diameter of the reinforcing bar 21 and a width of the steel plate is 150% to 300% of the diameter of the reinforcing bar 21. The fixation of the plate head 23 to the shearing force reinforcing bar 21 can be simply performed by using a friction pressure joining machine, pushing the rotated steel plate to the fixed reinforcing bar 21, thereby generating friction heat in the rotating steel plate at a predetermined pressure, and joining the steel plate to the reinforcing bar 21 with a melt-adhesion (friction pressure joining A).

Here, the joining method between the plate head 23 and the shearing force reinforcing bar 21 is not limited to the friction pressure joining A; any methods such as a gas pressure joining and an arc welding joining are available if the head 23 and the reinforcing bar 21 can be integrated. In addition, the shape of the plate head 23 is not limited to a rectangle, and such a circle, an ellipse, and a polygon are also available.

Meanwhile, a combination of the ring head 22 and the plate head 23 can be freely selected, matching factors such as a bar arrangement, concrete intensity, and wall thickness of the side wall W to be reinforced.

As the filler 30 is used a filler composed of a cement mortar having a plasticity, and a property of not flowing down even if it is filled upward. Here, the cement mortar having the plasticity is a material composed of a pozzolan substance such as cement, a silica fume, and a quartz powder; a viscosity increasing material; and water. Meanwhile, such a property of the filler 30 is not limited thereto, and anything is available if it has a similar property.

The shearing force reinforced structure 1 of the present invention directly reinforces with the shearing force reinforced members 20 oblique cracks c occurring when an out-of-plane shearing force S acts as shown in FIG. 1, and improves shear force capacity.

In other words, although if the out-of-plane shearing force S acts on the side wall W, the oblique cracks c attempt to occur, a tensile force acts on each of the shearing force reinforced members 20, and thereby, a pulling-out force ft acts on the ring head 22 and the plate head 23 at respective ends of the member 20. Therefore, a supporting pressure acts on a concrete (hereinafter referred to as "internal concrete") existing inside the ring head 22 and the plate head 23 as a reaction force, and thus a field of compression forces fc is formed in the internal concrete. In other words, the internal concrete receives a lateral constraint and results in increasing a resistance force for an oblique tension. Therefore, an out-of-plane shear force capacity of the side wall W is increased by the shearing force reinforced member 20 having the ring head 22 and the plate head 23 at respective ends of the member 20; and the compression forces fc are generated (the compression stress field is formed) in the internal concrete, and thereby a toughness performance of the side wall W is also increased.

Figure 5:
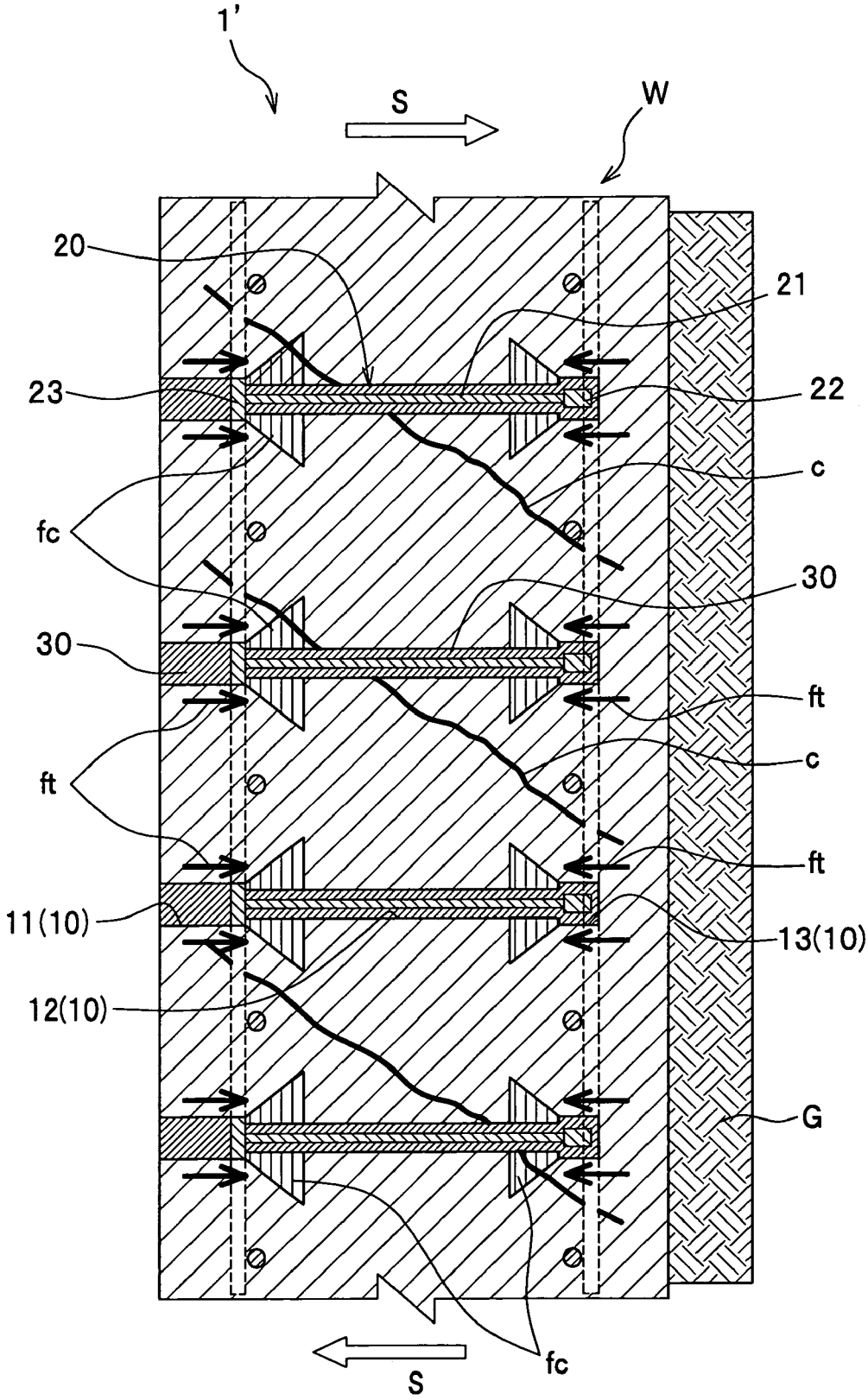
FIG. 5 is a side section view showing a stress state when top end width broadening parts are provided around ring heads.

In addition, in the first embodiment a top end width broadening part 13 around the ring head 22 may also be provided, and in this case, as a shearing force reinforced structure 1' shown in FIG. 5, a fixation effect and toughness performance of the ring head 22 are improved. In other words, when the pulling-out force ft acts on each of the ring heads 22, it is enabled to prevent adhesion slide from occurring between an inside wall of the drilled hole and the filler 30, and to increase a pulling-out rigidity. Furthermore, a supporting reaction force acting on the ring head 22 effectively acts on an internal concrete, and a field of a larger compression stress fc is formed; therefore, a constraint effect of the internal concrete is further enhanced and a toughness performance is increased.

Figure 6A:
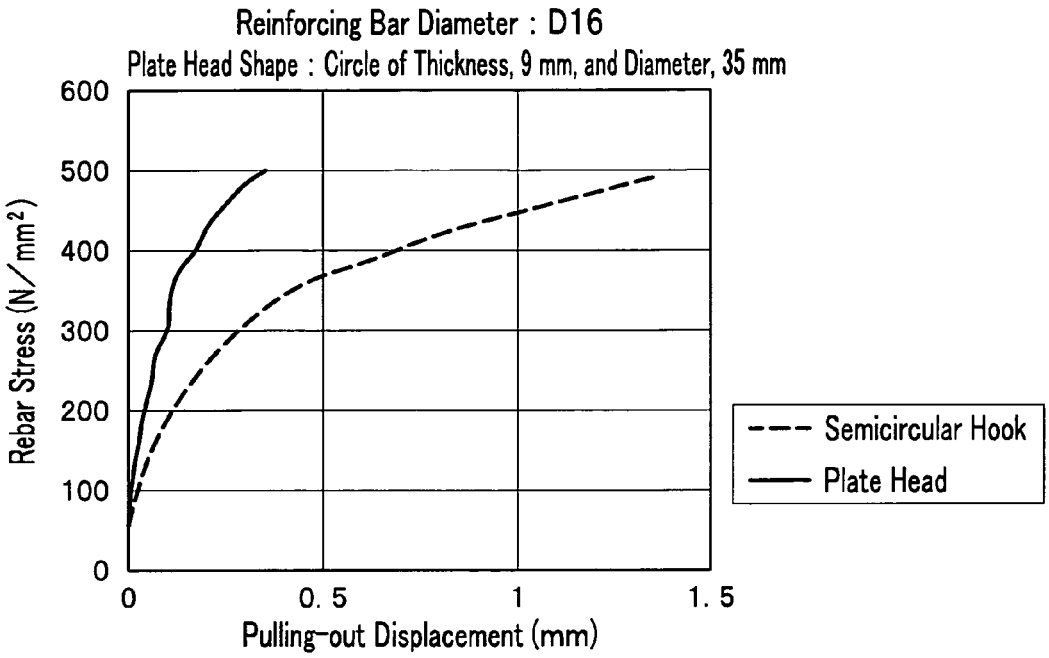
FIGS. 6A and 6B are graphs both showing results of pulling-out tests between a shearing force reinforcing bar having a plate head and a shearing force reinforcing bar where a semicircular hook is formed at an end.
Figure 6B:
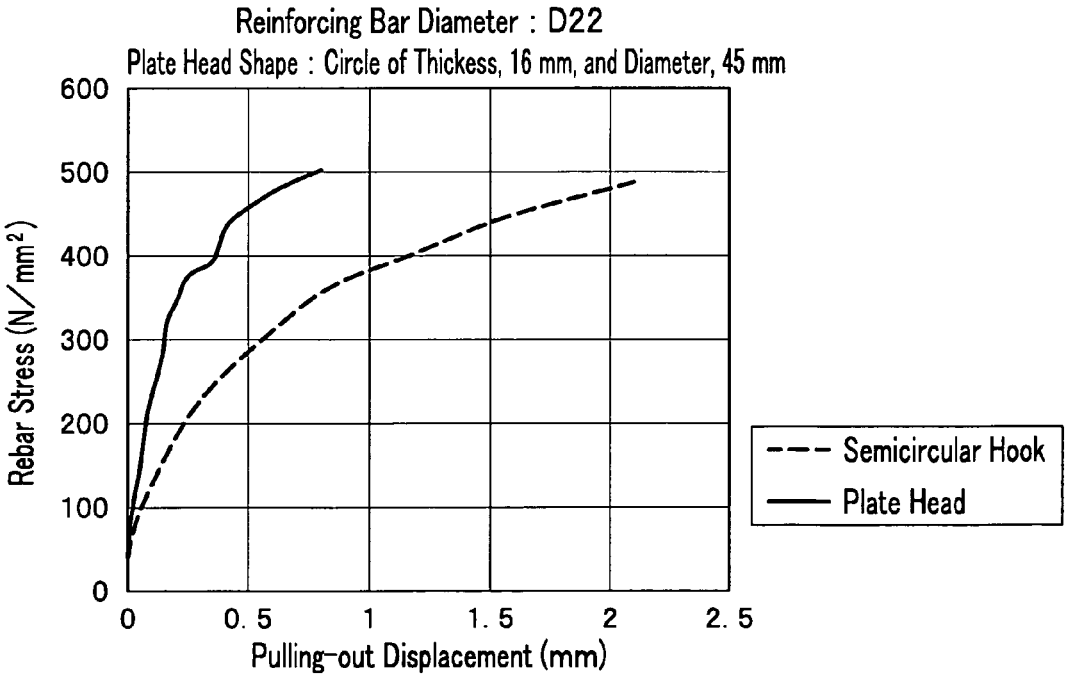

In addition, in a case of performing a reinforcement related to the first embodiment, because the ring head 22 and the plate head 23 exist, a fixation portion increases. One example of results is shown in FIGS. 6A and 6B, wherein pulling-out tests were respectively performed in order to investigate the fixation effect for the shearing force reinforcing bar 21 having the plate head 23 and for a shearing force reinforcing bar (hereinafter referred to as "comparison example") where a semicircular hook was formed at an end. FIG. 6A is a graph of a relationship between a tensile stress and pulling-out displacement, wherein the relationship was derived in a case of: using a deformed reinforcing bar (D16); drilling a reinforced member insertion hole of a diameter of 25 mm in an RC member; inserting the shearing force reinforcing bar 21 having the plate head 23 of a circular shape of which a thickness was 9 mm and a diameter was 35 mm, and the comparison example; and filling and hardening the filler 30.

FIG. 6B is a graph of a relationship between a tensile stress and puling-out displacement, wherein the relationship was derived in a case of: similarly using a deformed reinforcing bar (D 22); drilling a reinforced member insertion hole of a diameter of 32 mm in an RC member; and inserting the shearing force reinforcing bar 21 having the plate head 23 of a circular shape of which a thickness was 16 mm and a diameter was 45 mm, and the comparison example.

In accordance with the result, the shearing force reinforcing bar 21 having the plate head 23 related to the present invention results in being demonstrated that the puling-out displacement is smaller (the pulling-out rigidity is high) and the fixation effect is markedly excellent.

A construction of the shearing force reinforced structure 1 related to the first embodiment is performed by: drilling the reinforced member insertion hole 10 in the side wall W, then filling the filler 30 in the general part 12, inserting the shearing force reinforced member 20 in the hole 10, and filling the filler 30 in the base end width broadening part 11. Here, the order of filling the filler 30 in the general part 12 and inserting the shearing force reinforced member 20 is not limited; the order of filling the filler 30 after inserting the shearing force reinforced member 20 in the reinforced member insertion hole 10 is also available. In this case filling the filler 30 in the general part 12 may be performed by forming a filling hole in the plate head 23 and filling the filler 30 through the hole.

Second Embodiment

Figure 7:
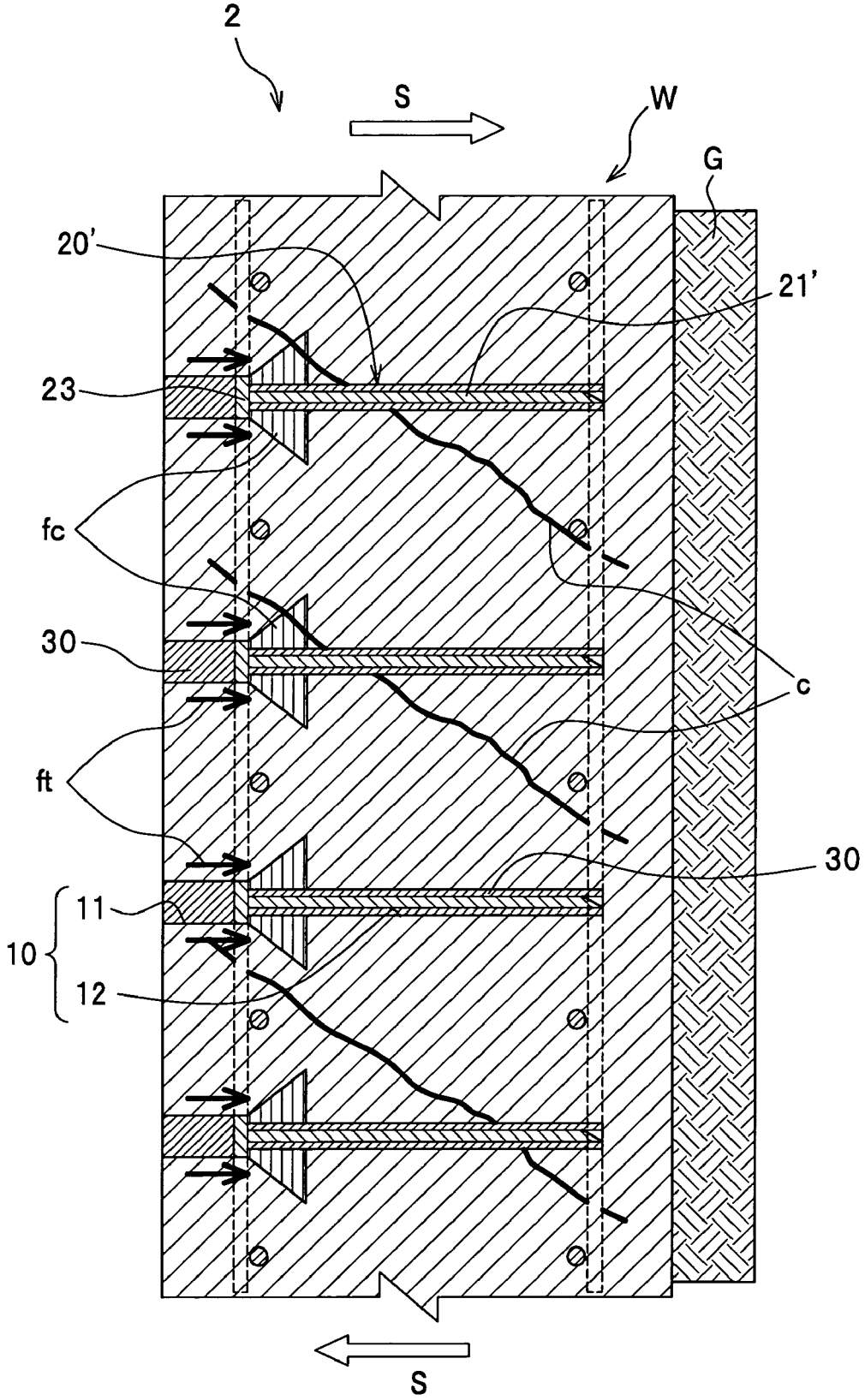
FIG. 7 is a section view showing a shearing force reinforced structure related to the second embodiment of the predetermined.

A shearing force reinforced structure 2 related to a second embodiment of the present invention comprises, as shown in FIG. 7, the side wall W of an existing reinforced concrete structure, the shearing force reinforced members 20' arranged inside the reinforced member insertion holes 10 with bottoms formed in a direction intersecting a major reinforcing bar of the side wall W; and the fillers 30 filled in the holes 10.

Figure 8:
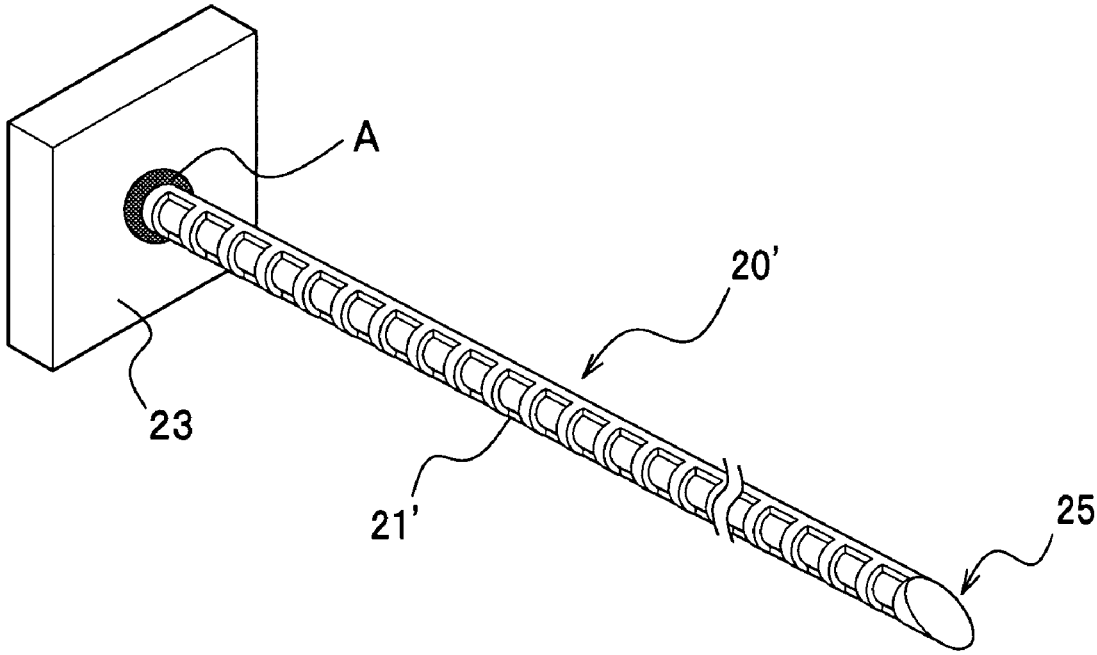
FIG. 8 is a general perspective view of a shearing force reinforced member related to the second embodiment.

Here, each of the shearing force reinforced members 20' comprises, as shown in FIG. 8, a shearing force reinforcing bar 21' of a wire rod, and the plate head (base end fixation member) 23 fixed at the base end of the reinforcing bar 21'.

In addition, each of the reinforced member insertion holes 10 comprises the general part 12 having an inner diameter larger than a reinforcing bar diameter of the shearing force reinforcing bar 21' and smaller than a width of the plate head 23; and the base end width broadening part 11 formed at the base end of the hole 10 and having an inner diameter larger than the width of the plate head 23.

In addition, the filler 30 similar to that used in the first embodiment is used.

Here will be described a detail of the shearing force reinforced structure 2 related to the second embodiment.

The reinforced member insertion hole 10 is drilled from an inner face side to outer face side of the side wall W in order to place the shearing force reinforced member 20, and as shown in FIGS. 2A and 2B, is arranged at center of both major reinforcing bars R1 and minor reinforcing bars R2 at a same interval laterally as in the reinforcements R1 and longitudinally as in the reinforcing bars R2 not to damage them in drilling, based on information of a bar arrangement drawing and a nondestructive test in execution of an existing RC structure body. As shown in FIG. 2B, the drilling of the reinforced member insertion hole 10 is performed till a depth of a position of the major reinforcing bar R1 at the outer face side in a direction from the inner face side (one face side) of the side wall W to the outer face side (the other face side), which the outer face side contacts the ground G, and in a direction approximately perpendicular to the face of the side wall W, using a drilling means such as an impact drill, a rotary hammer drill, and a core drill. In addition, the reinforced member insertion hole 10 is drilled, having a slightly downward slant, and is provided in a length size where a cover concrete thickness of a predetermined size is subtracted at the other face side; and a hole diameter thereof is formed into a value where a slight margin is anticipated in the reinforcing bar diameter of the shearing force reinforcing bar 21' shown in FIG. 8.

In addition, at the base end of the reinforced member insertion hole 10 is formed the base end width broadening part 11 by broadening a drilled hole diameter so that a peripheral edge of the plate head 23 attached to the base end (distal end) of the shearing force reinforced member 20 is hooked, using the drilling means. Meanwhile, a drilled depth of the base end width broadening part 11 is designed to be a value where a cover concrete thickness is added to the thickness of the plate head 23, and is drilled till the position of the major reinforcing bar R1 of the inner face side in the embodiment similarly to the first embodiment.

The shearing force reinforced member 20 comprises, as shown in FIG. 8, the shearing force reinforcing bar 21' having an acute part 25 at its top end; and the plate head 23 that is provided at the base end of the reinforcing bar 21' by the friction pressure joining A and of which the section shape is larger than the reinforcing bar 21'. Meanwhile, because a method of fixing the base end of the reinforcing bar 21' and the plate head 23 by the friction pressure joining A is similar to that described in the first embodiment, a detailed explanation thereof will be omitted. Then, as shown in FIG. 7, in a state of being inserted in the reinforced member insertion hole 10, the shearing force reinforced member 20 has a length where the peripheral edge of the plate head 23 is hooked at the base end width broadening part 11, and the top end of the shearing force reinforcing bar 21' abuts with the bottom of the top end of the reinforced member insertion hole 10.

A method of processing the acute part 25 of the shearing force reinforced member 20' is not limited, such as cutting off the top end of the shearing force reinforcing bar 21' at an acute angle, and heating and deforming the part 25. Providing the acute part 25 at the top end of the shearing force reinforcing bar 21', it is enabled to prevent air from being enwound in inserting the shearing force reinforced member 20' in a case of filling the filler 30 before inserting the member 20'.

Meanwhile, a space made at the base end width broadening part 11 of the inner face side of the plate head 23 is filled by grinding in the filler 30 composed of a cement mortar, using a trowel.

Next will be described a shearing force reinforcement mechanism according to the embodiment, using FIG. 7. Although if the out-of-plane shearing force S acts on the side wall W, oblique cracks c attempt to occur, tensile forces work on each of the shearing force reinforced reinforcing bars 21' because of the existence of the reinforcing bar 21', and the pulling-out forces ft act on the plate head 23 at an end. Therefore, a supporting pressure from the plate head 23 acts on a concrete inside the head 23, and the compression force fc acts on a concrete inside the side wall W. In other words, the concrete inside the plate head 23 receives a lateral constraint and results in increasing a resistance force. Therefore, not only an out-of-plane shear force capacity of the side wall W is increased by the shearing force reinforcing bar 21' with the plate head 23 at the end, but also a toughness rigidity is increased by the compression force fc being formed in the internal concrete.

Meanwhile, also in a case of performing a reinforcement according to the embodiment, performing the pulling-out test in the first embodiment in order to investigate a fixation effect, a result similar to that of FIGS. 6A and 6B was obtained.

A construction of the shearing force reinforced structure 2 related to the second embodiment is performed by: drilling the reinforced member insertion hole 10 in the side wall W, then filling the filler 30 in the general part 12, inserting the shearing force reinforced member 20' in the hole 10, and filling the filler 30 in the base end width broadening part 11.

Figure 10A:
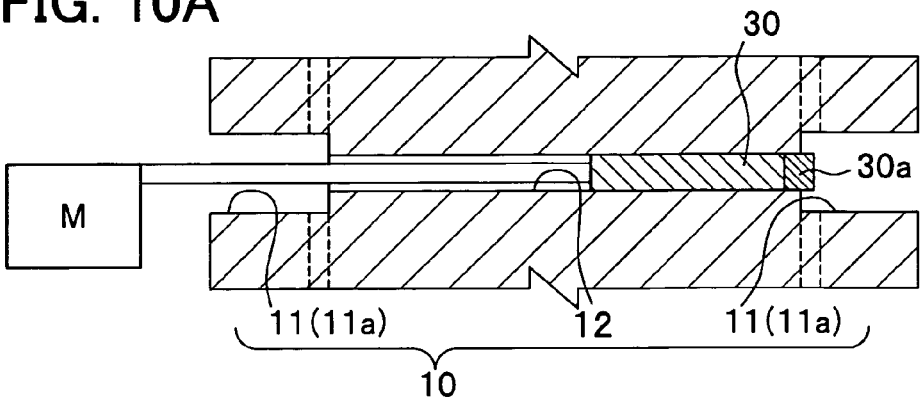
FIG. 10A shows a filler filling process.
Figure 10B:
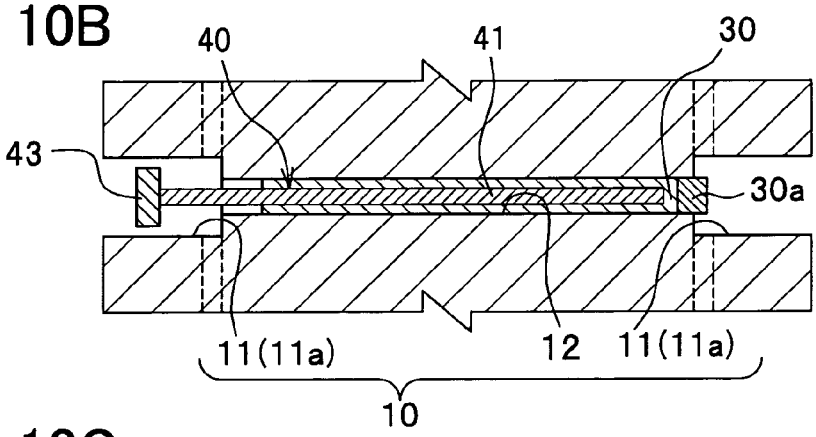
FIG. 10B shows a reinforced structure reinforcing bar insertion process.
Figure 10C:
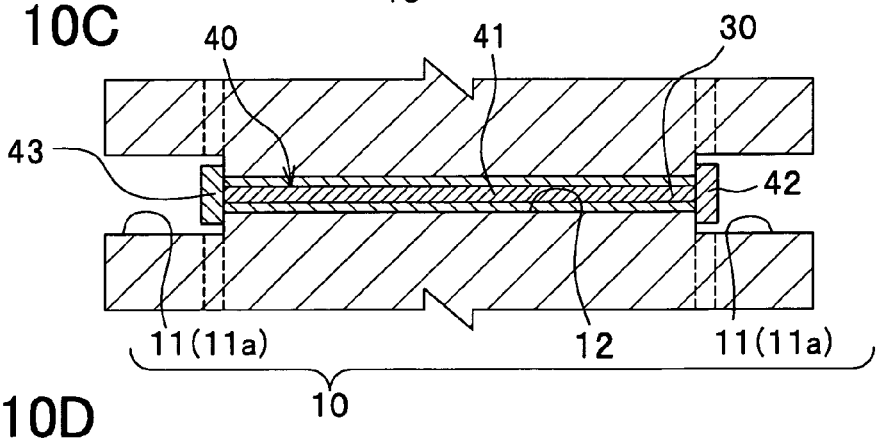
FIGS. 10C and 10D show shearing force reinforced member arrangement processes.
Figure 10D:
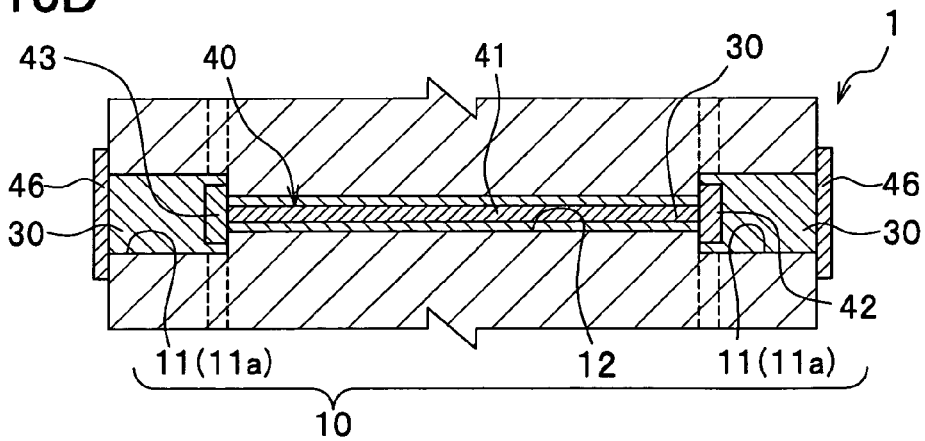
Figure 14A:
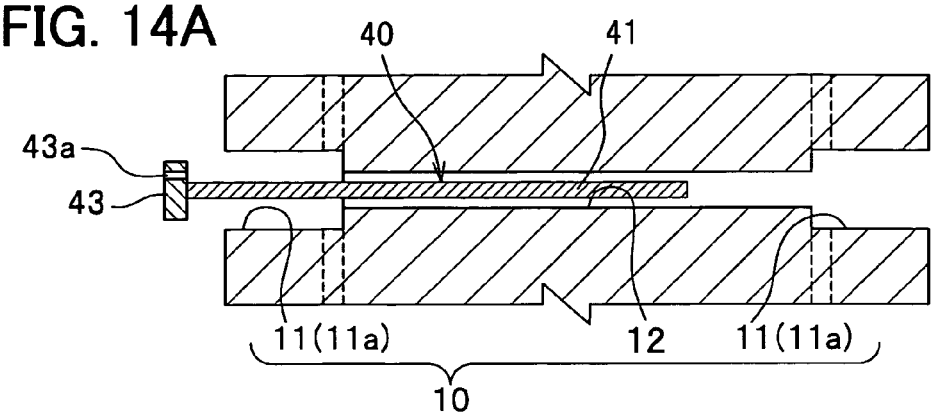
FIG. 14A shows a reinforced structure reinforcing bar insertion process.
Figure 14B:
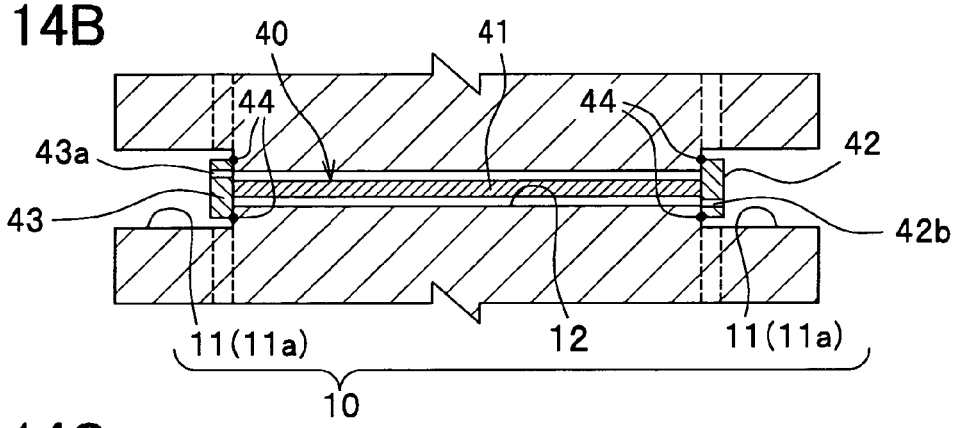
FIG. 14B shows a shearing force reinforced member arrangement process.
Figure 14C:
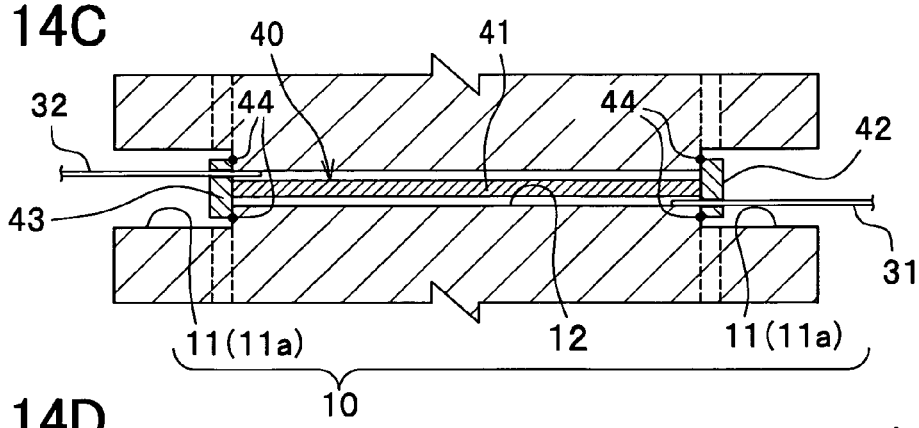
FIGS. 14C and 14D show filler filling processes.
Figure 14D:
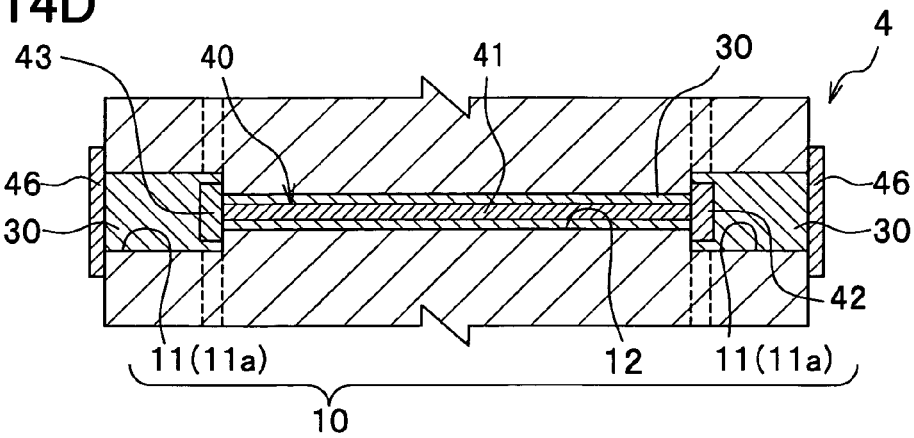
Figure 15A:
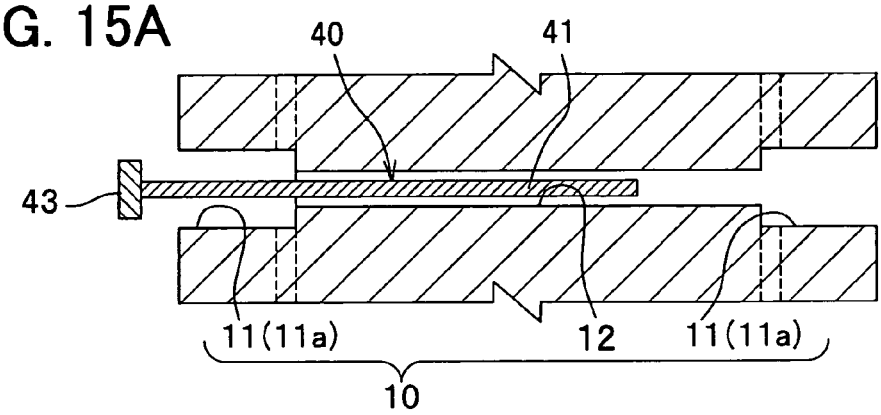
FIG. 15A shows a reinforced structure reinforcing bar insertion process.
Figure 15B:
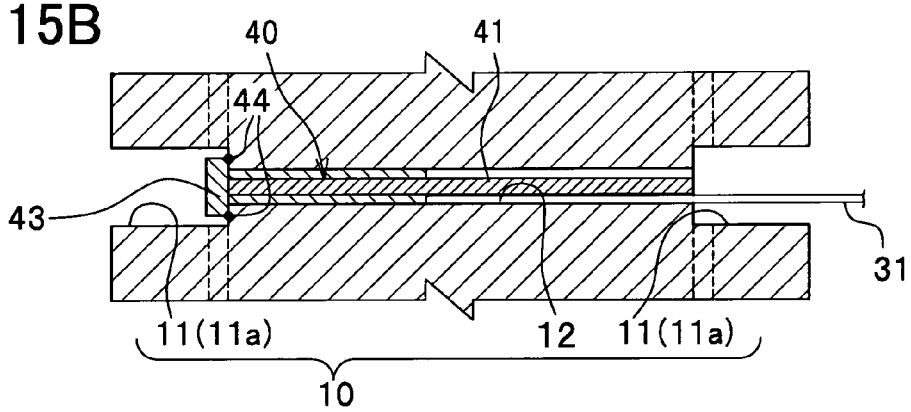
FIG. 15B shows a shearing force reinforced structure reinforcing bar insertion process.
Figure 15C:
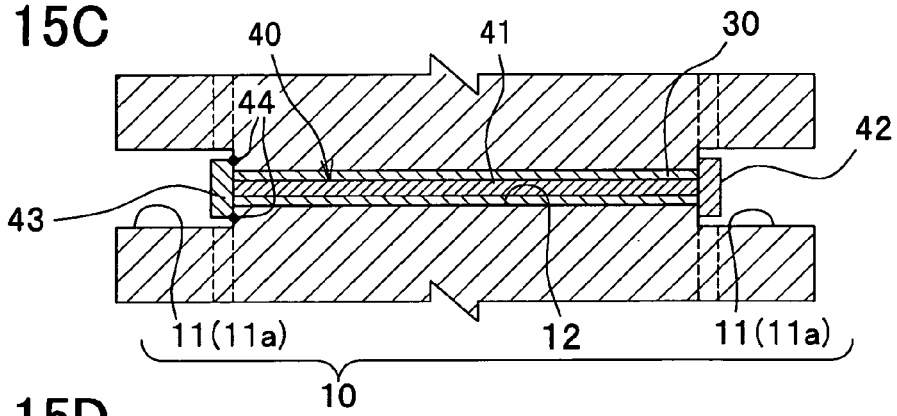
FIG. 15C show a filler filling process.
Figure 15D:
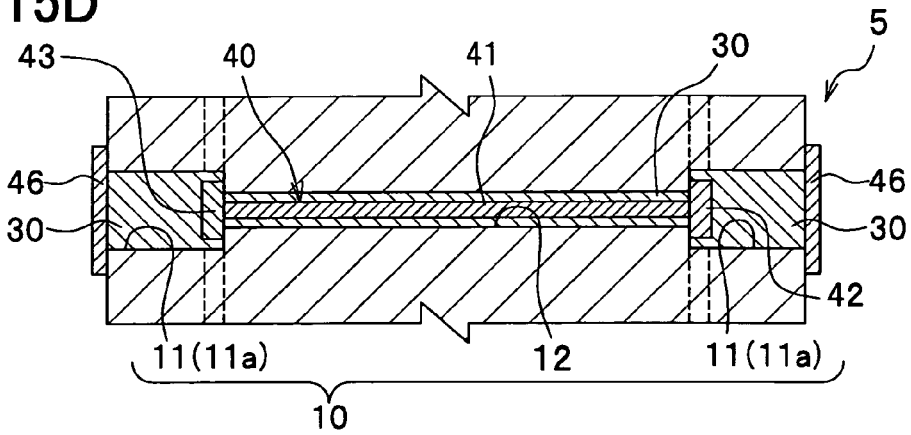
FIG. 15D shows a shearing force reinforced member arrangement process.

Shearing force reinforced structures 3 to 5 related to third to fifth embodiments of the present invention comprise an intermediate wall W' of an existing reinforced concrete structure, shearing force reinforced members 40 arranged inside the reinforced member insertion holes 10 penetrating the wall W' in a direction intersecting a major reinforcing bar; and the fillers 30 filled in the holes 10 (see FIGS. 10D, 14D, and 15D).

Figure 9B:
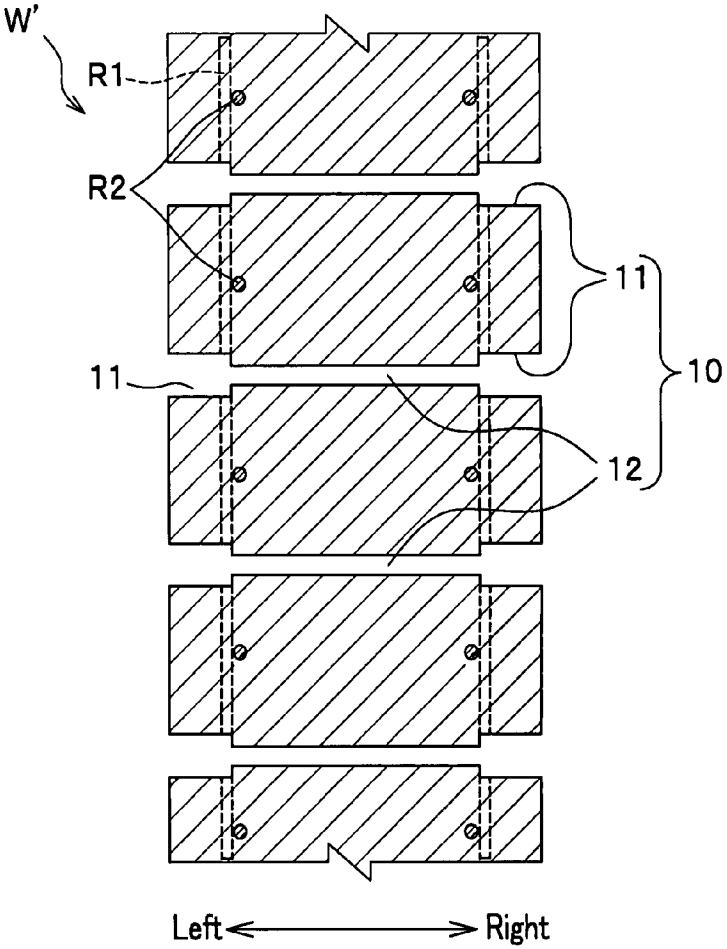
FIGS. 9A and 9B are drawings showing a reinforced member insertion hole drilling process of a reinforcement method related to a third embodiment and a fourth embodiment.

Meanwhile, "left" and "right" in an explanation will be unified in directions shown in FIG. 9B.

Here, each of the shearing force reinforced members 40 comprises a shearing force reinforcing bar 41 of a wire rod, and a base end plate head (base end fixation member) 43 and a top end plate head (top end fixation member) 42 respectively fixed at the base end and top end of the reinforcing bar 41.

In addition, each of the reinforced member insertion holes 10 comprises the general part 12 having an inner diameter larger than a reinforcing bar diameter of the shearing force reinforcing bar 41 and smaller than a width of the base end plate head 43; the width broadening part 11 formed at the base end of the hole 10 and having an inner diameter larger than the width of the head 43; and the width broadening part 11 formed at the top end of the hole 10 and having an inner diameter larger than the width of the top end plate head 42.

Here will be described construction methods and detailed configurations of the shearing force reinforced structures 3 to 5 related to the third to fifth embodiments.

Third Embodiment

A reinforcement method related to the third embodiment mainly comprises (1) a reinforced member insertion hole drilling process, (2) a filler filling process, (3) a reinforcing bar insertion process, and (4) a shearing force reinforced member arrangement process.

(1) Reinforced Member Insertion Hole Drilling Process

The process drills a reinforced member insertion hole for placing a shearing force reinforced member that penetrates an intermediate wall of an existing RC structure body.

Figure 9A:
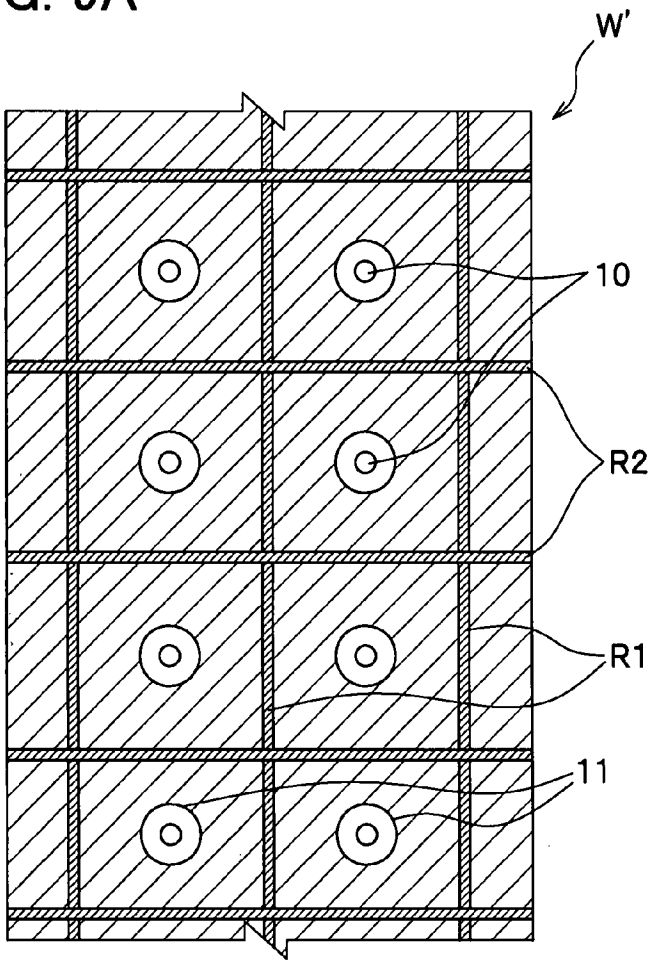

As shown in FIG. 9A, each of the reinforced member insertion holes 10 is arranged at center of both major reinforcing bars R1 and minor reinforcing bars R2 at a same interval laterally as in the reinforcements R1 and longitudinally as in the reinforcing bars R2 not to damage them in drilling, based on information of a bar arrangement drawing and a nondestructive test in execution of the existing RC structure body. As shown in FIG. 9B, the reinforced member insertion hole 10 is penetrated in a direction approximately perpendicular to a side face of the intermediate wall W', and is drilled by using a drilling means such as an impact drill, a leg drill, a rotary hammer drill, and a core drill. A hole diameter of the reinforced member insertion hole 10 is assumed to be a value where a slight margin is anticipated in a reinforcing bar diameter of the shearing force reinforcing bar 41 shown in FIG. 10B.

Thereafter, broadening a drill hole diameter of the reinforced member insertion hole 10 is performed (hereinafter a portion where the drill hole diameter is broadened is referred to as "width broadening part 11") so that respective peripheral edges of the base end plate head 43 (base end fixation member) attached to the base end (distal part) of the shearing force reinforced member 40 and the top end plate head 42 (top end fixation member) attached to the top end of the member 40 are hooked (see FIG. 10C), using the drilling means. Meanwhile, a drilled depth of the width broadening part 11 is requested to be made a value where a cover concrete thickness is added to a thickness of the top end plate head 42 and that of the base end plate head 43. In other words, in a state of the shearing force reinforced member 40 being arranged in the reinforced member insertion hole 10, the top end plate head 42 and the base end plate head 43 ensure the cover concrete thickness equivalent to that of the major reinforcing bar R1. Meanwhile, a diameter of the width broadening part 11 is assumed to be a value where a slight margin is anticipated in respective widths (diameters in a case of a circular shape) of the top end plate head 42 and the base end plate head 43. Hereinafter, in the reinforced member insertion hole 10, a portion where broadening a drilled hole diameter is not performed is referred to as the general part 12.

Then if drilling the hole of the width broadening part 11 is completed in the reinforced member insertion hole 10, a concrete powder generated inside the hole is removed.

(2) Filler Filling Process

The process fills the filler 30 by a press fit machine M in the general part 12 of the reinforced member insertion hole 10 drilled in the reinforced member insertion hole drilling process.

As shown in FIG. 10A, after drilling the reinforced member insertion hole 10 is completed, the filler 30 composed of a cement mortar having a plasticity is filled in the general part 12 by the press fit machine M. Here, at a right end of the general part 12 of the reinforced member insertion hole 10 is placed a stopper 30*a* made of wood or plastic, and thereby the filler 30 is prevented from flowing out.

The cement mortar having the plasticity is a material composed of a pozzolan substance such as cement, a silica fume, and a quartz powder; a viscosity increasing material, and water, and is the filler 30 having a property of not flowing out even if it is filled upward; therefore, the mortar can be filled without being restricted to a direction of the reinforced member insertion hole 10. Meanwhile, such a property of the filler 30 is not limited thereto, and anything is available if it has a similar property. In addition, filling the filler 30 in the reinforced member insertion hole 10 is not limited to the filling by the press fit machine M, and the filler 30 may also be filled by a known method.

(3) Shearing Force Reinforced Rebar Insertion Process

As shown in FIG. 10B, the process inserts the shearing force reinforcing bar 41 and the base end plate head 43 in the reinforced member insertion hole 10 where the filler 30 is filled in the general part 12 in the filler filling process, wherein the head 43 is provided at the base end of the reinforcing bar 41 and a section shape of the head 43 is larger than the reinforcing bar 41.

Inserting the shearing force reinforcing bar 41 in the reinforced member insertion hole 10 is performed by inserting the reinforcing bar 41, where the base end plate head 43 is fixed at the base end thereof, from a left opening, where the stopper 30*a* of the hole is not placed, till the top end abuts with the stopper 30*a*. At this time, because the reinforced member insertion hole 10 is formed with anticipating a margin in a reinforcing bar diameter of the shearing force reinforcing bar 41, the reinforcing bar 41 can be inserted even if the filler 30 is filled in the general part 12 of the hole 10. Meanwhile, in inserting the shearing force reinforcing bar 41 in the reinforced member insertion hole 10 is also available a configuration of lessening an insertion resistance of the filler 30 by attaching a cap made of a bullet-like rubber or plastic to the base end of the reinforcing bar 41.

Figure 11A:
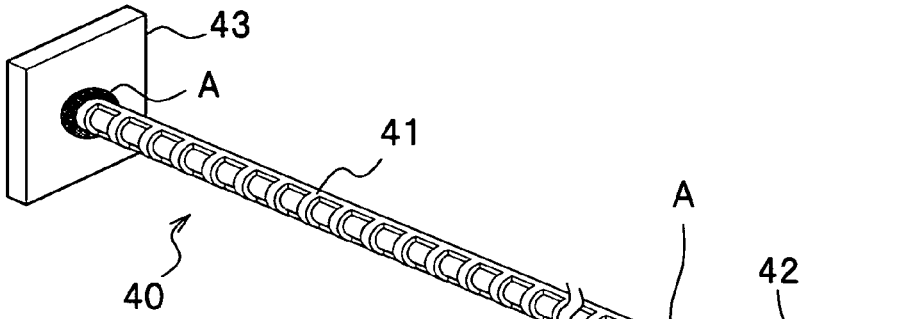
FIG. 11A is an exploded perspective view related to the shearing force reinforced member related to the third embodiment.

Here, the shearing force reinforcing bar 41 related to the third embodiment is, as shown in FIG. 11A, configured with a deformed reinforcing bar, and at the base end (left end in FIG. 11A) is fixed the base end plate head 43 by the friction pressure joining A. In addition, at the top end (right end in FIG. 11A), by the friction pressure joining A is fixed a male thread member 41*a* for joining the top end plate head 42 described later. Here, although a deformed reinforcing bar is assumed to be used as the shearing force reinforcing bar (wire rod) 41, the wire rod 41 is not limited to the deformed reinforcing bar; anything such as a thread reinforcing bar, a steel bar, and a PC tendon, and a carbon rod may be used if it brings out a function as a wire form reinforced material.

In addition, as shown in FIG. 11A, the base end plate head 43 is configured by joining a rectangular steel plate, of which a thickness size is 30% to 120% of the diameter of the shearing force reinforcing bar 41, and a width size is 200% to 300% of the reinforcing bar 41, to the base end of the reinforcing bar 41.

The joining method of the base end plate head 43 to the shearing force reinforcing bar 41 is performed by using a friction pressure joining machine not shown, pushing the rotated steel plate to the fixed reinforcing bar 41, thereby generating friction heat with a predetermined pressure in the rotating steel plate, and joining the steel plate to the reinforcing bar 41 with a melt-adhesion (friction pressure joining A).

Here, the joining method between the plate head 43 and the shearing force reinforcing bar 41 is not limited to the friction pressure joining A; any methods such as a gas pressure joining and an arc welding joining are available if the head 43 and the reinforcing bar 41 can be integrated. In addition, a shape of the plate head 43 is not limited to a rectangle, and such a circle, an ellipse, and a polygon are also available.

<Shearing Force Reinforced Member Arrangement Process>

As shown in FIGS. 10C and 10D, the process arranges the shearing force reinforced member 40 inside the intermediate wall W' by inserting the top end plate head 42, of which a section shape is larger than the shearing force reinforcing bar 41, from the right of the reinforced member insertion hole 10; fixing the top end of the reinforcing bar 41 inserted in the hole 10 in the shearing force reinforcing bar insertion process; and then filling the filler 30 in spaces 11*a* inside the width broadening part 11.

The top end plate head 42 is inserted, upon removing the stopper 30*a* placed at the right part of the general part 12 of the reinforced member insertion hole 10, from the right of the reinforced member insertion hole 10 so that a female thread 42*a* described later of the head 42 is arranged at an end face (bottom face of the width broadening part 11) of the general part 12. Then screwing the top end of the shearing force reinforcing bar 41 in the female thread 42*a*, and thereby fixing the shearing force reinforcing bar 41 and the top end plate head 42, the shearing force reinforced member 40 is formed inside the intermediate wall W'.

Then the spaces 11*a* made at the width broadening parts 11 of the right of the top end plate head 42 and that of the left of the base end plate head 43 are filled by grinding in the fillers 30 composed of a cement mortar, using a trowel. If the filing is completed, frames 46 are respectively placed at surfaces of the intermediate wall W' to close the width broadening parts 11 not for the fillers 30 to be deformed due to a fluidity thereof. Meanwhile, the frames 46 are removed after the fillers 30 are hardened. In this case, if the reinforced member insertion hole 10 is lateral as in the third embodiment, the frames 46 are not requested to be placed because the fillers 30 are not deformed in some case. In addition, if the reinforced member insertion hole 10 is longitudinal or slant, the frame 46 may be placed only at a lower width broadening part 11. Meanwhile, a material, shape, and placement method of each of the frames 46 are sufficient if they can suppress the outflow of the filler 30, and are not limited. Because the filler 30 is filled in advance in the reinforced member insertion hole 10, the shearing force reinforced member 40 is inserted, the filler 30 is hardened, thereby the member 40 is fixed inside the hole 10 without a gap, and thus an integration with the intermediate wall W' is enabled.

Here, in the top end plate head 42 related to the third embodiment, as shown in FIG. 11A, is formed the female thread 42*a* at center of a rectangular steel plate of which a thickness size is 80% to 120% of the reinforcing bar diameter of the shearing force reinforcing bar 41 and a width size is 200% to 300% the reinforcing bar diameter of the reinforcing bar 41, and it is enabled to screw the male thread 41*a* in the female thread 42*a*. Meanwhile, the shape of the top end plate head 42 is not limited to a rectangle; other polygons, a circle, and an ellipse (including an oval shape and such a shape where side parts of a circle is cut off) are also available. In addition, the shape of the joining part between the top end plate head 42 and the shearing force reinforcing bar 41 is not also limited; as a top end plate head 42' shown in 11C, a configuration is also available that fixes a cylindrical member 42*a'* where a female thread is formed on an inner face, matching the top end shape of the reinforcing bar 41. In this case a nut can be used as the cylindrical member 42*a'*.

Figure 11B:
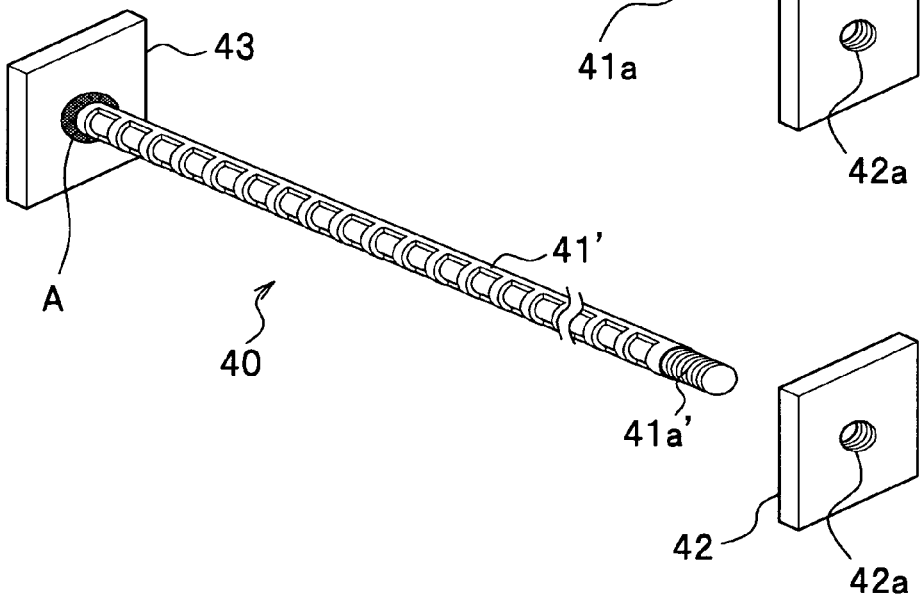
FIGS. 11B and 11C are exploded perspective views showing variation examples of the shearing force reinforced member.
Figure 11C:
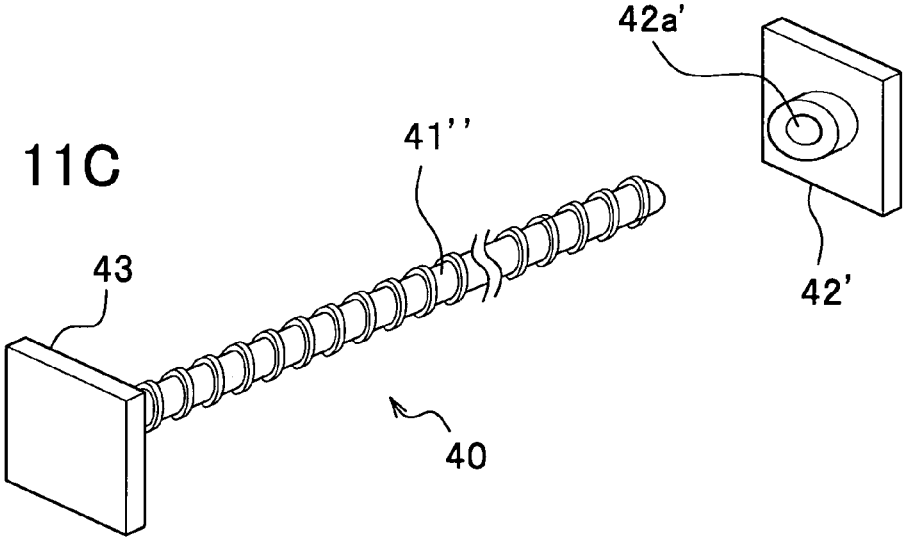

In addition, although the shearing force reinforcing bar 41 is assumed to be made by joining the male member 41*a* at the top end of a deformed reinforcing bar by the friction pressure joining A, it is not limited thereto; for example, as shown in FIG. 11B, a shearing force reinforcing bar 41' may also be used where the male member 41*a* is processed at the top end of a deformed reinforcing bar; and as shown in FIG. 11C, as a shearing force reinforcing bar 41" may also be used a thread reinforcing bar.

In addition, in the filler filling process a configuration is also available that arranges the top end plate head 42 instead of the stopper 30*a* at the right end of the general part 12, makes a sealant intervene around the head 42, thereby shields the right end of the general part 12, and then fills the filler 30. Thus in the shearing force reinforcing bar insertion process, by inserting the shearing force reinforcing bar 41 in the reinforced member insertion hole 10, and fixing the top end of the reinforcing bar 41 to the top end plate head 42, it is enabled to arrange the shearing force reinforced member 40 inside the intermediate wall W'.

Figure 12:
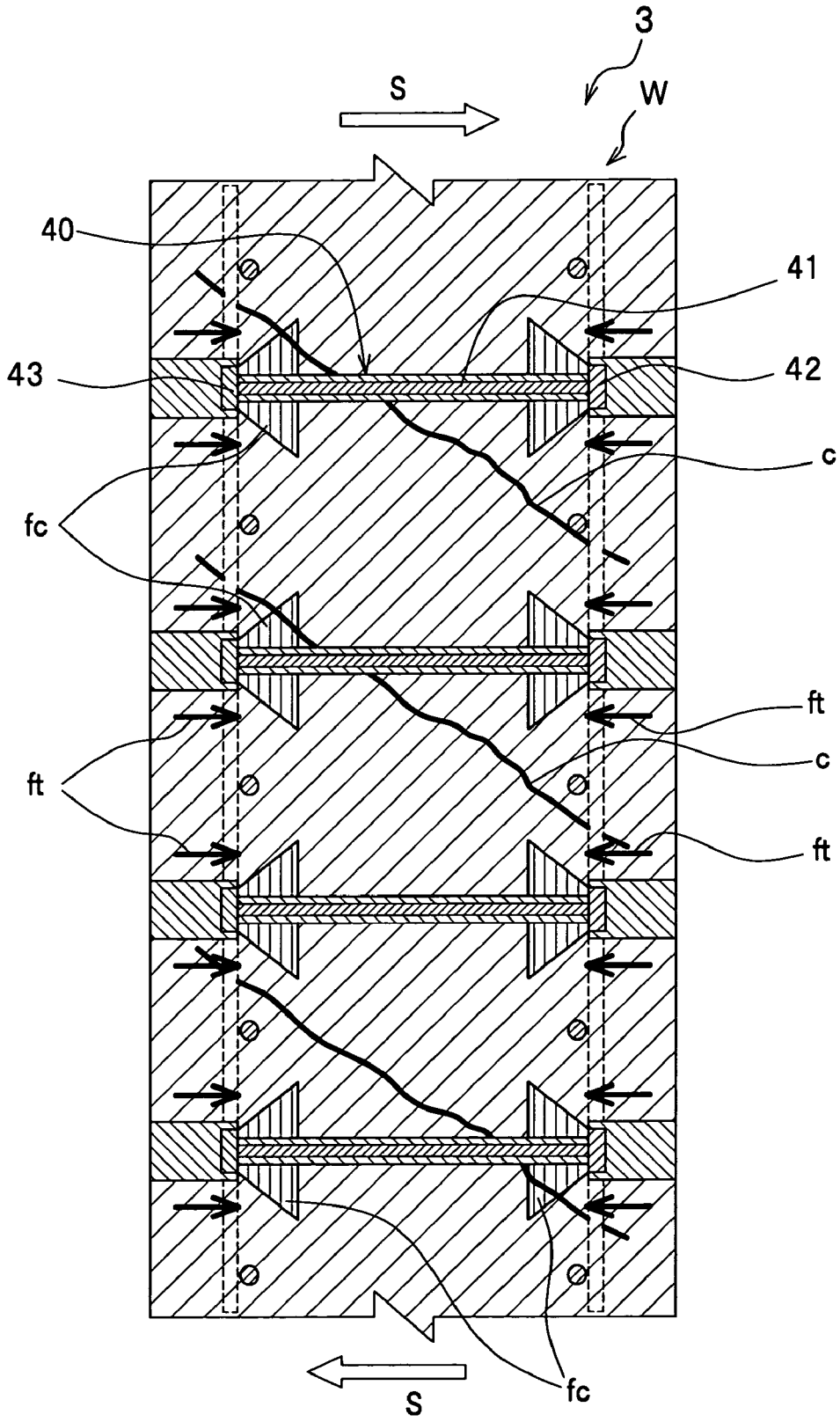
FIG. 12 is a front section view showing a stress state when a shearing force acts on a wall where the reinforced structure related to the third embodiment is applied.

An RC structure body reinforced by the reinforcement method of the present invention directly reinforces with the shearing force reinforced members 40 the oblique cracks c occurring when the out-of-plane shearing force S acts as shown in FIG. 12, and improves shear force capacity.

In other words, although if the out-of-plane shearing force S acts on the intermediate wall W', the oblique cracks c attempt to occur, a tensile force acts on each of the shearing force reinforced members 40; therefore, the pulling-out force ft acts on the top end plate head 42 and the base end plate head 43. Therefore, a supporting pressure acts on a concrete (hereinafter referred to as "internal concrete") existing inside the top end plate head 42 and the base end plate head 43 as a reaction force, and the field of compression forces fc is formed in the internal concrete. In other words, the internal concrete receives a lateral constraint and results in increasing a resistance force for an oblique tension. Therefore, the out-of-plane shear force capacity of the intermediate wall W' is increased by the shearing force reinforced member 40 having the top end plate head 42 and the base end plate head 43 at respective ends of the member 40; and the compression forces fc are generated (compression stress field is formed) in the internal concrete, and thereby the toughness performance of the intermediate wall W' is also increased.

In addition, in a case of performing a reinforcement related to the embodiment, because the top end plate head 42 and the base end plate head 43 exist, a fixation portion increases. One example of results are shown in FIGS. 13A and 13B, wherein pulling-out tests are respectively performed in order to investigate the fixation effect for the shearing force reinforcing bar 41 having the base end plate head 43 and for a shearing force reinforcing bar (hereinafter referred to as "comparison example") where a semicircular hook is formed at an end.

Figure 13A:
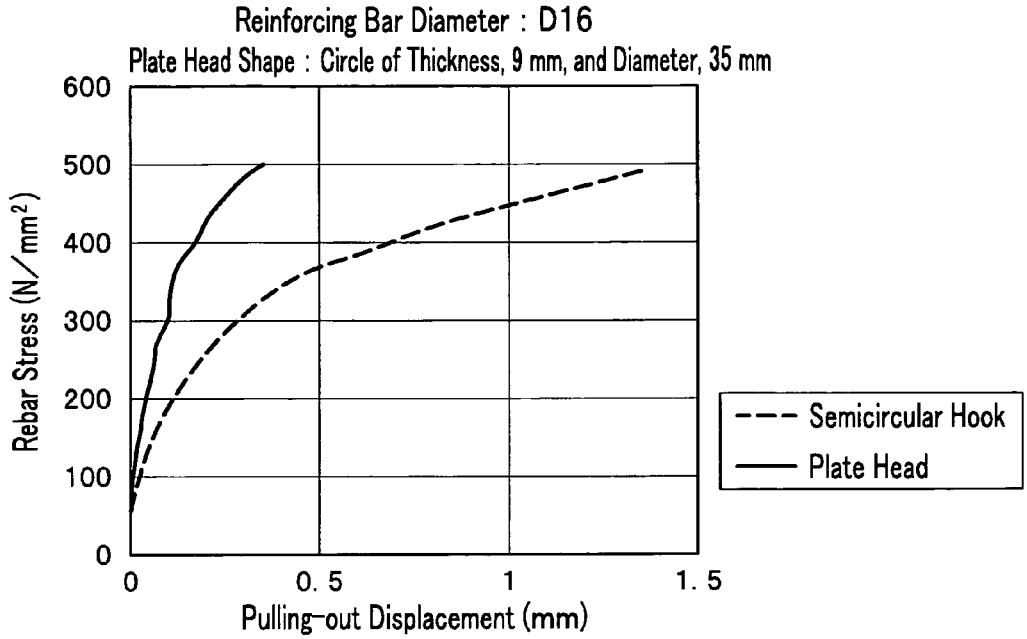
FIGS. 13A and 13B are graphs both showing results of pulling-out tests between a shearing force reinforcing bar having a plate head and a shearing force reinforcing bar where a semicircular hook is formed at an end.

FIG. 13A is a graph of a relationship between a tensile stress and pulling-out displacement, wherein the relationship was derived in a case of: using a deformed reinforcing bar (D16); drilling a reinforced member insertion hole of a diameter of 25 mm in an RC member; inserting the shearing force reinforcing bar 41 having the base end plate head 43 of a circular shape of which a thickness was 9 mm and a diameter was 35 mm, and the comparison example; and filling and hardening the filler 30.

Figure 13B:
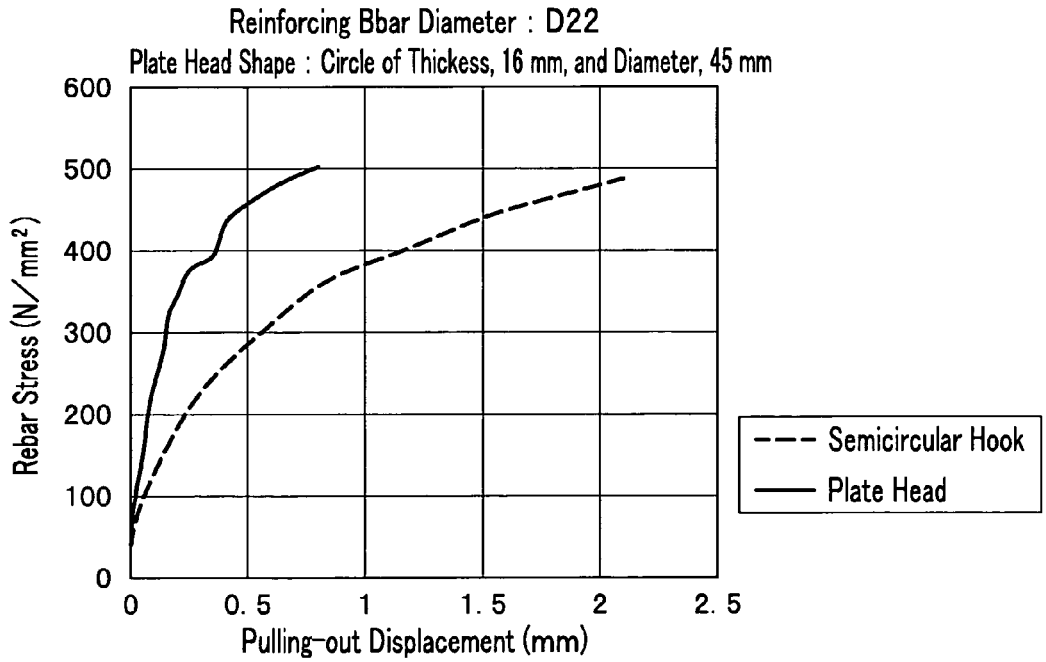

FIG. 13B is a graph of a relationship between a tensile stress and pulling-out displacement, wherein the relationship was derived in a case of: similarly using a deformed reinforcing bar (D 22); drilling a reinforced member insertion hole of a diameter of 32 mm in an RC member; and inserting the shearing force reinforcing bar 41 having the top end plate head 43 of a circular shape of which a thickness was 16 mm and a diameter was 45 mm, and the comparison example.

In accordance with the result, the shearing force reinforcing bar 41 having the base end plate head 43 related to the present invention results in being demonstrated that the pulling-out displacement is smaller (pulling-out rigidity is high) and the fixation effect is markedly excellent.

Fourth Embodiment

A reinforcement method related to the fourth embodiment mainly comprises (1) a reinforced member insertion hole drilling process, (2) a reinforcing bar insertion process, (3) a shearing force reinforced member arrangement process, and (4) a filler filling process.

(1) Reinforced Member Insertion Hole Drilling Process

The process is similar to that of the third embodiment, and therefore, a detailed explanation thereof will be omitted.

(2) Shearing Force Reinforced Rebar Insertion Process

As shown in FIG. 14A, the process inserts the shearing force reinforcing bar 41 and the base end plate head 43 in the reinforced member insertion hole 10 penetrated through the intermediate wall W' in the reinforced member hole drilling process, wherein the head 43 is provided at the base end of the reinforcing bar 41 and a section shape of the head 43 is larger than the reinforcing bar 41.

Inserting the shearing force reinforcing bar 41 in the reinforced member insertion hole 10 is performed by inserting the reinforcing bar 41, where the base end plate head 43 is fixed at the base end of the reinforcing bar 41, from a left opening of the hole 10 till the head 43 abuts with the top end of the left width broadening part 11.

Here, at the base end plate head 43 is formed an air releasing hole 43*a* in advance for filling the filler 30 described later. Meanwhile, because other configurations of the shearing force reinforcing bar 41 and the base end plate head 43 are similar to those shown in the third embodiment, detailed explanations thereof will be omitted.

<Shearing Force Reinforced Member Arrangement Process>

As shown in FIG. 14B, the process arranges the shearing force reinforced member 40 inside the intermediate wall W' by inserting the top end plate head 42, of which a section shape is larger than the shearing force reinforcing bar 41, from the right of the reinforced member insertion hole 10, and by fixing the top end of the reinforcing bar 41 inserted in the hole 10 in the shearing force reinforcing bar insertion process.

The top end plate head 42 is inserted from the right of the reinforced member insertion hole 10 so that the female thread 42*a* of the head 42 is arranged at a right end (bottom face of the width broadening part 11) of the general part 12 of the hole 10. Then screwing the top end of the shearing force reinforcing bar 41 in the female thread 42*a*, and thereby fixing the shearing force reinforcing bar 41 and the top end plate head 42, the shearing force reinforced member 40 is formed inside the intermediate wall W'. Then making sealants 44 intervene around the top end plate head 42 and the base end plate head 43, the fillers 30 are prevented from leaking in the filler filling process described later when they are filled.

Here, at the top end plate head 42 related to the fourth embodiment is in advance formed a filling hole 42*b* in filling the filler 30 described later. In addition, because other configurations of the top end plate head 42 are similar to those of the third embodiment, detailed explanations thereof will be omitted.

(4) Filler Filling Process

As shown in FIGS. 14C and 14D, the process fills filler 30 in the reinforced member insertion hole 10 where the shearing force reinforced member 40 is placed.

Firstly, as shown in FIG. 14C, inserting a filling tube 31 composed of such a vinyl tube in the filling hole 42*b* of the top end plate head 42, the tube 31 is penetrated to the general part 12 of the reinforced member insertion hole 10. In addition, in the air release hole 43*a* of the base end plate head 43 an air release tube 32 composed of such a vinyl tube is penetrated to the general part 12 of the reinforced member insertion hole 10.

Then the filler 30 is filled in the general part 12 from the filling tube 31, using a known filling machine. Meanwhile, filling the filler 30 is assumed to be performed till the filler 30 is discharged from the air release tube 32, and thereby a gap between the general part 12 and the shearing force reinforcing bar41 is completely filled. In addition, the filler 30 does not leak because the both ends are shielded by the top end plate head 42 and the base plate head 43 of which peripheries are intervened by the sealants 44.

If filling the filler 30 in the general part 12 is completed, the space 11*a* made at the right width broadening part 11 of the top end plate head 42 and that made at the left width broadening part 11 of the base end plate head 43 are filled by grinding in the fillers 30 composed of a cement mortar, using a trowel. Meanwhile, the filling method of the filler 30 in the space 11*a* is similar to that shown in the third embodiment, a detailed explanation thereof will be omitted.

Thus the filler 30 is hardened, thereby the shearing force reinforced member 40 is fixed inside the reinforced member insertion hole 10 without a gap, an integration with the intermediate wall W' is enabled, and the shearing force reinforced structure 4 is completed.

In addition, a shearing force reinforcement mechanism and a fixation effect according to the fourth embodiment are similar to those described in the third embodiment, detailed explanations thereof will be omitted.

Fifth Embodiment

A reinforcement method related to the fifth embodiment mainly comprises (1) a reinforced member insertion hole drilling process, (2) a reinforcing bar insertion process, (3) a filler filling process, and (4) a shearing force reinforced member arrangement process.

(1) Reinforced Member Insertion Hole Drilling Process

The process is similar to that of the third embodiment, and therefore, a detailed explanation thereof will be omitted.

(2) Shearing Force Reinforced Rebar Insertion Process

As shown in FIG. 15A, the process inserts the shearing force reinforcing bar41 and the base end plate head 43 in the reinforced member insertion hole 10 penetrated through the intermediate wall W' in the reinforced member hole drilling process, wherein the head 43 is provided at the base end of the reinforcing bar 41 and the section shape of the head 43 is larger than the reinforcing bar 41.

Inserting the shearing force reinforcing bar41 in the reinforced member insertion hole 10 is performed by inserting the reinforcing bar 41, where the base end plate head 43 is fixed at the base end of the reinforcing bar 41, from a left opening of the hole 10 till the head 43 abuts with a bottom face (left end of the general part 12) of the left width broadening part 11. Then making the sealants 44 intervene around the base end plate head 43, the fillers 30 are prevented from leaking in the filler filling process described later when they are filled.

Here, because other configurations of the shearing force reinforcing bar41 and the base end plate head 43 are similar to those shown in the third embodiment, detailed explanations thereof will be omitted.

(3) Filler Filling Process

As shown in FIG. 15B, the process fills the filler 30 in the general part 12 of the reinforced member insertion hole 10 where the shearing force reinforcing bar41 is placed.

Firstly, as shown in FIG. 15B, the filling tube 31 composed of such a vinyl tube is inserted from a right opening so that the top end of the tube 31 is arranged near the base end plate head 43 at left. Then using a known filling machine, the filler 30 is filled from the left of the general part 12 through the filling tube 31. Here, the filling tube 31 is gradually pulled out toward right till the completion of the filling as the filler 30 is being filled, while the top end of the tube 31 is always arranged inside the filled filler 30. Meanwhile, the filler 30 does not leak because the left end is shielded by the base end plate head 43 of which a periphery is intervened by the sealant 44.

<Shearing Force Reinforced Member Arrangement Process>

As shown in FIGS. 15C and 15 D, the process arranges the shearing force reinforced member 40 inside the intermediate wall W' by inserting the top end plate head 42, of which a section shape is larger than the shearing force reinforcing bar41, from the right of the reinforced member insertion hole 10, fixing the top end of the reinforcing bar 41 inserted in the hole 10 in the shearing force reinforcing bar insertion process, and then filling the filler 30 in the spaces 11*a* inside the width broadening parts 11.

Meanwhile, because the process is similar to that of the third embodiment, a detailed explanation thereof will be omitted.

In addition, the top end plate head 42 related to the fifth embodiment is similar to that of the third embodiment, a detailed explanation thereof will be omitted.

Thus the filler 30 is hardened, thereby the shearing force reinforced member 40 is fixed inside the reinforced member insertion hole 10 without a gap, an integration with the intermediate wall W' is enabled, and the shearing force reinforced structure 5 is completed.

In addition, a shearing force reinforcement mechanism and a fixation effect according to the fifth embodiment are similar to those described in the third embodiment, detailed explanations thereof will be omitted.

Sixth Embodiment

Figure 16A:
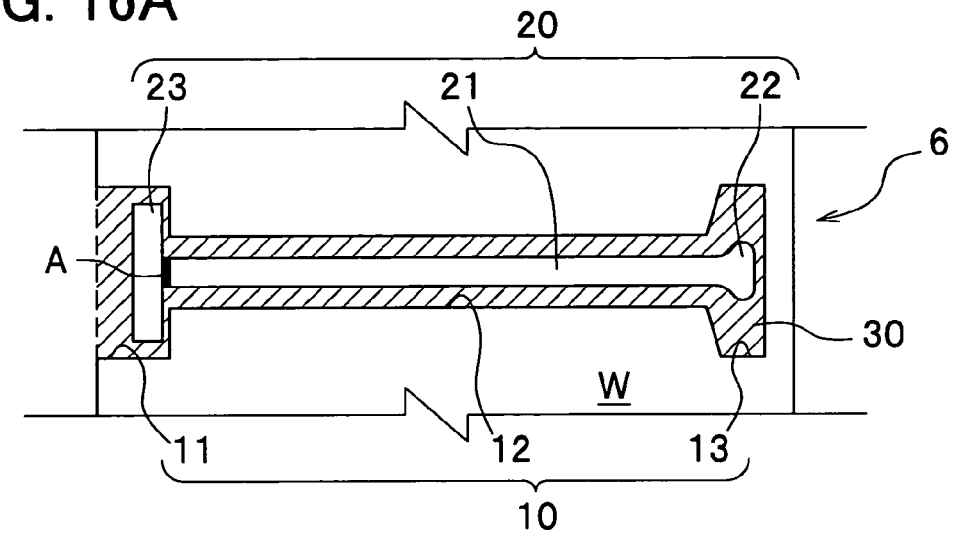
FIG. 16A is a section view showing a shearing force reinforced structure related to a six embodiment.

A shearing force reinforced structure 6 related to a sixth embodiment of the present invention comprises, as shown in FIG. 16A, the side wall W of an existing reinforced concrete structure, the shearing force reinforced members 20 arranged inside the reinforced member insertion holes 10 with bottoms formed in a direction intersecting a major reinforcing bar from the inner face side of the side wall W; and the fillers 30 filled in the holes 10.

Each of the shearing force reinforced members 20 comprises the shearing force reinforcing bar21 of a wire rod, a top end protrusion (top end fixation member) 22 fixed at the top end of the reinforcing bar 21, and the plate head (base end fixation member) 23 fixed at the base end of the reinforcing bar 21.

In addition, each of the reinforced member insertion holes 10 comprises the general part 12 having an inner diameter larger than a reinforcing bar diameter of the shearing force reinforcing bar21 and an outer diameter of the top end protrusion 22, and smaller than a width of the plate head 23; the base end width broadening part 11 formed at the base end of the hole 10 and having an inner diameter larger than the width of the plate head 23; and a top end width broadening part 13 formed at the base end of the hole 10 and having an inner diameter larger than the inner diameter of the general part 12. Here, in the description a "width" of a fixation member is assumed to be unified as: a diagonal length if a shape of the fixation member is a rectangle or a polygon; a diameter if the shape is a circle; and a long axis length if the shape is an ellipse.

Then a space of an inner face more inside than the plate head 23 of the base end width broadening 11 is filled with the filler 30.

Here will be described a detail of the shearing force reinforced structure 6 related to the sixth embodiment.

Figure 17A:
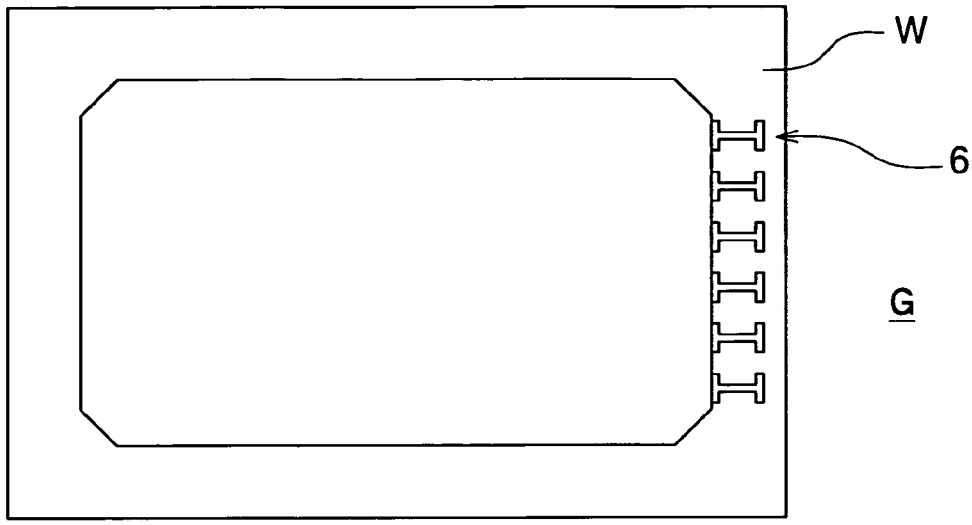
FIG. 17A is a schematic section view showing an arrangement relationship of a shearing force reinforced structure.
Figure 17B:
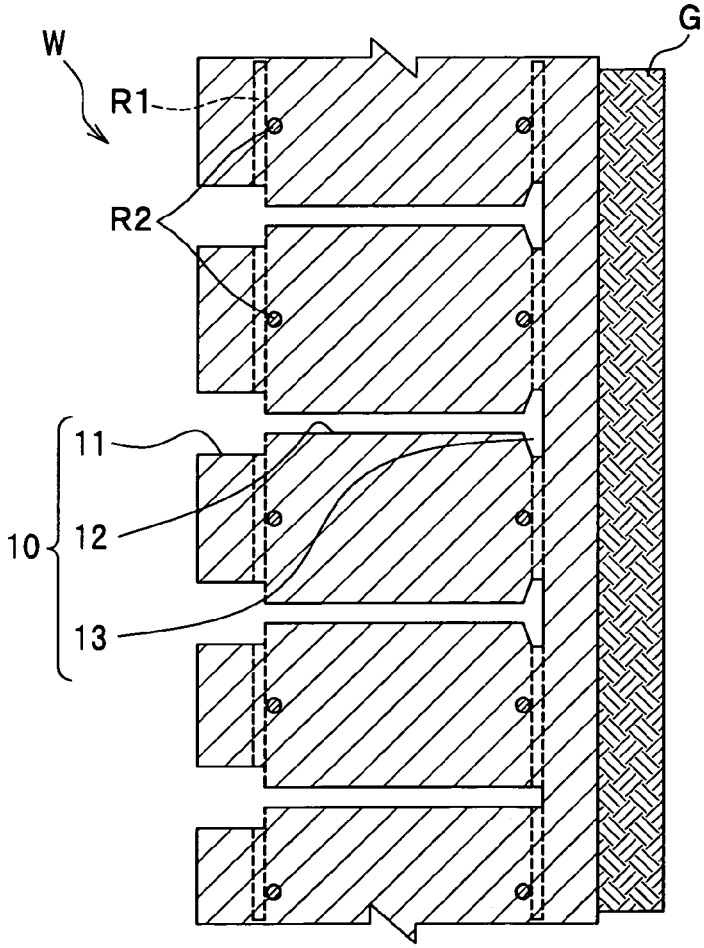
FIG. 17B is an enlarged section view of reinforced member insertion holes.

Each of the reinforced member insertion holes 10 is drilled from an inner face side to outer face side of the side wall W in order to place the shearing force reinforced member 20, and as shown in FIGS. 17A and 17B, is arranged at center of both major reinforcing bars R1 and minor reinforcing bars R2 at a same interval laterally as in the reinforcements R1 and longitudinally as in the reinforcing bars R2 not to damage them in drilling, based on information of a bar arrangement drawing and a nondestructive test in execution of an existing RC structure body. Meanwhile, a drilling method of the reinforced member insertion hole 10 is similar to that shown in the first embodiment, a detailed explanation thereof will be omitted. In addition, the reinforced member insertion hole 10 is drilled, having a slightly downward slant, and is provided in a length size where a cover concrete thickness of a predetermined size is subtracted at the outer face side; and a hole diameter of the general part 12 is formed into a value where a slight margin is anticipated in the outer diameter of the top end protrusion 22 formed at the top end of the shearing force reinforced member 20 shown in FIG. 18.

In addition, at the base end of the reinforced member insertion hole 10 is formed the base end width broadening part 11 by broadening a drilled hole diameter so that a peripheral edge of the plate head 23 attached to the base end (distal end) of the shearing force reinforced member 20 is hooked, using the drilling means. Meanwhile, a drilled depth of the base end width broadening part 11 is designed to be a value where a cover concrete thickness is added to a thickness of the plate head 23, and is drilled till a position of the major reinforcing bar R1 of the inner face side in the sixth embodiment.

Furthermore, at the top end of the reinforced member insertion hole 10 is formed the top end width broadening part 13 by attaching a not shown bottom broadening bit at the top end of the drilling means and broadening the width of the top end. Meanwhile, in the sixth embodiment, because drilling is performed till the position depth of the major reinforcing bar R1, a cover concrete thickness of a predetermined size is ensured at a bottom part of the top end width broadening part 13.

Figure 18:
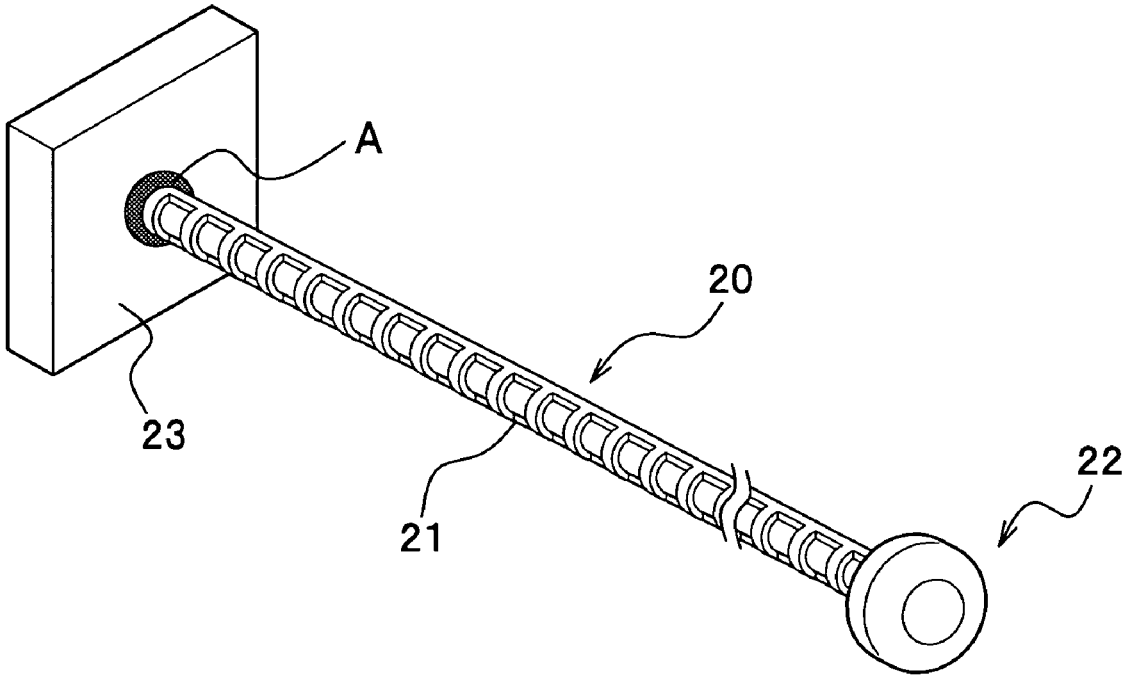
FIG. 18 is a general perspective view of a shearing force reinforced member related to the six embodiment.

The shearing force reinforced member 20 comprises, as shown in FIGS. 16A and 18, the shearing force reinforcing bar21 configured with a deformed reinforcing bar; and the top end protrusion 22 and the plate head 23 that are respectively provided at the top end and base end of the reinforcing bar 21 and of which section shapes are larger than the reinforcing bar 21. Here, although it is assumed to use a deformed reinforcing bar as the shearing force reinforcing bar (wire rod) 21, it is not limited thereto; anything bringing out a function of a linear reinforced material, for example, such as a thread reinforcing bar, a steel bar, a PC tendon, and a carbon rod may also be used.

The top end protrusion 22 related to the six embodiment is formed, as shown in FIG. 18, into a diameter larger than the reinforcing bar diameter of the shearing force reinforcing bar21 by pressing or striking the top end of the reinforcing bar 21 in a state of being heated.

Meanwhile, the top end protrusion 22 is not limited thereto, and may also be formed into a predetermined shape (a width size is 130% to 200% of a reinforcing bar diameter of a shearing force reinforced reinforcing bar) according to a method similar to that of the variation example of the ring head 22 of the first embodiment shown in FIG. 4.

Meanwhile, a forming method of the top end protrusion 22 is not limited; a friction pressure joining, a gas pressure joining, an arc welding joining, and the like are available if the integration of the protrusion 22 is enabled.

As shown in FIG. 18, the plate head 23 is configured by integrally fixing a rectangular steel plate to the base end of shearing force reinforcing bar21, wherein a thickness of the steel plate is 40% to 80% of the diameter of the reinforcing bar 21, and a width thereof is 130% to 300% of the diameter of the reinforcing bar 21. The fixation of the plate head 23 to the shearing force reinforcing bar21 can be simply performed by using a friction pressure joining machine, pushing the rotated steel plate to the fixed reinforcing bar 21, thereby generating friction heat in the rotating steel plate at a predetermined pressure, and joining the steel plate to the reinforcing bar 21 with a melt-adhesion (friction pressure joining A).

Here, the joining method between the plate head 23 and the shearing force reinforcing bar21 is not limited to the friction pressure joining A; any method such as a gas pressure joining and an arc welding joining are available if the head 23 and the reinforcing bar 21 can be integrated. In addition, the shape of the plate head 23 is not limited to a rectangle, and such a circle, an ellipse, and a polygon are also available.

Figure 16B:
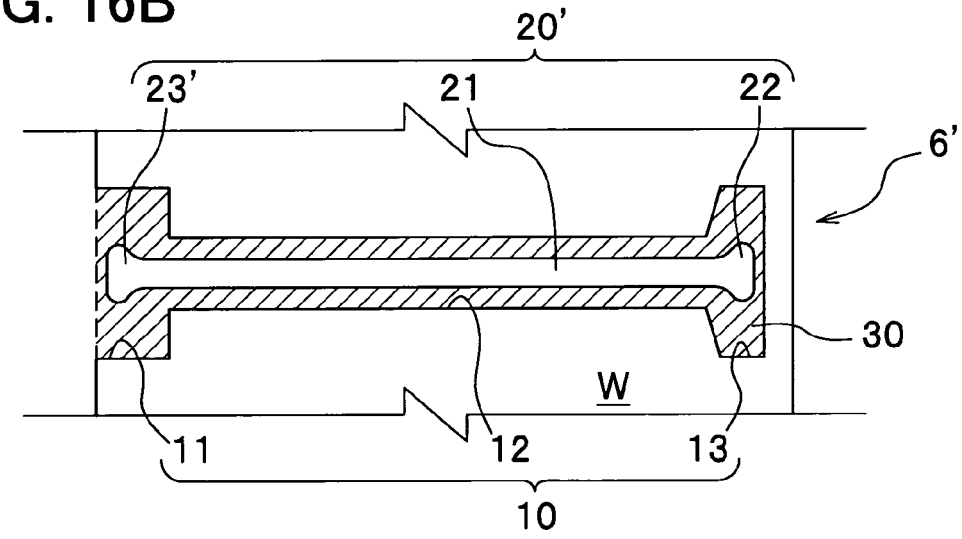
FIGS. 16B and 16C are variation examples thereof.

Here, the configuration of the shearing force reinforced member 20 is not limited to that described above; for example, as in a shearing force reinforced structure 6' shown in FIG. 16B is also available a configuration of also forming a base end protrusion 23' at the base end of the shearing force reinforcing bar21, similarly to the base end protrusion 22 formed at the top end.

Figure 16C:
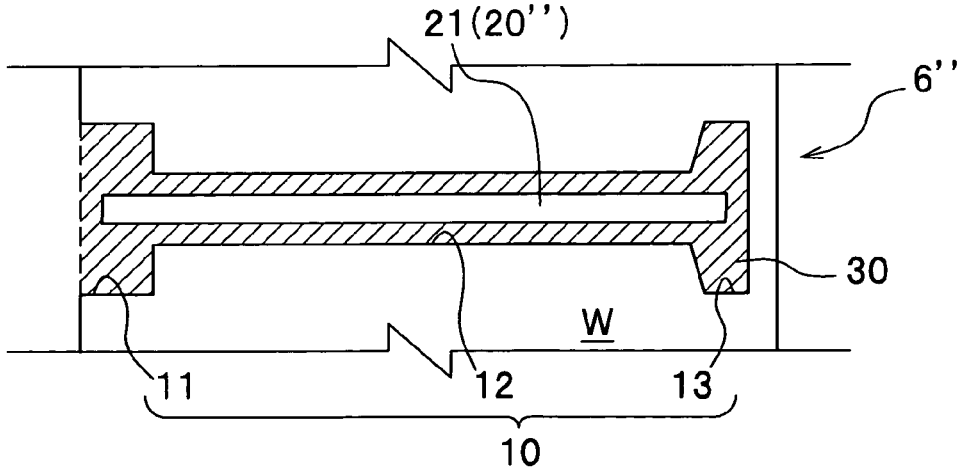

In addition, if it is enabled to bring out a sufficient pulling-out force with respect to the shearing force S added to the side wall W, a configuration of member is formed at neither the top end nor the base end as in a shearing force reinforced structure 6" shown in FIG. 16C.

As the filler 30 is used a fiber reinforced cementitious composite material (hereinafter referred to as "high strength fiber filler 30") composed by blending a fiber, of which a diameter is 0.05 mm to 0.3 mm and a length is 8 mm to 16 mm, by around 1% to 4% for a volume of a cementitious matrix obtained by mixing: cement; an aggregate of which a maximum particle diameter is not more than 2.5 mm; a silica fume of a high activity pozzolan reaction particle of which a particle size is 0.01 to 0.5 μm and; a blast furnace slug or a fly ash of a low activity pozzolan reaction particle of which a particle size is 0.1 to 15 μm; at least one kind of super plasticizer; and water: In the high strength fiber filler 30 a compression strength is 200 $N/mm^2$, a bending tensile strength is 40 $N/mm^2$, and an adhesion strength for a deformed bar is 60 to 80 $N/mm^2$, and thus a fixation effect of a higher rigidity has been realized.

Figure 19:
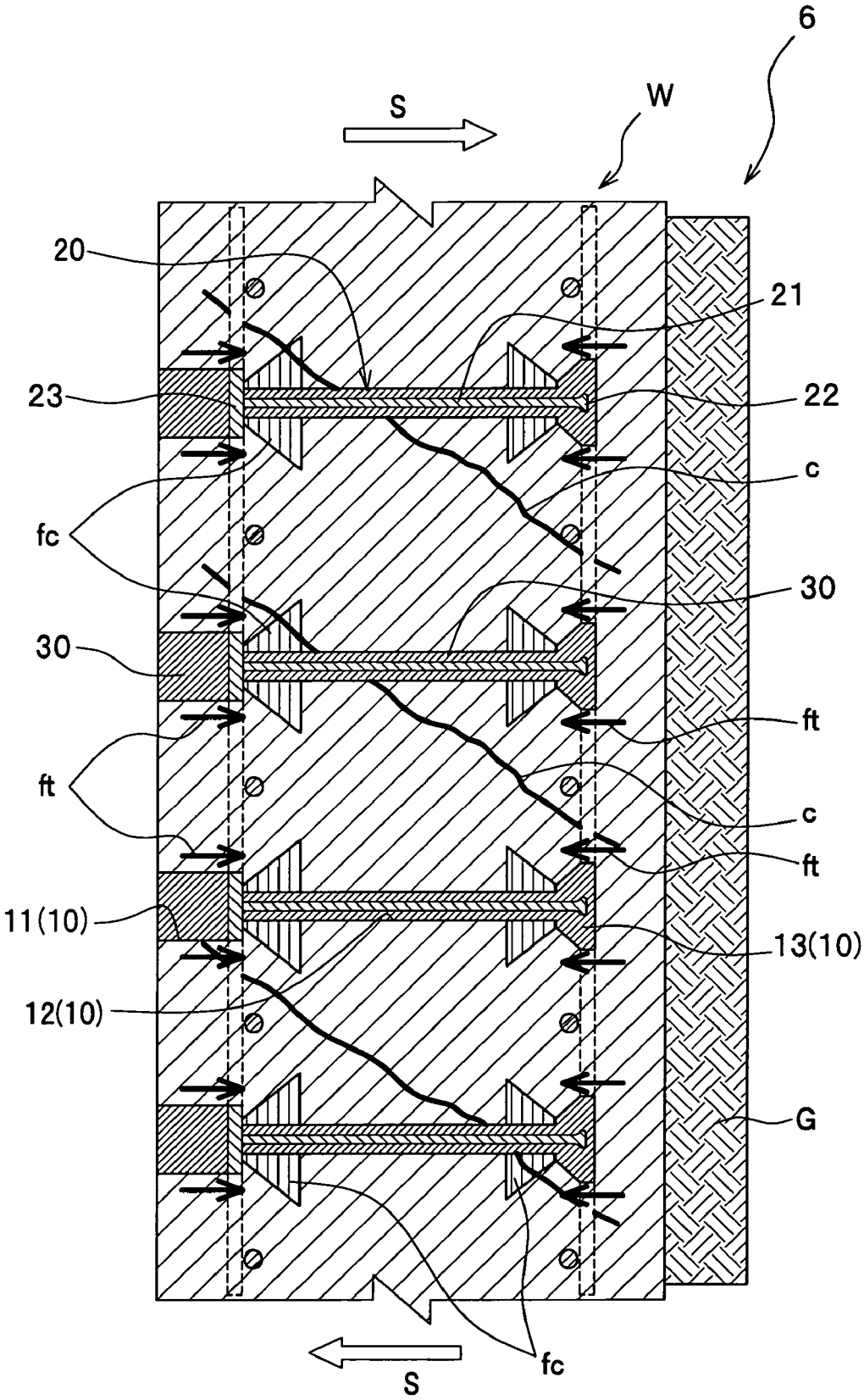
FIG. 19 is a side section view showing a stress state when a shearing force acts on the shearing force reinforced structure related to the six embodiment.

The shearing force reinforced structure 6 of the present invention directly reinforces with the shearing force reinforced members 20 the oblique cracks c occurring when the out-of-plane shearing force S acts as shown in FIG. 19, and improves shear force capacity.

In other words, although if the out-of-plane shearing force S acts on the side wall W, the oblique cracks c attempt to occur, a tensile force acts on each of the shearing force reinforced members 20, and thereby, the pulling-out forces ft act on the top end protrusion 22 and the plate head 23 at both ends of the member 20. The top end protrusion 22 and the plate head 23 are respectively integrated with the top end width broadening part 13 and the base end width broadening part 11, and achieve a sufficient constraint effect with respect to the pulling-out forces ft by the high strength fiber filler 30 of an ultra-high strength filled in the both parts 13, 11. Therefore, a supporting pressure acts on a concrete (hereinafter referred to as "internal concrete") existing inside the top end protrusion 22 and the plate head 23 as a reaction force of the pulling-out forces ft, and a field of the compression forces fc is formed in the internal concrete. In other words, the internal concrete receives a lateral constraint and results in increasing a resistance force for an oblique tension. Therefore, an out-of-plane shear force capacity of the side wall W is increased by the shearing force reinforced member 20 having the top end protrusion 22 and the plate head 23 at the respective ends of the member 20; and the top end width broadening part 13 and the base end width broadening part 11, and thus the compression forces fc are generated (a compression stress field is formed) in the internal concrete, and thereby a toughness performance of the side wall W is also increased.

In a case of performing a reinforcement according to the shearing force reinforced structure 6 related to the sixth embodiment, because there exist the base end width broadening part 13 and the top end width broadening part 11 in the reinforced member insertion hole 10, the fixation effect of the shearing force reinforced member 20 is increased. Results are shown in FIGS. 20A and 20B, wherein pulling-out tests are respectively performed in order to investigate the fixation effect for the shearing force reinforced member 20 according to the reinforced member insertion hole 10 having the width broadening parts 13, 11 at the ends and for the shearing force reinforced member 20 (hereinafter referred to as "comparison example") according to the reinforced member insertion hole 10 not having the parts 13, 11.

Figure 20A:
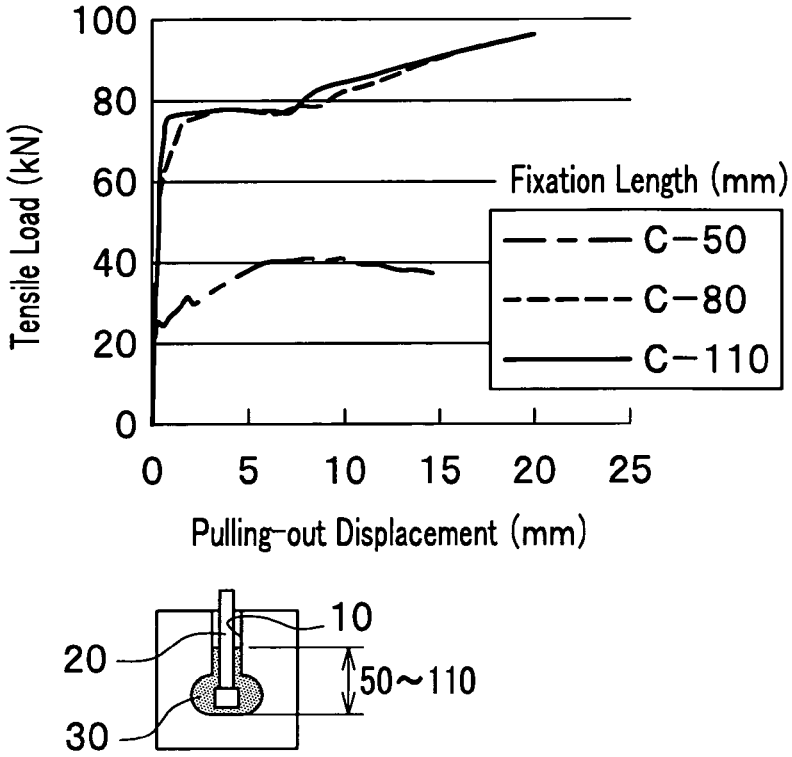
FIGS. 20A and 20B are graphs both showing results of pulling-out tests between a shearing force reinforcing bar having a plate head and a shearing force reinforcing bar where a semicircular hook is formed at an end.
Figure 20B:
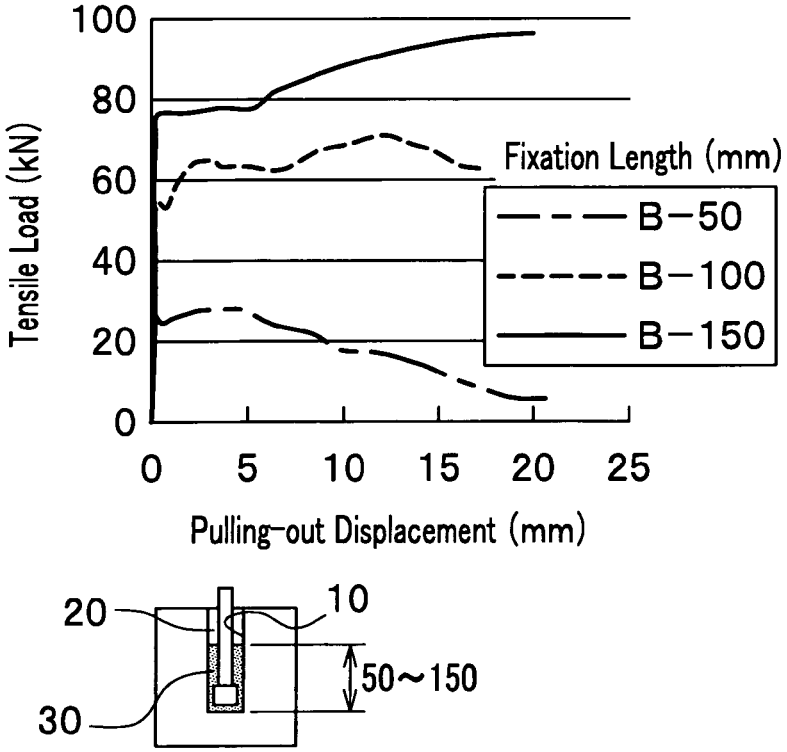

FIG. 20A is a graph of: respectively filling the high strength fiber fillers 30 in depths of 50 mm (C-50), 80 mm (C-80), and 110 mm (C-110) in the reinforced member insertion holes 10 having the width broadening parts 13, 11; and performing pulling-out tests for test bodies where the shearing force reinforced members 20 were inserted, and in FIG. 20A a tensile load is shown at a vertical axis and a puling-out displacement is shown at a horizontal axis. In addition, FIG. 20B is a graph of: respectively filling the high strength fiber fillers 30 in depths of 50 mm (B-50), 100 mm (B-100), and 110 mm (B-110) in the reinforced member insertion holes 10 not having the width broadening parts 13, 11; and performing pulling-out tests for test bodies where the shearing force reinforced members 20 were inserted, and in FIG. 20B a tensile load is shown at a vertical axis and a puling-out displacement is shown at a horizontal axis.

Comparing the both results, even in a case that the depth of the fillers 30 is same 50 mm, it is shown that an excellent fixation effect can be obtained in the reinforced member insertion hole 10 having the width broadening parts 13, 11, compared to that not having the parts 13, 11. In addition, it is shown in the configuration having the width broadening parts 13, 11 that if making the depth of the filler 30 80 mm, it is enabled to obtain a fixation effect approximately similar to that of the depth of 150 mm of the comparison example, and the fixation effect of the reinforced member insertion hole 10 having the width broadening parts 13, 11 is larger. Accordingly, it is demonstrated that providing ends of a reinforced member insertion hole with broadening parts, a shearing force reinforced member and the width broadening parts are integrated and resist a tensile force; because even if a wall thickness is thin, an excellent fixation effect can be obtained, an out-of-plane shear force capacity of a face material or slab material preferably increases, and a toughness performance preferably increases thanks to an compression stress occurring in an internal concrete.

Here, a construction related to the shearing force reinforced structure 6 is performed by: drilling the reinforced member insertion hole 10 in the side wall W, then filling the fillers 30 in the general part 12 and the top end width broadening part 13, inserting the shearing force reinforced member 20 in the hole 10, and filling the filler 30 in the base end width broadening part 11. Meanwhile, the order of filling the filler 30 in the general part 12 and the top end width broadening part 13, and inserting the shearing force reinforced member 20 is not limited; the order of filling the filler 30 after inserting the shearing force reinforced member 20 in the reinforced member insertion hole 10 is also available. In this case filling the fillers 30 in the general part 12 and the top end width broadening part 13 may be performed by forming a filling hole in the plate head 23 and filling the filler 30 through the hole.

Next will be described seventh and eighth embodiments of the present invention.

Seventh Embodiment

Figure 21:
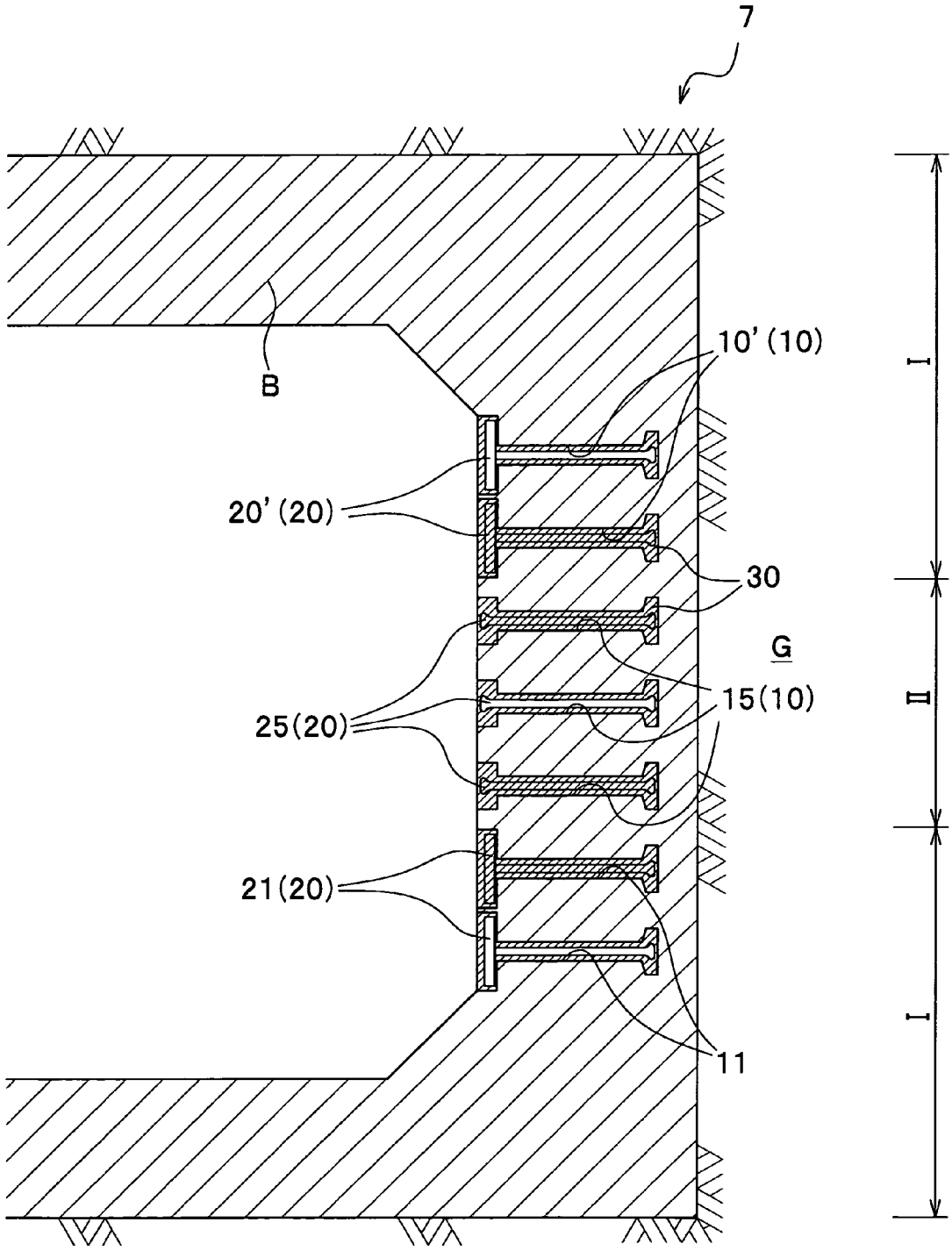
FIG. 21 is a section view showing a shearing force reinforced structure related to a seventh embodiment.

As shown in FIG. 21, a shearing force reinforced structure 7 related to the seventh embodiment comprises a box culvert B of an existing reinforced concrete structure; first shearing force reinforced members 20' arranged inside first reinforced member insertion holes 10' formed in a position (see FIGS. 24C), where a plastic hinge is assumed to occur due to a seismic force, and first areas I of a vicinity of the position; second shearing force reinforced members 25 arranged inside second reinforced member insertion holes 15 formed in a second area II of other areas; and fillers 30. Hereinafter, in a case that "first reinforced member insertion hole 10'", and "second reinforced member insertion hole 15" are not distinguished, these are called "reinforced member insertion hole 10", in some case. In addition, in a case that "first shearing force reinforced members 20'" and "second shearing force reinforced member 25" are not distinguished, these are called "shearing force reinforced member 20" in some case.

Figure 22A:
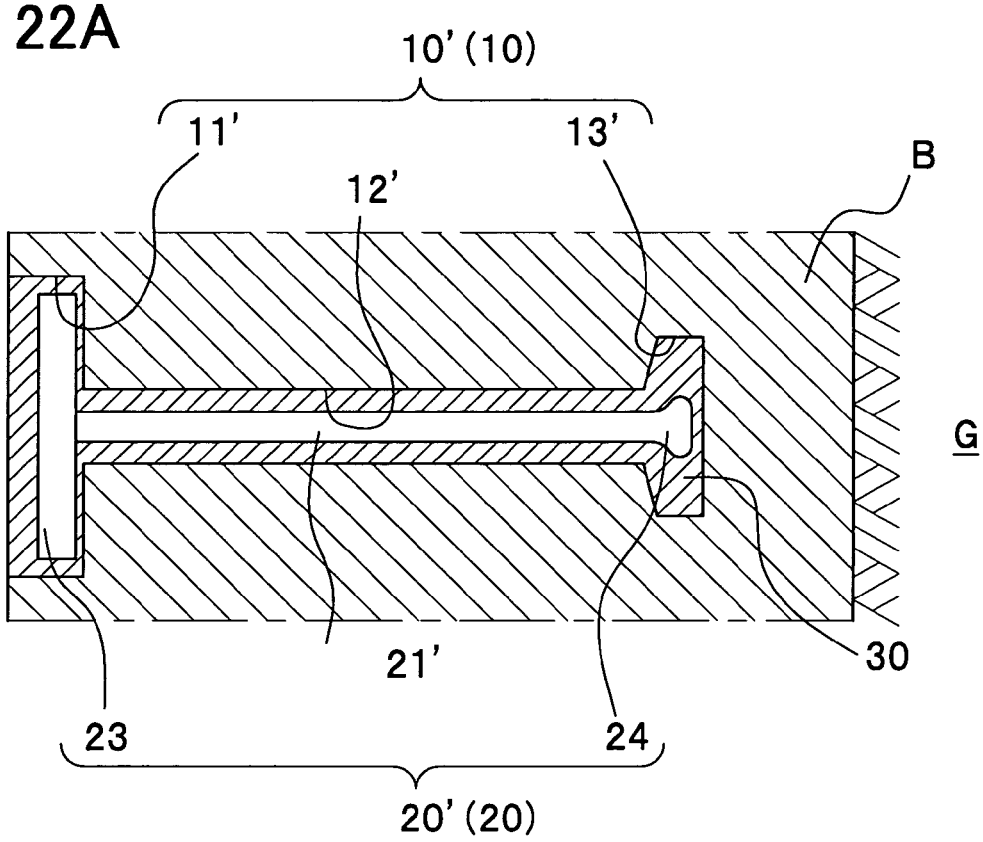
FIGS. 22A and 22B are drawings showing a first shearing force reinforced member.

As shown in FIG. 22, the first shearing force reinforced member 20' comprises a first shearing force reinforcing bar (first wire rod) 21' composed of a deformed reinforcing bar; a protrusion part 24 that is formed at a top end of the reinforcing bar 21' and of which a section shape is larger than the reinforcing bar 21'; and the plate head 23 (first fixation member) that is formed at a base end of the reinforcing bar 21' and of which a section shape is larger than the protrusion part 24. Then a total length of the shearing force reinforced member 20' is shorter than a depth of the first reinforced member insertion hole 10' and is completely embedded in a state of being arranged in the hole 10' (see FIG. 21A or 22A).

Figure 22B:
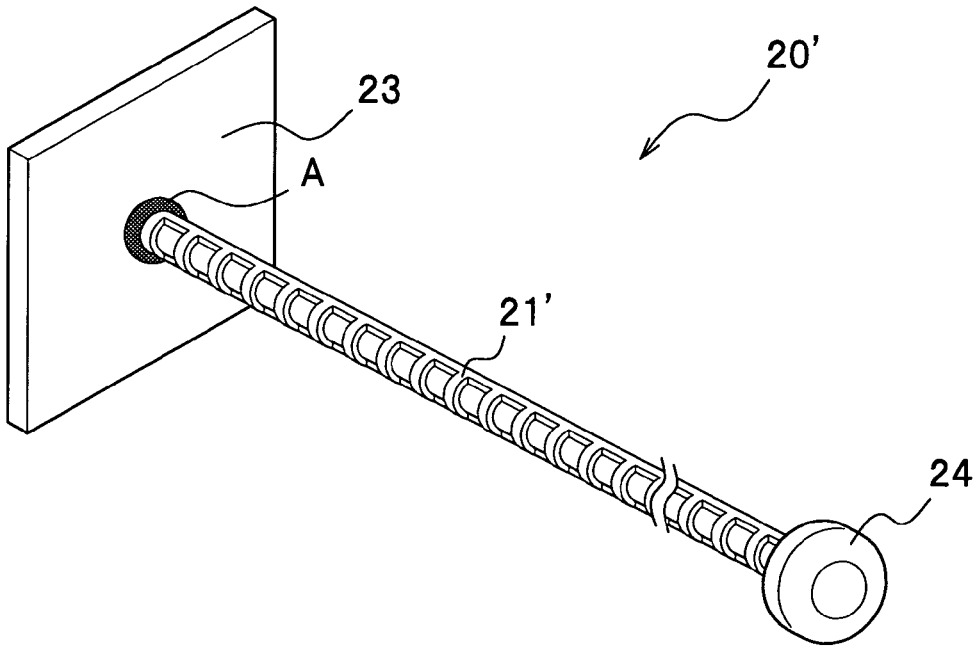

As shown in FIGS. 22A and 22B, the plate head 23 is composed of a rectangular steel plate of which a thickness is 40% to 80% of a reinforcing bar diameter of the first shearing force reinforcing bar21' and a width is around ten to 15 folds of the reinforcing bar 21', and is integrally fixed to the base end of the reinforcing bar 21'. The fixation of the plate head 23 to the shearing force reinforcing bar21' can be simply performed by using a friction pressure joining machine; pushing the rotated steel plate to the fixed reinforcing bar 21', thereby generating friction heat in the rotating steel plate at a predetermined pressure, and joining the steel plate to the reinforcing bar 21' with a melt-adhesion (friction pressure joining A).

Here, the joining method between the plate head 23 and the first shearing force reinforcing bar21' is not limited to the friction pressure joining A; any methods such as a gas pressure joining and an arc welding joining are available if the head 23 and the reinforcing bar 21' can be integrated. In addition, the shape of the plate head 23 is not limited to a rectangle, and such a circle, an ellipse, and a polygon are also available.

Figure 23A:
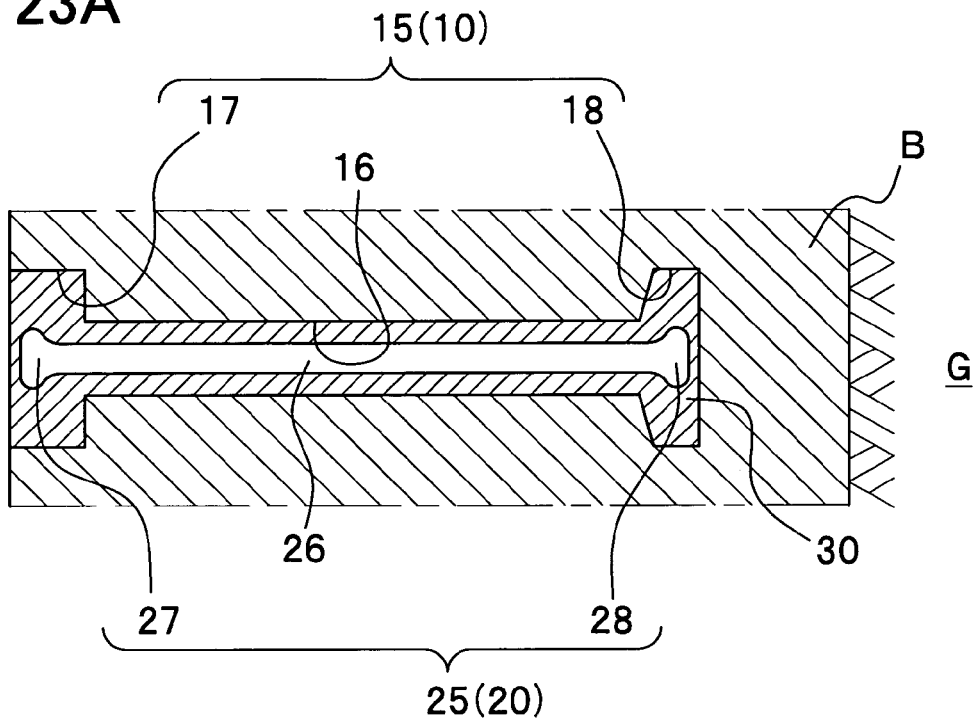
FIGS. 23A and 23B are drawings showing a second shearing force reinforced member.
Figure 23B:
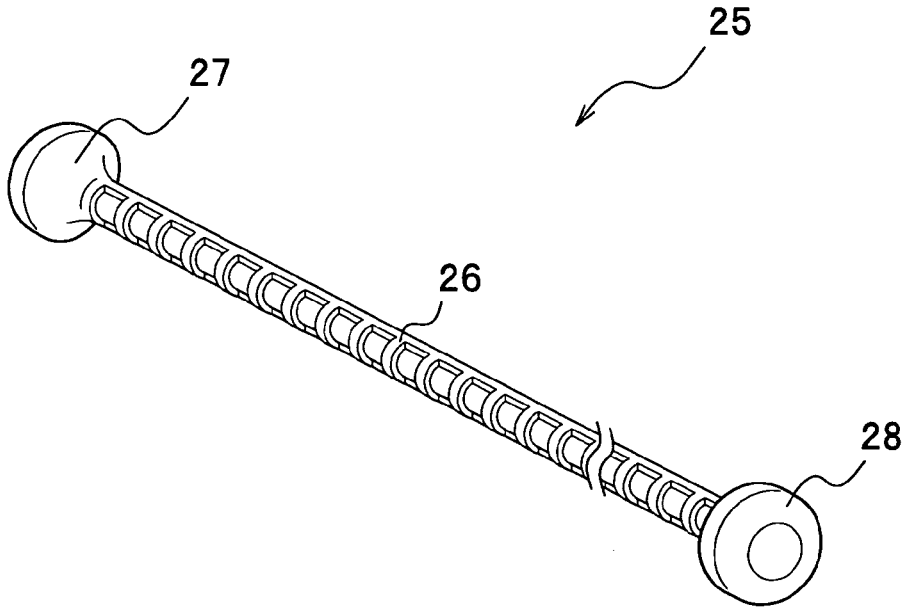

In addition, the protrusion part 24 is formed, as shown in FIG. 22B, into a width of 120% to 130% of the reinforcing bar diameter of the first shearing force reinforcing bar21' by pressing or striking the top end of the reinforcing bar 21' in a state of being heated. Here, in the description a "width" of a fixation member such as the plate head 23 and the protrusion part 24 is assumed to be unified into a diagonal length if a shape of the fixation member is a rectangle or a polygon; a diameter if it is a circle; and a long axis length if it is an ellipse As shown in FIGS. 23A and 23B, the second shearing force reinforced member 25 comprises a second shearing force reinforcing bar (second wire rod) 26 composed of a deformed reinforcing bar; a protrusion part (second base end fixation member) 27 that is formed at a base end of the reinforcing bar 26 and of which a section shape is larger than the reinforcing bar 26; and a protrusion part 28 that is similarly formed at a base end of the reinforcing bar 26 and of which a section shape is larger than the reinforcing bar 26. Then a total length of the shearing force reinforced member 25 is shorter than a depth of the second reinforced member insertion hole 15 and is completely embedded in a state of being arranged inside the hole 15 (see FIG. 21 or 23A).

The protrusion parts 27, 28 respectively formed at the base end and the top end of the second shearing force reinforced member 25 are formed to be widths of 120% to 130% of the reinforcing bar diameter of the second shearing force reinforcing bar26 according to a method similar to that of the protrusion 24 formed at the top end of the first shearing force reinforced member 20'.

Here, the first shearing force reinforcing bar21' and the second shearing force reinforcing bar26 (hereinafter, in a case that "first shearing force reinforcing bar21'" and "second shearing force reinforcing bar26" are not distinguished, these are simply called "shearing force reinforced reinforcing bars 21', 26" in some case) related to each shearing force reinforced member 20 are not limited to a reinforcing bar; anything bringing out a function of a linear reinforced material, for example, such as a thread reinforcing bar, a steel bar, a PC tendon, and a carbon rod may also be used.

In addition, the protrusion part 24 formed at the top end of the first shearing force reinforced member 20' is not limited to the above, and may also be formed into a predetermined shape (the width is 120% to 130% of the diameter of the shearing force reinforcing bar21') according to a method similar to that of the variation example of the ring head 22 of the first embodiment shown in FIG. 4 as needed.

Meanwhile, the forming method of the protrusion part 24 is not limited; a friction pressure joining, a gas pressure joining, an arc welding joining, and the like are available if the formation of the part 24 is enabled.

Meanwhile, a combination of the plate head 23 and the protrusion part 24 can be freely selected according to such a bar arrangement state, concrete strength, and wall thickness of the side wall W to be reinforced. In addition, the protrusion parts 27, 28 respectively formed at the base end and top end of the second shearing force reinforced member 25 may also be formed according to the various methods similarly to the protrusion part 24 of the first shearing force reinforced member 20'.

As shown in FIG. 21, each of the reinforced member insertion holes 10 is drilled from an inner face side to outer face side of the box culvert B in order to place the shearing force reinforced member 20. In the seventh embodiment the reinforced member insertion holes 10 are formed at total seven places: the first reinforced member insertion holes 10' respectively formed at two places in the upper and lower first areas I; and the second reinforced member insertion holes 15 formed at three places in the second area II.

As shown in FIG. 22A, each of the reinforced member insertion holes 10' comprises a first general part 12' of which an inner diameter is 120% to 130% of a reinforcing bar diameter of a first shearing force reinforcing bar21' and larger than a width of the protrusion part 24; a first base end width broadening part 11' formed at a base end of the hole 10' and having an inner diameter larger than the width of the plate head 23; and a first top end width broadening part 13' formed at a top end of the hole 10' and having an inner diameter larger than an inner diameter of the part 12'.

In addition, as shown in FIG. 23A, each of the reinforced member insertion holes 15 comprises a first general part 16 of which an inner diameter is 120% to 130% of a reinforcing bar diameter of the second shearing force reinforcing bar26 and larger than a width of the protrusion part 28; a second base end width broadening part 17 formed at the base end of the hole 15 and having an inner diameter larger than the width of a part 16; and a second top end width broadening part 18 formed at a top end of the hole 15 and having an inner diameter larger than that of the part 16.

Here, in the seventh embodiment, as shown in FIGS. 22A and 23A, the shapes of the first general part 12 and the second general part 16, and those of the first top end width broadening part 13' and the second top end width broadening part 18 are respectively formed into same shapes.

Meanwhile, because the drilling method of the reinforced member insertion hole 10 is similar to the method shown in the first embodiment, a detailed explanation thereof will be omitted. In addition, a hole diameter of the reinforced member insertion hole 10 is formed into a value where a slight margin is anticipated in a diameter of the protrusion part 24 or 28 attached at the top end of the shearing force reinforced member 20 shown in FIGS. 22B and 23B.

In addition, the first base end width broadening part 11' and the second top end width broadening part 17 are formed by enlarging a drilled hole diameter, using the drilling method. Meanwhile, a drilled hole depth of the first base end width broadening part 11' is a value where a margin is anticipated in the thickness of the plate head 23, and in the seventh embodiment the first base end width broadening part 11' is drilled till a position where the plate head 23 is completely embedded in a state of the first shearing force reinforced member 20' being placed. In addition, in the seventh embodiment, although a drilled hole depth of the second base end width broadening part 17 is formed into a depth similar to that of the first base end width broadening part 11', if the protrusion part 27 ensures a cover concrete thickness equivalent to the major reinforcing bar R1 in a state of arranging the second shearing force reinforced member 25 in the second reinforced member insertion hole 15, making the depth of the part 17 a value where the cover concrete thickness is added to the thickness of the part 17 formed at the base end of the second shearing force reinforcing bar26, an excellent shearing force reinforced function can be preferably maintained even if a concrete more outside than the major reinforcing bar R1 is peeled off due to such an earthquake.

Furthermore, the first top end width broadening part 13' and the second top end width broadening part 18 are formed by attaching a diameter enlarging bit at the top end of the drilling means and enlarging the top ends. Meanwhile, in the embodiment bottom parts of the first top end width broadening part 13' and the second top end width broadening part 18 are drilled till a depth of a position of the outside major reinforcing bar R1, the cover concrete thickness of a predetermined size is ensured.

The filler 30 is filled in a gap formed between the reinforced member insertion hole 10 and the shearing force reinforced member 20. In addition, as shown in FIG. 22A, the filler 30 is filled in a space of the first base end width broadening part 11' formed inside the plate head 23, not to generate a concavity and convexity on a surface of the culvert B, using such a trowel.

In the filler 30 is used a fiber reinforced cementitious composite material (hereinafter referred to as "high strength fiber filler 30") composed by blending a fiber, of which a diameter is 0.05 mm to 0.3 mm and a length is 8 mm to 16 mm, by around 1% to 4% for a volume of a cementitious matrix obtained by mixing cement; an aggregate of which a maximum particle diameter is not more than 2.5 mm; a silica fume of a high activity pozzolan reaction particle of which a particle size is 0.01 to 0.5 μm; a blast furnace slug or a fly ash of a low activity pozzolan reaction particle of which a particle size is 0.1 to 15 μm; at least one kind of super plasticizer; and water: In the high strength fiber filler 30 a compression strength is 200 $N/mm^2$, a bending tensile strength is 40 $N/mm^2$, and an adhesion strength for a deformed bar is 60 to 80 $N/mm^2$, and thus a fixation effect of a higher rigidity has been realized. In addition, the filler 30 has a plasticity, and a property of not flowing down even if it is filled upward.

In the seventh embodiment, as shown in FIGS. 22A and 23A, the filler 30 is filled so as to shield the reinforced member insertion hole 10 from outside with the filler 30.

A construction of the shearing force reinforced structure 7 related to the seventh embodiment is performed in order of drilling the reinforced member insertion hole 10, filling the filler 30 in the hole 10, and placing the shearing force reinforced member 20 in the hole 10.

The reinforced member insertion holes 10 are respectively drilled so that predetermined shapes are formed at predetermined positions. Then after drilling, concrete powders generated inside the holes due to the drilling are removed.

Next, the filler 30 is filled in the reinforced member insertion hole 10 by such a press fit machine. At this time the filler 30 is filled only in the first general part 12' and the first top end width broadening part 13' in the first reinforced member insertion hole 10'.

Then the shearing force reinforced member 20 is inserted in the reinforced member insertion hole 10 where the filler 30 is filled. Meanwhile, in the first reinforced member insertion hole 10', after inserting the first shearing force reinforced member 20', the filler 30 is filled not to generate a space inside the first base end width broadening part 11', and a concavity and convexity on the inner face of the box culvert B, using a trowel for a space of an inner face side of the plate head 23 of the part 11'. In addition, also with respect to the second reinforced member insertion hole 15, filling the filler 30 not to generate a concavity and convexity on the inner face of the box culvert B, a surface thereof is adjusted.

Meanwhile, in the construction of the shearing force reinforced structure 7 the order of filling the filler 30 and inserting the shearing force reinforced member 20 in the reinforced member insertion hole 10 is not limited, a configuration of inserting the member 20 in the hole 10 and then filling the filler 30 is also available. In this case the filler 30 may be filled in the first general part 12' and the first top end width broadening part 13' by forming a filling hole in the plate head 23 and filling the filler 30 through the hole.

Next will be described a reinforcement effect of an out-of-plane shear force capacity and an improvement effect of a bending toughness performance according to the shearing force reinforced structure 7 of the seventh embodiment.

Figure 24A:
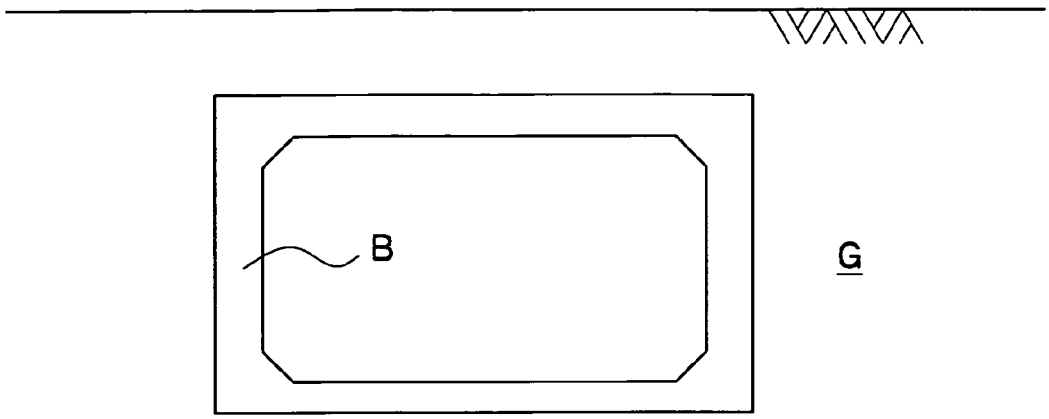
FIGS. 24A to 24C are drawings showing deformed states of a box culvert embedded in ground.
Figure 24B:
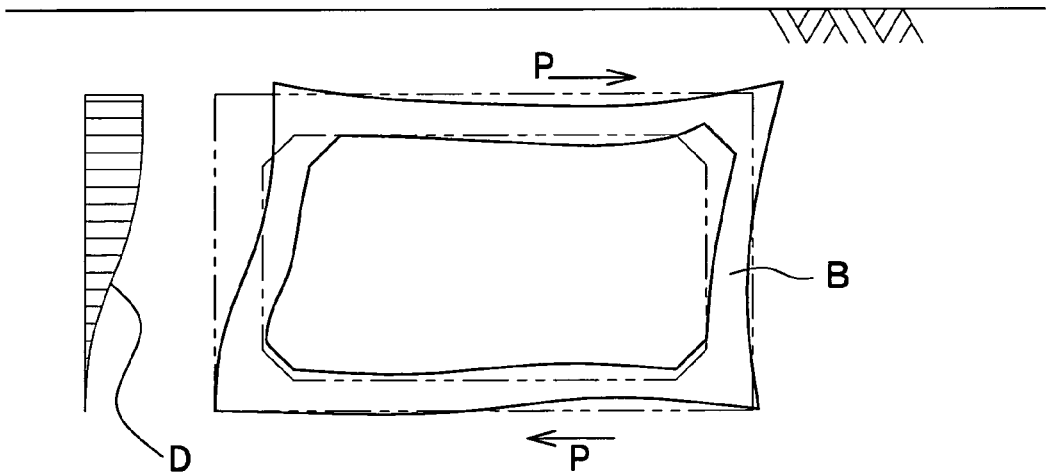
Figure 24C:
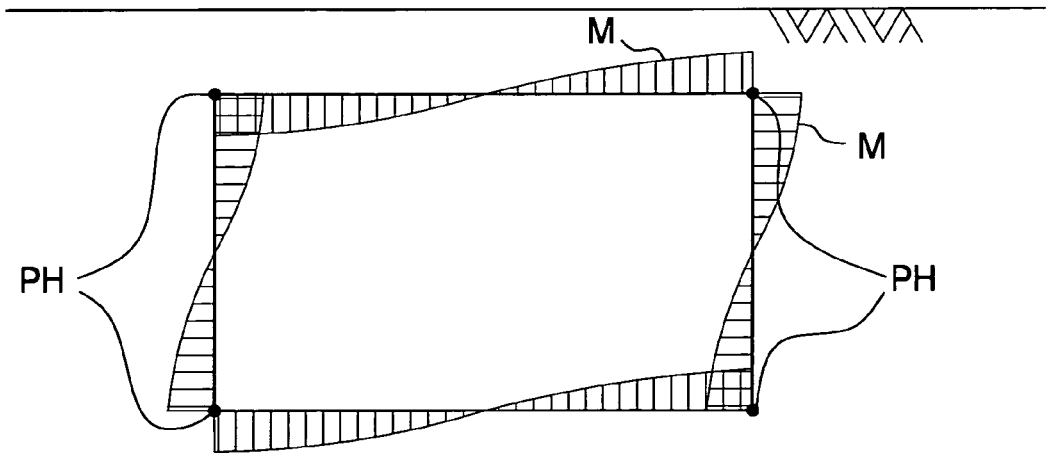

In a case that a large seismic force P occurs in a periphery of the box culvert B embedded in the earth shown in FIG. 24A, a deformation also occurs in the box culvert B, accompanied with a deformation such as a ground deformation distribution D of a peripheral ground as shown in FIG. 24B. Therefore, because on the box culvert B of a rahmen structure works a bending moment M as shown in FIG. 24C, and the moment M concentrates on corners, damage concentrates on plastic hinges near the corners.

In accordance with the seventh shearing force reinforced structure 7, because the plate head 23 composed of a large plate member is formed at the base end of each of the first shearing force reinforced members 20' arranged near the plastic hinge PH where the bending moment M becomes larger in earthquake, even if a reinforcing bar of an inside wall yields in tension due to the seismic force P, and a cover concrete attempts to peel off, shear force capacity and a toughness performance can be improved because the plate head 23 can constrain the concrete and make a compression stress field in it. Accordingly, a position of the plastic hinge PH results in being inevitably moved from a corner to a central part, and the box culvert B increases a resistance performance for a collapse. Although a major reinforcing bar and a cover concrete outside the corner show an effect similar to that of the plate head 23 by the filler 30 of the first top end width broadening part 13', the cover concrete can be prevented from peeling off thanks to an earth pressure of the ground G because there exists the ground G at the outer face side, compared to the inner face side of the box culvert B.

Therefore, because the shearing force reinforced structure 7 shows a high toughness performance and copes with a deformation of the ground even after the major reinforcing bar yields due to the bending moment M, it can make damage smaller.

Eighth Embodiment

Figure 25:
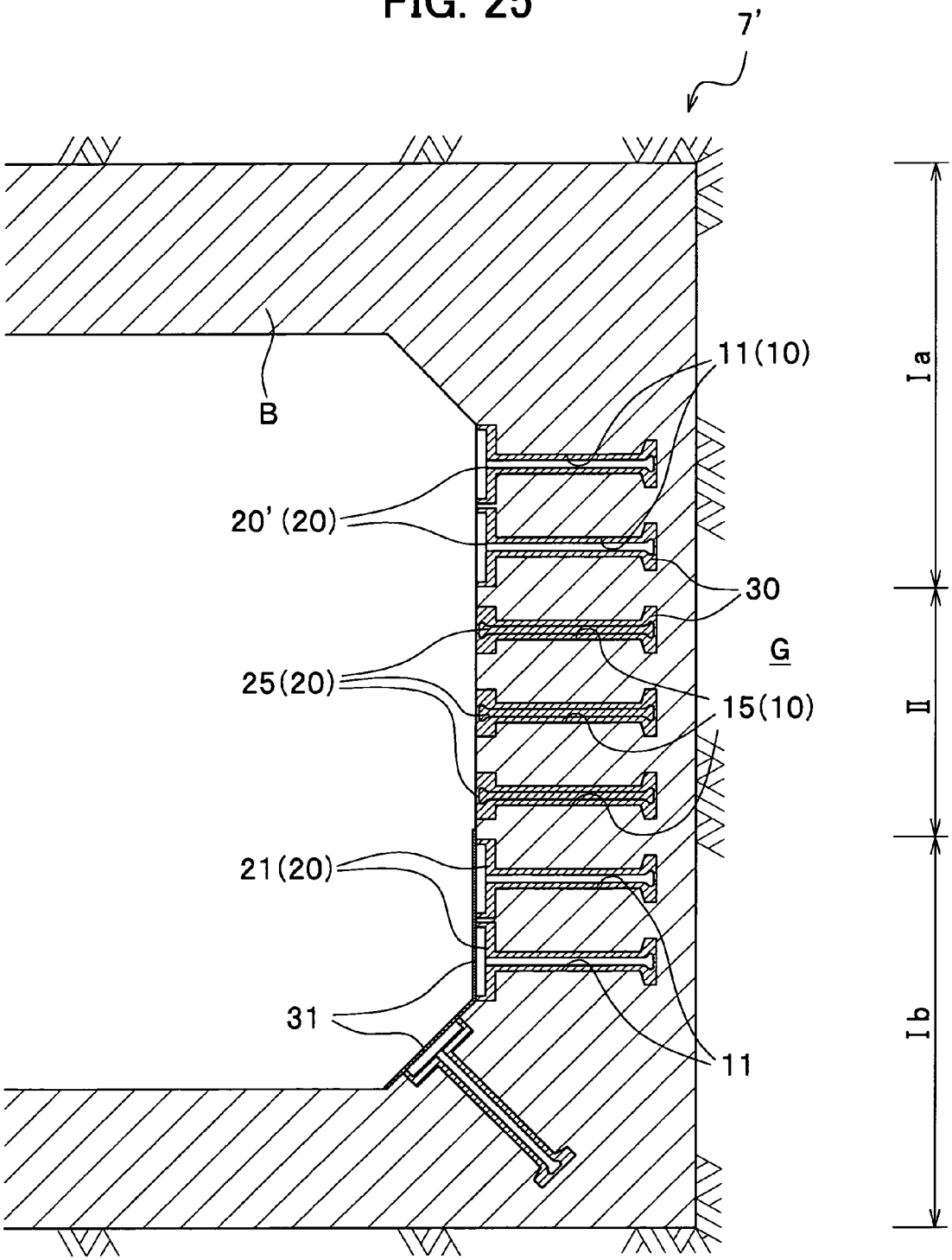
FIG. 25 is a section view showing a shearing force reinforced structure related to an eighth embodiment.
Figure 26:
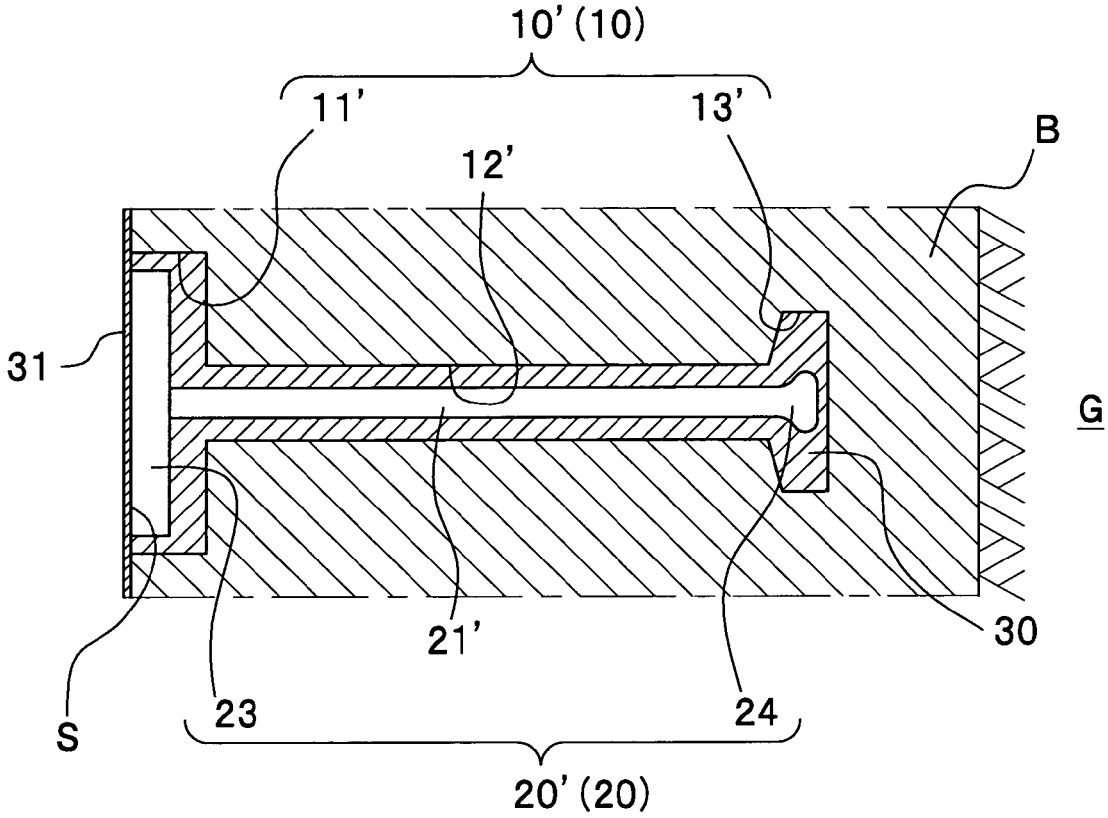
FIG. 26 is a section view showing a placement state of a first shearing force reinforced member related to the eighth embodiment.

As shown in FIG. 25, a shearing force reinforced structure 7' related to the eighth embodiment comprises the box culvert B of an existing reinforced concrete structure; the first shearing force reinforced members 20' arranged inside the first reinforced member insertion holes 10' formed in positions (see FIG. 24C), where plastic hinges are assumed to occur due to a seismic force, and first areas Ia, Ib of a vicinity of the positions; the second shearing force reinforced members 25 arranged inside the second reinforced member insertion holes 15 formed in the second area II of other areas; the fillers 30 filled in the holes 10' and the holes 15; and fiber sheets 31 integrally adhered to surfaces of the plate heads 23 of the members 20' and that of the culvert B (see FIG. 26).

As shown in FIG. 25, each of reinforced member insertion holes 10 is drilled from the inner face side to outer face side of the box culvert B in order to place the shearing force reinforced member 20; in the eighth embodiment the reinforced member insertion holes 10 are formed at total eight places: two places in a side wall part of the upper first area Ia, two places in a side wall part of the lower first area Ib, one place at a haunch part, and three places in the second area II. Meanwhile, the reinforced member insertion holes 10, other configurations, and a forming method related to the eighth embodiment is similar to the content shown in the seventh embodiment, a detailed explanation thereof will be omitted.

As shown in FIG. 25, the shearing force reinforced member 20 comprises: the first shearing force reinforced members 20' arranged in the first reinforced member insertion holes 10' at five places, two places formed in the first area Ia near an upper corner of the box culvert B, two formed in the first area Ib near a lower corner of the culvert B, and one formed at the haunch part; and the second shearing force reinforced members 25 inserted in the second reinforced member insertion holes 15 at three places formed in the second area II near the center of the side wall of the culvert B.

The first shearing force reinforced member 20' has a length approximately same as a depth of the first reinforced member insertion hole 10', and in a state of being arranged in the hole 10', is formed so that its joining face with the first shearing force reinforcing bar21' of the plate head 23 and the opposite surface match the inner face of the box culvert B.

Meanwhile, because such other detailed configurations of the first shearing force reinforced member 20' are similar to the content shown in the seventh embodiment, a detailed explanation thereof will be omitted. In addition, because such configurations of the second shearing force reinforced member 25 are similar to the content shown in the seventh embodiment, a detailed explanation thereof will be omitted. In addition, as the filler 30 is used same one used in the seventh embodiment.

As shown in FIG. 25, the fiber sheets 31 are adhered to three plate heads 23 of the three first shearing force reinforced members 20' in the lower first area Ib of the box culvert B and the inner face of the culvert B and integrated. Meanwhile, a material of the fiber sheet 31 is not limited if it is a high strength fiber sheet such as a carbon fiber sheet and an aramid fiber sheet.

A construction of the shearing force reinforced structure 7' related to the eighth embodiment is performed by drilling the reinforced member insertion hole 10, filling the filler 30 in the hole 10, arranging the shearing force reinforced member 20 in the hole 10, then making the fiber sheets 31 adhere to surfaces of the plate heads 23 of the three first shearing force reinforced members 20' and the inner face of the box culvert B, and integrating them.

Next will be described a reinforcement effect of an out-of-plane shear force capacity and an improvement effect of a bending toughness performance according to the shearing force reinforced structure 7' of the eighth embodiment.

In accordance with the shearing force reinforced structure 7', with respect to the damage of the plastic hinge PH shown in FIG. 24C, it is enabled to further improve a toughness performance in addition to the effect of the shearing force reinforced structure 7 shown in the seventh embodiment. In other words, because the fiber sheets 31 are directly adhered to the plate heads 23 of the first shearing force reinforced members 20', they do not peel off the face, and a mutual constraint effect by the internal concrete and the heads 23 can be expected.

Thus in the shearing force reinforced structures related to the present invention a shearing force reinforced member is directly embedded inside an existing RC structure face/slab material without increasing a concrete thickness of the material, and therefore, the structures can efficiently realize to increase shear force capacity and a toughness performance, and thus can prevent an inconvenience from occurring that an inside space section decreases after a reinforcement as in such a reinforced concrete thickness increasing method. In addition, because an out-of-plane shear force capacity can be improved without increasing a bending moment capacity thanks to no increase of a major reinforcing bar, it is enabled to change an RC structure body having a possibility of a shearing preceding failure to bending preceding one.

In addition, because the increase of the drilled hole diameter by the ring head 22 provided at the top end of the shearing force reinforcing bar21 in the shearing force reinforced member 20 related to the first embodiment is only around 30% to 50%, compared to the reinforcing bar diameter of the reinforcing bar 21, not only the execution of the reinforced member insertion hole 10 is easy but also a reinforcement can be economically performed. In addition, upon ensuring a predetermined pulling-out rigidity, it is enabled to efficiently perform the execution of the reinforced member insertion hole 10 and the processing of a fixation member.

Because a base end fixation member provided at a base end of a shearing force reinforcing bar and a top end fixation member at a top end thereof can obtain a sufficient fixation effect, and a tensile force acts on the shearing force reinforcing bar21 if an out-of-plane shearing force occurs, a supporting forces works on the base end fixation member, or the top end fixation member and the base end fixation member, and a compression stress field is formed in an internal concrete; therefore, a shearing resistance force of the internal concrete itself increases for shearing, and it becomes an effective shearing force reinforcement.

Furthermore, because the reinforced member insertion hole 10 is shielded from outside by the filler 30, a suppression of a degradation can be expected in a viewpoint of a durability after the reinforcement.

In addition, in the shearing force reinforced structure 2 related to the second embodiment, because the drilled hole diameter of the reinforced member insertion hole 10 is formed into around 120% to 130% of the reinforcing bar diameter of the shearing force reinforcing bar21', the structure 2 is good in work efficiency, and the integration with the side wall W is completed only by inserting the shearing force reinforced member 20' in the hole 10 where the filler 30 is filled, and filling the filler 30 in a space inside the plate head 23, an execution property is excellent, compared to a method of filling the filler 30 after the insertion of the shearing force reinforced member 20. However, because the top end is the acute part 25, a fixation effect near the top end cannot be expected so much.

In addition, in accordance with the shearing force reinforcement methods of the third to fifth embodiments, increases of shear force capacity and a toughness performance can be efficiently realized by directly forming a shearing force reinforcing bar and each plate head provided at both ends of the reinforcing bar inside the RC structure face/slab material as an out-of-plane shearing reinforcement of the material.

In addition, in accordance with shearing force reinforcement methods of the third to fifth embodiments, a drilled hole diameter of a general part of the reinforced member insertion hole 10 may be 120% to 130% of the shearing force reinforcing bar41 or 41', a work efficiency is good, and an execution property is excellent.

In addition, although the top plate head fixed at the top end of the shearing force reinforcing bar can be easily attached, a fixed degree is high and a fixation effect of the reinforcing bar can be sufficiently brought out.

In addition, in a shearing force reinforcement method related to the third embodiment, because an execution is completed only by filling a plastic cement mortar, then arranging a shearing force reinforced member, and grinding the filler 30 in a space outside each plate head fixed at both ends of the member, the method can shorten an execution period and is also economically excellent, compared to a conventional thickness increasing method and steel plate lining method.

In addition, a drilled hole diameter to insert a shearing force reinforced member may be a few larger than a diameter of a top end fixation member or a shearing force reinforcing bar and is smaller, a rapid execution is enabled and a work efficiency is better.

In addition, a high strength fiber filler related to the sixth embodiment becomes integrated with a shearing force reinforced member and realizes a fixation effect of a higher rigidity at width broadening parts at both ends of a reinforced member insertion hole. Therefore, a fixed degree between the width broadening parts at the both ends of the hole and the shearing force reinforced member is higher, and a fixation effect of the member can be sufficiently brought out.

In addition, because a reinforced member insertion hole is shielded from outside by a filler, a suppression of a degradation can be expected in a viewpoint of a durability after a reinforcement.

In addition, in accordance with the shearing force reinforced structures 7, 7' related to the seventh and eighth embodiments, because the reinforced member insertion hole 10 is shielded from outside by the filler 30 or the fiber sheet 31, a suppression of a degradation can be expected in a viewpoint of a durability after a reinforcement.

In addition, it is enabled to perform a reinforcement of an economical configuration by selecting a shape of the base end of the shearing force reinforced member 20 according to a distribution of a bending moment occurring in earthquake, and by constructing a reasonable structure for bringing out a toughness performance.

Furthermore, because although it is not generally enabled to perform a shearing force reinforcement for a bottom slab of the box culvert B, a safety performance is totally improved in the culvert B, a shearing force reinforcement of the bottom slab is not necessary.

Thus the preferred embodiments with respect to the present invention have been described. However, the present invention is not limited to each of the embodiments; it goes without saying that each of the components is appropriately variable in design with the spirit and scope of the invention.

Particularly, an RC structure body of an objective of a shearing force reinforced structure in the present invention is not limited to the embodiments, it may be a structure of such a culvert, a wall type bridge, and a footing In addition, an existing RC structure body of a reinforcement objective may be an RC structure, and a kind thereof is not requested such as a cast-in-place and a pre-cast concrete product; a region where a reinforcement is performed is also not limited, and the RC structure is applicable to such a bottom slab.

In addition, an insertion interval and number of shearing force reinforced members are not limited to the embodiments, and can be appropriately defined.

In addition, a ring head provided at a top end of a shearing force reinforced member may be formed into an acute angle not to enwind air by the top end of the member in inserting the member in a reinforced member insertion hole.

In addition, although in the second embodiment is used a shearing force reinforced member where an acute part is formed at a top end thereof, the member is not limited thereto; for example, it is also available to use the member where nothing is processed at the top end; another member where a fixation part of a section shape larger than a reinforcing bar diameter of the member is formed by being heated and then pushed to such a steel plate; and the like.

In addition, an existing RC structure body of a reinforcement objective may be an RC structure, a kind thereof is not requested such as a cast-in-place and a pre-cast concrete product, and a region where a reinforcement is performed is also not limited In addition, in the third to fifth embodiments, although it is assumed to insert a shearing force reinforcing bar from left of an intermediate wall, it goes without saying that the insertion direction is not limited thereto.

In addition, in a base end plate head of each of the embodiments, although it is assumed to fix a rectangular steel plate to a shearing force reinforcing bar by friction pressure joining, it is not limited thereto; for example, it is also available to form a female thread at the head, thereby to process a male thread also at a base end of the reinforcing bar similarly to a top end thereof, and to screw the reinforcing bar in the head; or to use a thread reinforcing bar as the reinforcing bar and to screw the reinforcing bar in the head.

In addition, shear force capacity reinforcement and toughness performance of a side wall of an existing RC structure may also be improved by constructing a shearing force reinforced structure comprising: the sidewall; a shearing force reinforced member having a base end fixation member arranged in a reinforced member insertion hole formed in the side wall; a filler filled in the hole; and a fiber sheet adhered to a surface of the side wall and that of the base end fixation member of the shearing force reinforced member, and integrated.

In addition, in the eighth embodiment, although directly adhering a fiber sheet to a plate head is described, if with respect to a filler filled in a first base end width broadening part is used the filler of a material that can attain a sufficient fixation force with a first shearing force reinforcing bar and be integrated with the reinforcing bar, it is enabled to obtain an effect of making the sheet adhere to the head by making the sheet adhere to a surface of the filler without directly making the sheet adhere to the head.

In addition, although in the eighth embodiment it is assumed to make a fiber sheet adhere only to a lower first area, it is not limited thereto; for example, the sheet may be adhered to an upper first area or a whole of an inner face of a box culvert.

In addition, in the seventh and eighth embodiments, although a second shearing force reinforced member where protrusion parts are respectively formed at both ends of the member is assumed to be used, if fillers filled inside a second top end width broadening part and a second base end width broadening part have a sufficient fixation force for a tensile force in earthquake, and the fillers and the member can be integrated, the protrusion parts may not be formed at the both ends of the member.

Similarly, a protrusion part formed at a top end of a first shearing force reinforcing bar can also be omitted according to a fixation force with a filler for a tensile force in earthquake.

In addition, it goes without saying that a shape of a base end fixation member formed at a base end of a first shearing force reinforced member is appropriately set according to a stress that acts on an RC structure object.

In addition, in the embodiments, although a first top end fixation member, a second top end fixation member, and a second base end fixation member are assumed to be same, it goes without saying that the members need not to be same.

In addition, although as a first base end fixation member a plate material having a width of ten to 15 folds of a first wire rod is assumed to be used, the size of the member is not limited thereto.

In addition, in each of the embodiments, although it is assumed to fill a filler composed of a fiber reinforced cementitious composite material in a whole of a reinforced member insertion hole, it is not limited thereto; for example, it is also available to fill a high strength fiber filler only in a top end width broadening part and a base end width broadening part and to fill a filler of a normal strength in a general part.

In addition, a blending of an aggregate and a pozzolan reaction particle composing a filler is not limited to that described in the embodiment; the aggregate is available if a maximum particle diameter thereof is not more than 2.5 mm, and the pozzolan reaction particle is available if a particle diameter thereof is in a range of 0.01 to 15 μm.

In addition, although a silica fume is assumed to be mixed in the filler, the pozzolan reaction particle is not limited to the silica fume.

In addition, if the filler can attain a predetermined compression strength (not less than 200 N/mm$^2$), a predetermined bending tensile strength (not less than 40 N/mm$^2$), and an adhesion strength to a predetermined deformed reinforcing bar (60 to 80 N/mm$^2$), it is not limited to the embodiment; for example, such a cement mortar and an epoxy resin may also be used.

The invention claimed is:

1. A shearing force reinforced structure comprising:

an existing reinforced concrete structure object having an inner face side and an outer face side, said existing reinforced concrete structure object being substantially of a similar material throughout and substantially void of gaps in the material;

a shearing force reinforced member mainly made of a solid wire rod, the solid wire rod being arranged between the inner face side and the outer face side inside a reinforced member insertion hole formed in the existing reinforced concrete structure object between the inner face side and the outer face side; and a filler filled in the reinforced member insertion hole, wherein the reinforced member insertion hole comprises a general part having an inner diameter larger than a diameter of the wire rod, and a base end width broadening part formed at a base end of the reinforced member insertion hole and having an inner diameter larger than the general part; and the general part and the base end width broadening part are both formed entirely within the existing reinforced concrete structure object.

2. The shearing force reinforced structure according to claim 1, wherein a top end width broadening part having an inner diameter larger than the general part is formed at a top end of the reinforced member insertion hole.

3. The shearing force reinforced structure according to claim 1, wherein the shearing force reinforced member comprises a shearing force reinforcing bar of the wire rod; and a base end fixation member that is formed at a base end of the shearing force reinforcing bar and of which a section shape is larger than a reinforcing bar diameter of the shearing force reinforced reinforcing bar.

4. The shearing force reinforced structure according to claim 3, wherein at a top end of the shearing force reinforcing bar is formed a top end fixation member of which a section shape is larger than a reinforcing bar diameter of the shearing force reinforced reinforcing bar.

5. The shearing force reinforced structure according to claim 3, wherein a fiber sheet is adhered to a surface of the reinforced concrete structure object and that of the base end fixation member, and the fiber sheet and the shearing force reinforced member are integrated.

6. The shearing force reinforced structure according to claim 1, wherein an adhesion strength of the filler is not less than 60 N/mm$^2$ in a case that the wire rod is a deformed reinforcing bar.

7. The shearing force reinforced structure according to claim 1, wherein the filler is a fiber reinforced cementitious composite material where a fiber is mixed in a cementitious matrix.

8. The shearing force reinforced structure according to claim 7, wherein the fiber reinforced cementitious composite material is formed by: blending a fiber, of which a diameter is 0.05 to 0.3 mm and a length is 8 to 16 mm, by around 1 to 4% for a volume of a cementitious matrix obtained by mixing cement, an aggregate of which a maximum particle diameter is not more than 2.5 mm; a pozzolan reaction particle of which a diameter is 0.01 to 15 mm; and at least one kind of super plasticizer; and water.

9. The shearing force reinforced structure according to claim 1, wherein a fiber sheet is adhered to a surface of the reinforced concrete structure object; and the fiber sheet and the shearing force reinforced member are integrated.

10. A shearing force reinforced structure comprising:

an existing reinforced concrete structure object having an inner face side and an outer face side;

a first shearing force reinforced member arranged inside a first reinforced member insertion hole and a second shearing force reinforced member arranged inside a second reinforced member insertion hole formed in the existing reinforced concrete structure object; and a filler filled in the first reinforced member insertion hole and the second reinforced member insertion hole, wherein the first shearing force reinforced member comprises a first wire rod, and a first base end fixation member formed at a base end of the first wire rod, at a top end of the first shearing force reinforced member is formed a first top end fixation member, wherein the first base end fixation member and the first top end fixation member are arranged within the first reinforced member insertion hole between the inner face side and the outer face side of the existing reinforced concrete structure object; and the first base end fixation member and the first top end fixation member have section shapes larger than a section shape of the first wire rod at any location along the first wire rod.

11. The shearing force reinforced structure according to claim 10, wherein the reinforced concrete structure object comprises a rahmen structure, and the first reinforced member insertion hole is formed at a corner of the reinforced concrete structure object.

12. The shearing force reinforced structure according to claim 10, wherein in the first base end fixation member, at a base end of the first wire rod is fixed a plate member configured with a width not less than 5 times and not more than 20 times a diameter of the first wire rod.

13. The shearing force reinforced structure according to claim 10, wherein a fiber sheet is adhered to an inner face of the reinforced concrete structure object, and the fiber sheet is integrated with the first wire rod.

14. The shearing force reinforced structure according to claim 10, wherein a fiber sheet is adhered to an inner face of the reinforced concrete structure object, and the fiber sheet is adhered to a surface of the reinforced concrete structure object and that of the first base end fixation member of the first wire rod and is integrated.

15. The shearing force reinforced structure according to claim 10, wherein in the first base end fixation member, at a base end of the first wire rod is fixed a plate member configured with a width not less than 10 times and not more than 15 times a diameter of the first wire rod.

16. A shearing force reinforced structure comprising:

an existing reinforced concrete structure object having an inner face side and an outer face side;

a first shearing force reinforced member arranged inside a first reinforced member insertion hole and a second shearing force reinforced member arranged inside a second reinforced member insertion hole formed in the existing reinforced concrete structure object; and a filler filled in the first reinforced member insertion hole and the second reinforced member insertion hole, wherein the first shearing force reinforced member comprises a first wire rod, and a first base end fixation member formed at a base end of the first wire rod and having a width larger than a diameter of the first wire rod, at a top end of the first shearing force reinforced member is formed a first top end fixation member having a width larger than a diameter of the first wire rod, and the first base end fixation member and the first top end fixation member are arranged within the first reinforced member insertion hole between the inner face side and the outer face side of the existing reinforced concrete structure object, and wherein the first reinforced member insertion hole comprises a first general part having an inner diameter larger than a diameter of the first wire rod, and a first base end width broadening part formed at a base end of the first reinforced member insertion hole and having an inner diameter larger than the first general part.

17. The shearing force reinforced structure according to claim 16, wherein at a top end of the first reinforced member insertion hole is formed a first top end width broadening part having an inner diameter larger than the first general part.

18. A shearing force reinforced structure comprising:

an existing reinforced concrete structure object having an inner face side and an outer face side;

a first shearing force reinforced member arranged inside a first reinforced member insertion hole and a second shearing force reinforced member arranged inside a second reinforced member insertion hole formed in the existing reinforced concrete structure object; and a filler filled in the first reinforced member insertion hole and the second reinforced member insertion hole, wherein the first shearing force reinforced member comprises a first wire rod, and a first base end fixation member formed at a base end of the first wire rod and having a width larger than a diameter of the first wire rod, at a top end of the first shearing force reinforced member is formed a first top end fixation member having a width larger than a diameter of the first wire rod, and the first base end fixation member and the first top end fixation member are arranged within the first reinforced member insertion hole between the inner face side and the outer face side of the existing reinforced concrete structure object, wherein the second shearing force reinforced member comprises a second wire rod, and a second base end fixation member formed at a base end of the second wire rod and having a width larger than a diameter of the second wire rod, and wherein the first base end fixation member has a width larger than that of the second base end fixation member.

19. The shearing force reinforced structure according to claim 18, wherein at a top end of the second shearing force reinforced member is formed and a second top end fixation member having a width larger than a diameter of the second wire rod.

20. A shearing force reinforced member arranged inside a reinforced member insertion hole formed in an existing reinforced concrete structure object between an inner face side and an outer face side of said reinforced concrete structure, the member comprising:

a solid wire rod having a length shorter than a total length of the reinforced member insertion hole which is formed in the existing reinforced concrete structure object, the solid wire rod being arranged within the reinforced member insertion hole between the inner face side and the outer face side, said existing reinforced concrete structure object being substantially of a similar material throughout and substantially void of gaps in the material; and a base end fixation member and a top end fixation member respectively having width sizes larger than a diameter of the solid wire rod and respectively fixed at a base end and top end of the solid wire rod.

21. The shearing force reinforced member according to claim 20, wherein a width size of the top end fixation member is formed to be 120% to 250% of a diameter of the wire rod.

22. The shearing force reinforced member according to claim 20, wherein at a top end of the wire rod a male thread member is integrally formed, and wherein the top end fixation member is configured with a steel plate of which a shape is a circle or a polygon, a thickness size is 80% to 120% of a diameter of the wire rod, and a width size is 200% to 300% of the diameter of the wire rod; a female thread is formed in the steel plate; and by screwing the male thread member of the wire rod into the female thread, the top end fixation member is fixed at the top end of the wire rod.

23. The shearing force reinforced member according to claim 20, wherein at a top end of the wire rod is processed a male thread, and wherein the top end fixation member is configured with a steel plate of which a shape is a circle or a polygon, a thickness size is 80% to 120% of a diameter of the wire rod, and a width size is 200% to 300% of the diameter of the wire rod; a female thread is formed in the steel plate; and by screwing the male thread of the wire rod into the female thread, the top end fixation member is fixed at the top end of the wire rod.

24. The shearing force reinforced member according to claim 20, wherein the wire rod is configured with a thread reinforcing bar, and wherein the top end fixation member is configured with a steel plate of which a shape is a circle or a polygon, a thickness size is 80% to 120% of a diameter of the wire rod, and a width size is 200% to 300% of the diameter of the wire rod; a female thread is formed in the steel plate; and by screwing the wire rod into the female thread, the top end fixation member is fixed at a top end of the wire rod.

25. The shearing force reinforced member according to claim 20, wherein in the base end fixation member, at a base end of the wire rod is fixed a steel plate of which a shape is a circle or a polygon, a thickness size is 30% to 120% of a diameter of the wire rod, and a width size is 130% to 300% of a diameter of the wire rod.

* * * * *